US007130551B2

(12) United States Patent
Kobayashi

(10) Patent No.: US 7,130,551 B2
(45) Date of Patent: Oct. 31, 2006

(54) COLOR IMAGE FORMING DEVICE AND COLOR DEVIATION DETECTION DEVICE FOR THE SAME

(75) Inventor: Kazuhiko Kobayashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 167 days.

(21) Appl. No.: 10/880,510

(22) Filed: Jul. 1, 2004

(65) Prior Publication Data

US 2005/0031361 A1 Feb. 10, 2005

(30) Foreign Application Priority Data

Jul. 31, 2003 (JP) ..... 2003-204841
Feb. 9, 2004 (JP) ..... 2004-032407
May 31, 2004 (JP) ..... 2004-161416

(51) Int. Cl.
*G03G 15/00* (2006.01)
*G03G 15/01* (2006.01)

(52) U.S. Cl. ..... 399/49; 399/301

(58) Field of Classification Search ..... 399/49, 399/301; 347/116; 430/44
See application file for complete search history.

(56) References Cited

U.S. PATENT DOCUMENTS 5,768,671 A * 6/1998 Komiya et al. ..... 399/301
5,946,537 A * 8/1999 Nakayasu et al. ..... 399/301
6,049,690 A * 4/2000 Nakayasu et al. ..... 399/301
6,167,221 A 12/2000 Kobayashi
6,603,495 B1 * 8/2003 Hayakawa ..... 347/116
6,708,017 B1 3/2004 Yamanaka et al.
6,714,224 B1 3/2004 Yamanaka et al.
2002/0136570 A1 * 9/2002 Yamanaka et al. ..... 399/301

OTHER PUBLICATIONS

U.S. Appl. No. 10/041,640, filed Jan. 10, 2002, Yamanaka et al.
U.S. Appl. No. 10/375,115, filed Feb. 28, 2003, Yamanaka et al.
U.S. Appl. No. 10/452,212, filed Jun. 3, 2003, Yamanaka et al.
U.S. Appl. No. 10/666,245, filed Sep. 22, 2003, Kobayashi.
U.S. Appl. No. 10/668,156, filed Sep. 24, 2003, Kobayashi et al.
U.S. Appl. No. 10/732,341, filed Dec. 11, 2003, Yamanaka et al.
U.S. Appl. No. 10/725,450, filed Dec. 3, 2003, Andoh et al.
U.S. Appl. No. 10/729,962, filed Dec. 9, 2003, Yamanaka et al.
U.S. Appl. No. 10/880,510, filed Jul. 1, 2004, Kobayashi.

* cited by examiner

*Primary Examiner*—Sandra L. Brase
(74) *Attorney, Agent, or Firm*—Oblon, Spivak, McClelland, Maier & Neustadt, P.C.

(57) ABSTRACT

A color deviation detection device for a color image forming device which prevents the occurrence of color deviation that is attributable to the fact that the precision of color deviation detection is low, the replacement of photosensitive bodies or developing devices is itself a cause of fluctuation in the color deviation, and the precision of the part before and after replacement is slightly different. In the color deviation detection device, the spacing between marks of the reference color and other colors, the spacing between marks of the same color and the spacing between mark sets are set as the spacing between marks within the mark sets and the spacing between mark sets, so that when the amount of color deviation is calculated for a synthesized wave comprising two or more driving irregularity frequencies that are generated by the image carrying body driving system and the transfer driving system, the calculation error caused by this synthesized wave is within a range that allows correction of the deviation of the image of a plurality of colors.

39 Claims, 67 Drawing Sheets

FIG. 18A

CONDITIONS OF
SYNTHESIZED WAVEFORM

| SYSTEM = | 1 | | | | | | | |
|---|---|---|---|---|---|---|---|---|
| ITEM | | FREQUENCY Hz | | PHASE deg | | AMPLITUDE ON ONE SIDE mm | | |
| A1 | OPC DRUM | f1 = | 1.3240486 | θ1 = | 270 | A1 = | 0.050 | 0.060 |
| A2 | DRUM MOTOR | f2 = | 11.4624780 | θ2 = | 0 | A2 = | 0.008 | 0.008 |
| A3 | IDLER GEAR | f3 = | 2.8656195 | θ3 = | 0 | A3 = | 0.016 | 0.016 |
| A4 | DRIVING ROLLER | f4 = | 1.2719970 | θ4 = | 0 | A4 = | 0.020 | 0.025 |
| A5 | INDEPENDENT MOTOR | f5 = | 3.8195517 | θ5 = | 0 | A5 = | 0.010 | 0.018 |
| A6 | LOWER RIGHT ROLLER | f6 = | 2.5509170 | θ6 = | 330 | A6 = | 0.060 | 0.050 |
| A7 | EXIT ROLLER | f7 = | 2.4740730 | θ7 = | 0 | A7 = | 0.015 | 0.015 |
| A8 | ENTRANCE ROLLER | f8 = | 1.9573750 | θ8 = | 360 | A8 = | 0.020 | 0.020 |

FIG. 18B

COEFFICIENT OF $\alpha$ A1+$\beta$ A2+$\gamma$ A3

| | $\alpha$ | $\beta$ | $\gamma$ |
|---|---|---|---|
| M | 1.0 | 1.0 | 0.0 |
| C | 1.0 | 1.0 | 0.0 |
| Y | 1.2 | 1.0 | 1.0 |
| K | 1.0 | 1.0 | 0.0 |

FIG. 18C $\eta$ (A4+A5+A6+A7+A8)

| | |
|---|---|
| $\eta$ = | 1 |

FIG. 18D

CONDITIONS OF PATTERN SPACING

| LINE SPACING | | mm |
|---|---|---|
| HORIZONTAL – HORIZONTAL | ma = | 3.514 |
| SAME COLOR HORIZONTAL – OBLIQUE | mb = | 17.314 |
| BETWEEN LINE GROUPS | L = | 36.787 |

REPETITION OF (Y HORIZONTAL – K HORIZONTAL – C HORIZONTAL – M HORIZONTAL – Y OBLIQUE – K OBLIQUE – C OBLIQUE – M OBLIQUE)

2.5 ~ 5.5 0.5mm STEP 17.5 ~ 35 0.5mm STEP

35 ~ 70 1.0mm STEP

LOWER RIGHT 0 DEGREES

LOWER RIGHT 60 DEGREES

LOWER RIGHT 180 DEGREES

LOWER RIGHT 210 DEGREES

LOWER RIGHT 240 DEGREES

LOWER RIGHT 300 DEGREES

LOWER RIGHT 330 DEGREES

LOWER RIGHT 30 DEGREES

LOWER RIGHT 90 DEGREES

LOWER RIGHT 150 DEGREES

LOWER RIGHT 180 DEGREES

LOWER RIGHT 210 DEGREES

LOWER RIGHT 300 DEGREES

LOWER RIGHT 330 DEGREES

LOWER RIGHT 210 DEGREES

FIG. 57A

FIG. 57 FIG. 57A FIG. 57B

| OPC PHASE | LOWER RIGHT ROLLER PHASE | ENTRANCE PHASE | Y-K HORIZON-TAL | C-K HORIZON-TAL | M-K HORIZON-TAL | Y-K OBLIQUE | C-K OBLIQUE | M-K OBLIQUE |
|---|---|---|---|---|---|---|---|---|
| 0 | 0 | 0 | 0.307345 | 0.806498 | 0.180898 | 6.323288 | 1.571618 | 4.393288 |
| | | 30 | 0.057814 | 1.178184 | 0.496450 | 5.384347 | 0.749605 | 2.794307 |
| | | 60 | 0.171669 | 1.352248 | 0.753480 | 4.976090 | 0.110108 | 1.634402 |
| | | 90 | 0.618402 | 1.282051 | 0.521319 | 5.207908 | 0.175521 | 1.224369 |
| | | 120 | 1.278311 | 0.986402 | 0.137825 | 6.017687 | 0.030747 | 1.674075 |
| | | 150 | 1.974575 | 0.544520 | 1.047335 | 7.188446 | 0.505637 | 2.863025 |
| | | 180 | 2.520630 | 0.074807 | 1.963507 | 8.406482 | 1.289907 | 4.472637 |
| | | 210 | 2.770161 | 0.296879 | 2.640856 | 9.345423 | 2.111920 | 6.071619 |
| | | 240 | 2.656307 | 0.470943 | 2.897885 | 9.753680 | 2.751418 | 7.231524 |
| | | 270 | 2.209574 | 0.400746 | 2.665724 | 9.521861 | 3.037047 | 7.641557 |
| | | 300 | 1.549664 | 0.105098 | 2.006580 | 8.712083 | 2.892273 | 7.191849 |
| | | 330 | 0.853400 | 0.336785 | 1.097071 | 7.541323 | 2.355889 | 6.002901 |
| | | 360 | 0.307345 | 0.806498 | 0.180898 | 6.323288 | 1.571618 | 4.393288 |
| 0 | 30 | 0 | 0.280079 | 0.804798 | 0.213836 | 6.342165 | 1.640795 | 4.570918 |
| | | 30 | 0.030548 | 1.176484 | 0.463512 | 5.403224 | 0.818782 | 2.971937 |
| | | 60 | 0.144403 | 1.350548 | 0.720541 | 4.994967 | 0.179284 | 1.812032 |
| | | 90 | 0.591135 | 1.280352 | 0.488380 | 5.226786 | 0.106345 | 1.401999 |
| | | 120 | 1.251045 | 0.984703 | 0.170763 | 6.036564 | 0.038429 | 1.851706 |
| | | 150 | 1.947309 | 0.542820 | 1.080273 | 7.207324 | 0.574813 | 3.040655 |
| | | 180 | 2.493364 | 0.073107 | 1.996445 | 8.425359 | 1.359084 | 4.650267 |
| | | 210 | 2.742895 | 0.298578 | 2.673794 | 9.364300 | 2.181097 | 6.249249 |
| | | 240 | 2.629041 | 0.472643 | 2.930823 | 9.772557 | 2.820594 | 7.409154 |
| | | 270 | 2.182308 | 0.402446 | 2.698662 | 9.540739 | 3.106223 | 7.819186 |

FIG. 57B

| | | | | | | | | |
|---|---|---|---|---|---|---|---|---|
| | | 300 | 1.522398 | 0.106797 | 2.039518 | 8.730960 | 2.961450 | 7.369479 |
| | | 330 | 0.826134 | 0.335085 | 1.130009 | 7.560201 | 2.425066 | 6.180531 |
| | | 360 | 0.280079 | 0.804798 | 0.213836 | 6.342165 | 1.640795 | 4.570918 |
| ⋮ | ⋮ | ⋮ | ⋮ | ⋮ | ⋮ | ⋮ | ⋮ | ⋮ |
| 270 | 330 | 0 | 0.367078 | 0.768457 | 0.227727 | 6.374012 | 1.571808 | 4.341562 |
| | | 30 | 0.117547 | 1.140142 | 0.449621 | 5.435071 | 0.749795 | 2.742581 |
| | | 60 | 0.231401 | 1.314207 | 0.706650 | 5.026814 | 0.110298 | 1.582676 |
| | | 90 | 0.678134 | 1.244010 | 0.474489 | 5.258632 | 0.175331 | 1.172643 |
| | | 120 | 1.338044 | 0.948361 | 0.184655 | 6.068411 | 0.030558 | 1.622350 |
| | | 150 | 2.034308 | 0.506479 | 1.094164 | 7.239170 | 0.505826 | 2.811299 |
| | | 180 | 2.580363 | 0.036765 | 2.010337 | 8.457206 | 1.290097 | 4.420911 |
| | | 210 | 2.829894 | 0.334920 | 2.687685 | 9.396147 | 2.112110 | 6.019892 |
| | | 240 | 2.716039 | 0.508984 | 2.944714 | 9.804404 | 2.751608 | 7.179797 |
| | | 270 | 2.269306 | 0.438788 | 2.712553 | 9.572585 | 3.037237 | 7.589830 |
| | | 300 | 1.609397 | 0.143139 | 2.053410 | 8.762807 | 2.892463 | 7.140123 |
| | | 330 | 0.913133 | 0.298743 | 1.143900 | 7.592047 | 2.356079 | 5.951174 |
| | | 360 | 0.367078 | 0.768457 | 0.227727 | 6.374012 | 1.571808 | 4.341562 |
| | | max | 6.351051 | 3.064264 | 9.685688 | 10.664870 | 4.877646 | 15.913980 |
| | | min | 0.035439 | 0.749954 | 0.020575 | 0.614067 | 1.685997 | 0.077159 |
| | | av | 2.949567 | 1.905115 | 4.480446 | 4.650463 | 3.227886 | 7.004521 |

COLOR IMAGE FORMING DEVICE AND COLOR DEVIATION DETECTION DEVICE FOR THE SAME

BACKGROUND OF THE INVENTION

1. Field of the Invention

The present invention relates to a color deviation detection method, a color deviation detection device, a color deviation detection and correction method, a color deviation detection and correction device, a color image forming device and a process cartridge which make it possible to increase the reliability of color deviation detection, greatly reduce the error caused by the arrangement of marks in test patterns, and increase the precision of color deviation correction.

2. Description of the Related Art

For example, color deviation detection methods for detecting the positional deviation of pixels of a plurality of colors in color image forming devices are disclosed in Japanese Patent No. 2,573,855, Japanese Patent Application Laid-Open No. 11-65208, Japanese Patent Application Laid-Open No. 11-102098, Japanese Patent Application Laid-Open No. 11-249380, Japanese Patent Application Laid-Open No. 2000-112205 and the like. In these conventional color deviation detection methods, toner marks of respective colors are respectively formed in specified alignment patterns on a transfer belt (near both ends of this belt in the lateral direction) in which transfer paper is supported and conveyed along an arrangement of a plurality of photosensitive drums, and toner images of respective colors on the abovementioned plurality of photosensitive drums are transferred onto this transfer paper, the toner marks at the respective ends of the transfer belt are respectively read by a pair of optical sensors, and the positions of the respective marks of the mark arrangements (patterns) are calculated on the basis of these reading signals. Furthermore, the amount of deviation of the respective color images from a reference position in the sub-scanning direction (direction of movement of the transfer belt), the amount of deviation in the main scanning direction (lateral direction of the transfer belt), the amount of deviation of the effective line length of the main scanning lines and the skewing of the main scanning lines are calculated.

In the optical sensors, the reflected light or transmitted light of the transfer belt is received via slits by photo-electric conversion elements such as photo-transistors or the like, this light is converted into a voltage (analog detection signal) that indicates the amount of received light, and this voltage is corrected to a specified level range by an amplifier circuit. Accordingly, a detection signal of (for example) 5 V (high level: H) is obtained in cases where no marks are present in front of the abovementioned slits, and a detection signal of (for example) 0 V (low level: L) is obtained in cases where marks are present so that the entire surfaces of the abovementioned slits are covered.

However, since the transfer belt moves at a constant speed, the levels of the detection signals of the optical sensors gradually drop when the leading edges of marks enter the visual fields inside the slits of the optical sensors, the detection signals of the optical sensors remain at 0 V while the marks cover the entire surfaces of the slits, the levels of the detection signals of the optical sensors gradually rise when the trailing edges of the marks enter the visual fields inside the slits, and the detection signals of the optical signals return to 5 V when the marks have completely passed by the slits. This is an ideal case; in actuality, the detection signals of the optical sensors show a level fluctuation.

In cases where a level fluctuation is generated in the detection signals of the optical sensors, a binary signal distribution (with L corresponding to the marks) of a time series corresponding to the mark distribution is obtained by binarizing the detection signals of the optical sensors with (for example) the intermediate value of 2.5 V between 5 V and 0 V taken as the threshold value. Accordingly, the mark patterns can be grasped by binarizing the detection signals of the optical sensors by means of a comparator, counting clock pulses or timing pulses of a frequency that is proportional to the movement speed of the transfer belt, and storing the count value at the time that the output signal of the comparator changes from H to L and the count value at the time that this output signal changes from L to H in memory.

However, in the detection signals of the optical sensors, the level shifts during mark pattern detection and the changes in height with a relatively short period are large and numerous, and the level of the detection signals of the optical sensors also varies according to the color of the marks (type of toner). High-frequency noise of the detection signals of the optical sensors can be suppressed by passing the detection signals of the optical sensors through a low-pass filter; however, if the cut-off frequency is shifted toward a lower region in order to strengthen this suppression, the L pulse width corresponding to the mark width of the binary signals from the comparator shows an increased fluctuation in width, so that mark pattern recognition, and especially specification of the positions of the respective marks, becomes difficult. These problems become more severe with increasing contamination and scratching of the transfer belt, so that even if the useful life of the transfer application of the transfer belt is long, mark pattern detection for the purpose of color adjustment soon becomes impossible.

Accordingly, attempts have been made to identify data group positions corresponding to a reference waveform, and thus to recognize mark patterns, by repeatedly subjecting the detection signals of the optical sensors to an A/D conversion in a short period, collecting these converted signals in the memory, and performing a check of matching with the reference waveform or frequency distribution of the detection signals based on the data in the memory. In this case, however, the amount of data that is handled is greatly increased so that a large memory capacity is required; in addition, the pattern identification processing is complicated, and requires a long processing time.

Incidentally, the positions of the respective marks of the mark patterns in the movement direction of the transfer belt tends to fluctuate. For example, in cases where eccentricity or rotational irregularities are generated in the photosensitive drums or driving roller of the transfer belt, the positions of the marks show a deviation. A procedure in which marks of the same color are formed in two places at a pitch of one half of the circumference of the photosensitive drums, the amount of deviation of these positions with respect to a reference position is detected, and the mean value of this detected value is calculated as the amount of deviation, and in which such detection of the amount of deviation is further repeated a plurality of times (n times), and the mean value of 1/n is determined, in order to reduce the error of color deviation detection caused by such fluctuation in the positions of the marks, is disclosed in Patent Reference 2.

Furthermore, a procedure in which mark sets comprising arrangements of marks of respective colors are formed at a pitch of one fourth of the circumference, so that four sets are formed in the circumferential length of the photosensitive drums 1, the positional deviation of the respective marks on the transfer belt with respect to a reference position is detected following the transfer of these mark sets onto the transfer belt, and the mean value of the amount of positional deviation of the marks of the same color (four marks) is calculated, is disclosed in the abovementioned Japanese Patent Application Laid-Open No. 2000-112205.

Furthermore, if there is eccentricity in the photosensitive drums, the photosensitive drums show a maximum radius in a certain position, and show a minimum radius in a position located one-half circumference from this [maximum position]. In cases where there is elliptical distortion in the photosensitive drums, the position located one-half circumference from the position where a maximum radius is shown by the photosensitive drums is also a position where the radius is close to maximum. Accordingly, in a configuration in which marks of the same color are formed at a pitch of one half or one fourth of the circumference of the photosensitive drums, the averaging effect of the mean value is low. Specifically, the reliability of the measurements of the amount of deviation is low.

Furthermore, in the case of fluctuation components in products in which the circumferential length is longer than the total length of the plurality of mark sets, i.e., the pattern group length, measurements of the amount of deviation cannot be accurately performed using conventional pattern dispositions, so that correction that is conversely erroneous is commonly performed.

In the prior art, although the dispositions of the respective marks are taken into account for the respectively independent fluctuation waveforms with regard to fluctuations in the photosensitive body period and transfer belt driving roller period when calculating the mean values of the amounts of positional deviation of the images of respective colors, conventional methods do not go so far as to calculate the mean values of the amounts of positional deviation of the respective colors with respective marks disposed in the synthesized wave of these waveforms or a synthesized wave that includes the frequencies involved in the photosensitive body driving system and transfer belt driving system; accordingly, the precision of color deviation detection in such methods is low. Furthermore, the work of replacing the photosensitive bodies or developing devices is itself a cause of fluctuation in the color deviation, and color deviation caused by slight differences in the part precision before and after such replacement also occurs.

Furthermore, in the prior art, accurate measurements of the amount of deviation cannot be performed in the case of fluctuation components of products with a circumferential length that is longer than the pattern group length, so that there is on the contrary a possibility that an erroneous correction amount will be calculated. Conventionally, in order to avoid this problem at least to some extent, this has been countered by greatly improving the precision of one circumferential deviation of products with a long circumferential length. Naturally, this has contributed greatly to the cost involved, so that such parts are among the most expensive parts used in image forming devices.

SUMMARY OF THE INVENTION

It is an object of the present invention to provide a color deviation detection method, color deviation detection device, color image forming device, color deviation detection and correction method and color deviation detection and correction device which can improve the reliability of color deviation detection by actually taking into account the numerous causes of fluctuation, and considering and setting pattern dispositions in a state close to the fluctuations on the transfer medium in which these fluctuations occur, and which can improve the precision of color deviation correction by greatly reducing the error caused by the arrangement of the marks in mark patterns.

It is also an object of the present invention to provide a color deviation detection method, color deviation detection device, color image forming device, color deviation detection and correction method and color deviation detection and correction device which can shorten the time required for color deviation correction.

It is also an object of the present invention to provide a color deviation detection method, color deviation detection device, color image forming device, color deviation detection and correction method and color deviation detection and correction device which can detect the positions of the respective marks by means of relatively simple processing.

It is also an object of the present invention to provide a color deviation detection method, color deviation detection device and color image forming device which can reduce the amount of detection data requiring storage in memory.

It is also an object of the present invention to provide a color deviation detection method, color deviation detection device, color image forming device, color deviation detection and correction method and color deviation detection and correction device which allow the relatively easy detection of deviations between superimposed images of respective colors in color image formation.

It is also an object of the present invention to provide a color image forming device and process cartridge which can eliminate color deviation caused by unit replacement.

It is also an object of the present invention to provide a color deviation detection method, color deviation detection device, color image forming device, color deviation detection and correction method and color deviation detection and correction device which can suppress an increase in cost, and which can improve the precision of color deviation correction.

In accordance with the present invention, there is provided a color deviation detection method in which a plurality of mark sets constructed by arrangements of marks of respective colors that are lined up in the direction of movement are formed on a transfer medium in a color image forming device in which an image carrying body is rotated by an image carrying body driving system, the transfer medium is rotated by a transfer driving system, an image of a plurality of colors is formed on the image carrying body, and this image of a plurality of colors is superimposed on and transferred onto the transfer medium, and the respective marks of this plurality of mark sets are detected by sensors so that the amount of deviation of the image is detected. In this method, 1. the spacing between marks of the reference color and other colors 2. the spacing between marks of the same color, and 3. the spacing between mark sets, are set as the spacing between marks within the mark sets and the spacing between mark sets, so that when the amount of color deviation is calculated for a synthesized wave comprising two or more driving irregularity frequencies that are generated by the image carrying body driving system and the transfer driving system, the calculation error caused by the synthesized wave is within a range that allows correction of the deviation of the image of a plurality of colors.

In accordance with the present invention, there is also provided a color deviation detection method in which a plurality of mark sets constructed by arrangements of marks of respective colors that are lined up in the direction of movement are formed on a transfer medium in a color image forming device in which an image carrying body is rotated by an image carrying body driving system, the transfer medium is rotated by a transfer driving system, an image of a plurality of colors is formed on the image carrying body, and this image of a plurality of colors is superimposed on and transferred onto the transfer medium, and the respective marks of this plurality of mark sets are detected by sensors so that the amount of deviation of the image is detected. In this method, 1. the spacing between marks of the reference color and other colors, 2. the spacing between marks of the same color, and 3. the spacing between mark sets, are set as the spacing between marks within the mark sets and the spacing between mark sets, so that when the amount of color deviation is calculated for a synthesized wave comprising two or more driving irregularity frequencies that are generated by the image carrying body driving system and the transfer driving system, the calculation error caused by the synthesized wave is 20 μm or less.

In accordance with the present invention, there is also provided a color deviation detection device for a color image forming device in which an image carrying body is rotated by an image carrying body driving system, a transfer medium is rotated by a transfer driving system, an image of a plurality of colors is formed on the image carrying body, and this image of a plurality of colors is superimposed on and transferred onto the transfer medium. The color deviation detection device comprises test pattern forming means for forming a plurality of mark sets comprising arrangements of marks of a plurality of colors that are lined up in the movement direction within the range of the circumference of the transfer medium, sensors that detect the marks, conversion means for converting detection signals of the sensors into digital data, a memory in which the converted data from the conversion means is stored with the positions specified, and calculating means for calculating the positions of the respective marks on the basis of the data in the memory, and calculating the mean values of the amounts of deviation of the different mark sets with respect to the reference positions of marks of the same color.

In accordance with the present invention, there is also provided a color image forming device in which an image carrying body is rotated by an image carrying body driving system, a transfer medium is rotated by a transfer driving system, an image of a plurality of colors is formed on the image carrying body, and this image of a plurality of colors is superimposed on and transferred onto the transfer medium. The color image forming device comprises test pattern forming means for forming a plurality of mark sets comprising arrangements of marks of a plurality of colors that are lined up in the movement direction within the range of the circumference of the transfer medium, sensors that detect the marks, conversion means for converting detection signals of the sensors into digital data, a memory in which the converted data from the conversion means is stored with the positions specified, calculating means for calculating the positions of the respective marks on the basis of the data in the memory, and calculating the mean values of the amounts of deviation of the different mark sets with respect to the reference positions of marks of the same color, and color adjustment means for adjusting the image formation timing of the image of a plurality of colors on the basis of the mean values of the amounts of deviation calculated by the calculating means.

In accordance with then present invention, there is also provided a process cartridge which is disposed in a detachable manner in the main body of a color image forming device in which an image carrying body is rotated by an image carrying body driving system, a transfer medium is rotated by a transfer driving system, an image of a plurality of colors is formed on the image carrying body, and this image of a plurality of colors is superimposed on and transferred onto the transfer medium. The process cartridge is constructed by being combined with at least one of charging means, developing means and cleaning means for forming an image of a plurality of colors on the image carrying body. The image forming device further comprises test pattern forming means for forming a plurality of mark sets comprising arrangements of marks of a plurality of colors that are lined up in the movement direction within the range of the circumference of the transfer medium, sensors that detect the marks, conversion means for converting detection signals of said sensors into digital data, a memory in which the converted data from the conversion means is stored with the positions specified, calculating means for calculating the positions of the respective marks on the basis of the data in said memory, and calculating the mean values of the amounts of deviation of the different mark sets with respect to the reference positions of marks of the same color, and color adjustment means for adjusting the image formation timing of the image of a plurality of colors on the basis of the mean values of the amounts of deviation calculated by the calculating means.

In accordance with the present invention, there is provided a color deviation detection and correction method in which the amount of deviation of an image is detected by a color deviation detection method in which a plurality of mark sets constructed by arrangements of marks of respective colors that are lined up in the direction of movement are formed on a transfer medium in a color image forming device in which an image carrying body is rotated by an image carrying body driving system, the transfer medium is rotated by a transfer driving system, an image of a plurality of colors is formed on the image carrying body, and this image of a plurality of colors is superimposed on and transferred onto the transfer medium, the respective marks of this plurality of mark sets are detected by sensors so that the amount of deviation of the image is detected. In this method, 1. the spacing between marks of the reference color and other colors, 2. the spacing between marks of the same color, and 3. the spacing between mark sets, are set as the spacing between marks within the mark sets and the spacing between mark sets, so that when the amount of color deviation is calculated for a synthesized wave comprising two or more driving irregularity frequencies that are generated by the image carrying body driving system and the transfer driving system, the calculation error caused by the synthesized wave is within a range that allows correction of the deviation of the image of a plurality of colors, and the amount of deviation of the image is corrected on the basis of these detection results. At least two groups of mark sets in which a specified number of marks are taken as one group are formed within one color deviation correction operation, and the plurality of mark sets are disposed so that the phase of the write timing of the spacing of the mark sets of the respective groups is shifted by 360 degrees/number of groups of the mark sets with respect to a wave having a frequency per revolution that is lower than the frequency which is determined from the length of the mark sets of all of the groups.

In accordance with the present invention, there is also provided a color deviation detection and correction method in which the amount of deviation of an image is detected by a color deviation detection method in which a plurality of mark sets constructed by arrangements of marks of respective colors that are lined up in the direction of movement are formed on a transfer medium in a color image forming device in which an image carrying body is rotated by an image carrying body driving system, the transfer medium is rotated by a transfer driving system, an image of a plurality of colors is formed on the image carrying body, and this image of a plurality of colors is superimposed on and transferred onto the transfer medium, the respective marks of this plurality of mark sets are detected by sensors so that the amount of deviation of the image is detected. In this method, 1. the spacing between marks of the reference color and other colors, 2. the spacing between marks of the same color, and 3. the spacing between mark sets, are set as the spacing between marks within the mark sets and the spacing between mark sets, so that when the amount of color deviation is calculated for a synthesized wave comprising two or more driving irregularity frequencies that are generated by the carrying body driving system and the transfer driving system, the calculation error caused by the synthesized wave is 20 μm or less, and the amount of deviation of the image is corrected on the basis of these detection results. In this method, at least two groups of mark sets in which a specified number of marks are taken as one group are formed within one color deviation correction operation, and the plurality of mark sets are disposed so that the phase of the write timing of the spacing of the mark sets of the respective groups is shifted by 360 degrees/number of groups of the mark sets with respect to a wave having a frequency per revolution that is lower than the frequency which is determined from the length of the mark sets of all of the groups.

In accordance with the present invention, there is also provided a color deviation detection and correction device in which the amount of deviation of an image is detected by a color deviation detection device in which an image carrying body is rotated by an image carrying body driving system, a transfer medium is rotated by a transfer driving system, an image of a plurality of colors is formed on the image carrying body, and this image of a plurality of colors is superimposed on and transferred onto the transfer medium, this color deviation detection device comprising test pattern forming means for forming a plurality of mark sets comprising arrangements of marks of a plurality of colors that are lined up in the movement direction within the range of the circumference of the transfer medium, sensors that detect the marks, conversion means for converting detection signals of the sensors into digital data, a memory in which the converted data from the conversion means is stored with the positions specified, and calculating means for calculating the positions of the respective marks on the basis of the data in the memory, and calculating the mean values of the amounts of deviation of the different mark sets with respect to the reference positions of marks of the same color, and the amount of deviation of the image is corrected on the basis of these detection results. In this method, at least two groups of mark sets in which a specified number of marks are taken as one group are formed within one color deviation correction operation, and the plurality of mark sets are disposed so that the phase of the write timing of the spacing of the mark sets of the respective groups is shifted by 360 degrees/number of groups of said mark sets with respect to a wave having a frequency per revolution that is lower than the frequency which is determined from the length of the mark sets of all of the groups.

In accordance with the present invention, there is also provided a color deviation detection and correction method in which the amount of deviation of an image is detected by a color deviation detection method in which a plurality of mark sets constructed by arrangements of marks of respective colors that are lined up in the direction of movement are formed on a transfer medium in a color image forming device in which an image carrying body is rotated by an image carrying body driving system, the transfer medium is rotated by a transfer driving system, an image of a plurality of colors is formed on the image carrying body, and this image of a plurality of colors is superimposed on and transferred onto the transfer medium, the respective marks of this plurality of mark sets are detected by sensors so that the amount of deviation of the image is detected. In this method, 1. the spacing between marks of the reference color and other colors, 2. the spacing between marks of the same color, and 3. the spacing between mark sets, are set as the spacing between marks within the mark sets and the spacing between mark sets, so that when the amount of color deviation is calculated for a synthesized wave comprising two or more driving irregularity frequencies that are generated by the image carrying body driving system and the transfer driving system, the calculation error caused by the synthesized wave is within a range that allows correction of the deviation of the image of a plurality of colors, and the amount of deviation of the image is corrected on the basis of these detection results. Two groups of mark sets in which a specified number of marks are taken as one group are formed within one color deviation correction operation, and the two groups of mark sets are disposed so that the phase is shifted by 180 degrees with respect to a wave of the period of an endless belt used as the transfer medium, which is a wave having a frequency per revolution that is lower than the frequency determined from the length of the mark sets of one group.

In accordance with the present invention, there is also provided a color deviation detection and correction method in which the amount of deviation of an image is detected by a color deviation detection method in which a plurality of mark sets constructed by arrangements of marks of respective colors that are lined up in the direction of movement are formed on the transfer medium in a color image forming device in which an image carrying body is rotated by an image carrying body driving system, a transfer medium is rotated by a transfer driving system, an image of a plurality of colors is formed on the image carrying body, and this image of a plurality of colors is superimposed on and transferred onto the transfer medium, the respective marks of this plurality of mark sets are detected by sensors so that the amount of deviation of the image is detected. In this method, 1. the spacing between marks of the reference color and other colors, 2. the spacing between marks of the same color, and 3. the spacing between mark sets, are set as the spacing between marks within the mark sets and the spacing between mark sets, so that when the amount of color deviation is calculated for a synthesized wave comprising two or more driving irregularity frequencies that are generated by the image carrying body driving system and the transfer driving system, the calculation error caused by the synthesized wave is 20 μm or less, and the amount of deviation of the image is corrected on the basis of these detection results. Two groups of mark sets in which a specified number of marks are taken as one group are formed within one color deviation correction operation, and the two groups of mark sets are disposed so that the phase is shifted by 180 degrees with respect to a wave of the period of an endless belt used as said transfer medium, which is a wave having a frequency per revolution that is lower than the frequency determined from the length of the mark sets of one group.

In accordance with the present invention, there is also provided a color deviation detection and correction device in which the amount of deviation of an image is detected by a color deviation detection device in which an image carrying body is rotated by an image carrying body driving system, a transfer medium is rotated by a transfer driving system, an image of a plurality of colors is formed on the image carrying body, and this image of a plurality of colors is superimposed on and transferred onto the transfer medium, this color deviation detection device comprising test pattern forming means for forming a plurality of mark sets comprising arrangements of marks of a plurality of colors that are lined up in the movement direction within the range of the circumference of the transfer medium, sensors that detect the marks, conversion means for converting detection signals of the sensors into digital data, a memory in which the converted data from the conversion means is stored with the positions specified, and calculating means for calculating the positions of the respective marks on the basis of the data in the memory, and calculating the mean values of the amounts of deviation of the different mark sets with respect to the reference positions of marks of the same color, and the amount of deviation of the image is corrected on the basis of these detection results. Two groups of mark sets in which a specified number of marks are taken as one group are formed within one color deviation correction operation, and the two groups of mark sets are disposed so that the phase is shifted by 180 degrees with respect to a wave of the period of an endless belt used as the transfer medium, which is a wave having a frequency per revolution that is lower than the frequency determined from the length of the mark sets of one group.

BRIEF DESCRIPTION OF THE DRAWINGS

The above and other objects, features and advantages of the present invention will become more apparent from the following detailed description taken with the accompanying drawings in which:

FIGS. 18A through 18D are diagrams which show the synthesized wave formation conditions used to determine the dispositions of the marks in the same embodiment;

FIG. 57 is a diagram which shows some of the abovementioned third calculation results;

DESCRIPTION OF THE PREFERRED EMBODIMENTS

The present invention will be described in detail below.

Figure 1:
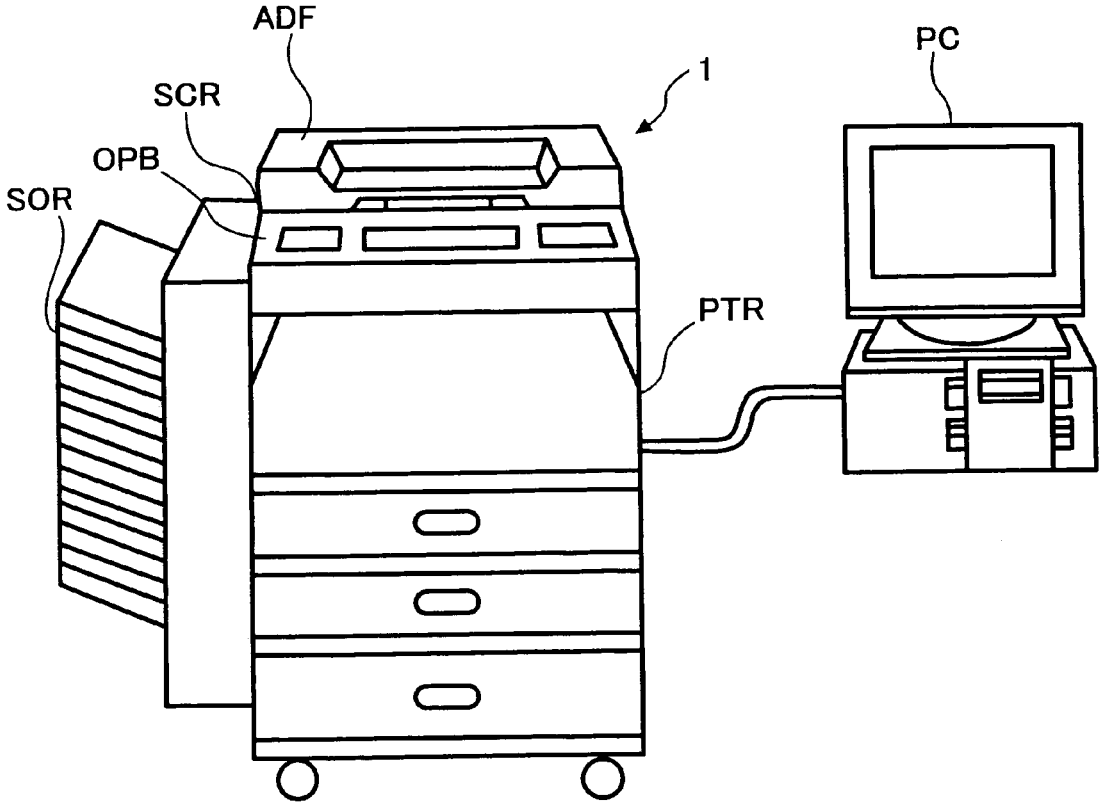
FIG. 1 is a perspective view which shows one example of a color image forming device to which the present invention has been applied.

First, one example of the color image forming device in which the present invention is applied will be described. As is shown in FIG. 1, this color image forming device is a tandem drum type color image forming device, and is a digital color copier (1) which has a composite function, and in which a color printer PTR used as an image forming part, a scanner SCR used as an image reading device, an automatic original supply device ADF, a sorter SOR, an operating board OPB used as an operating part and the like are installed. This digital color copier (1) has a system construction which can itself produce copies of originals, or which can print out printing data constituting image information when such printing data is supplied from a host PC such as a personal computer or the like via a communications interface.

Figure 2:
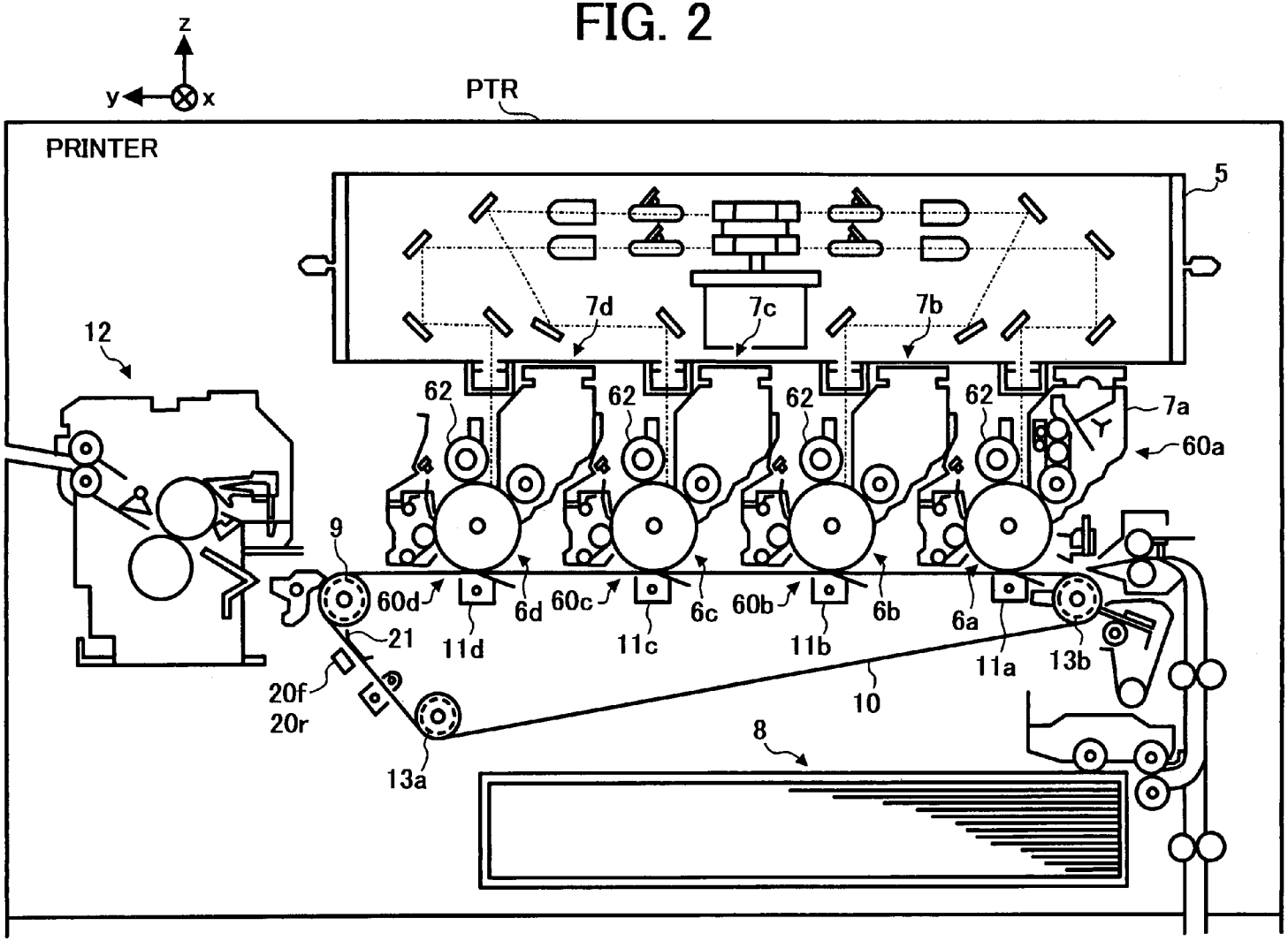
FIG. 2 is a block diagram showing the construction of the color printer PTR in the same color image forming device.

The construction of the abovementioned color printer PTR is shown in FIG. 2. After image data of respective colors produced by the scanner SCR is converted into respective image data for color recording (hereafter referred to as "recording image data" or simply "image data"), i.e., black (hereafter referred to as "Bk"), yellow (hereafter referred to as "Y"), cyan (hereafter referred to as "C") and magenta (hereafter referred to as "M") by the image processing part 40 (see FIG. 3), these respective sets of image data are sent to a write unit 5 used as the exposure means of the printer PTR. In the write unit 5, a modulator modulates and drives a laser light source in accordance with the recording image data, and irradiates photosensitive drums 6*a*, 6*b*, 6*c* and 6*d* used as respective image carrying bodies with laser light from this laser light source while scanning this laser light in the main scanning direction by means of a polygonal mirror. In the photosensitive drums 6*a*, 6*b*, 6*c* and 6*d*, surfaces that are uniformly charged by a charging roller 62 used as charging means are subjected to a scanning projection by laser beam light modulated by the respective M, C, Y and Bk image data used for image recording from the write unit 5, so that electrostatic latent images are formed. The electrostatic latent images on the respective photosensitive drums 6*a*, 6*b*, 6*c* and 6*d* are developed with M, C, Y and Bk toners by developing units 7*a*, 7*b*, 7*c* and 7*d* used as developing means, so that toner images (sensible images) of the respective colors are formed.

Meanwhile, the transfer paper is conveyed onto the transfer belt 10 of a transfer belt unit from a paper supply cassette 8, and after the toner images (sensible images) of the respective colors on the respective photosensitive drums 6*a*, 6*b*, 6*c* and 6*d* are successively superimposed and transferred by transfer units 11*a*, 11*b*, 11*c* and 11*d*, the toner images are fixed by a fixing unit 12. The transfer paper on which the fixing of the toner images has been completed is discharged from the apparatus.

The transfer belt 10 is a light-transmitting endless belt which is supported by a driving roller 9, tension roller 13*a* and driven roller 13*b*. Since the tension roller 13*a* pushes the transfer belt 10 downward by means of a spring (not shown in the figures), the tension of the transfer belt 10 is substantially constant.

In order to prevent color deviation in the superimposition and transfer of the above-mentioned toner images of the respective colors (deviation between colors), the abovementioned printer PTR is constructed so that test patterns are formed by uniformly charging the respective photosensitive drums 6*a*, 6*b*, 6*c* and 6*d* by means of the charging roller 62, and then writing test patterns used for position detection (see FIG. 5) on the foreground ends (front surface sides in FIG. 2; hereafter expressed as "front") and deep ends (back surface sides in FIG. 2; hereafter expressed as "rear") of the respective photosensitive drums 6*a*, 6*b*, 6*c* and 6*d* by means of the exposure unit 5 and developing these test patterns by means of the developing units 7*a*, 7*b*, 7*c* and 7*d*, and so that these test patterns are then transferred onto the transfer belt 10 by means of the transfer units 11*a*, 11*b*, 11*c* and 11*d*, the writing position deviation, inclination, magnification and the like of the exposure unit 5 for the respective photosensitive drums 6*a*, 6*b*, 6*c* and 6*d* are ascertained by reading the test patterns that have been transferred onto the transfer belt 10 by means of the front side reflection type sensor 20*f* and rear side reflection type sensor 20*r*, and the write timing or the like of the exposure unit 5 for the respective photosensitive drums 6*a*, 6*b*, 6*c* and 6*d* is corrected so that the color deviation caused by these factors is eliminated.

Figure 3:
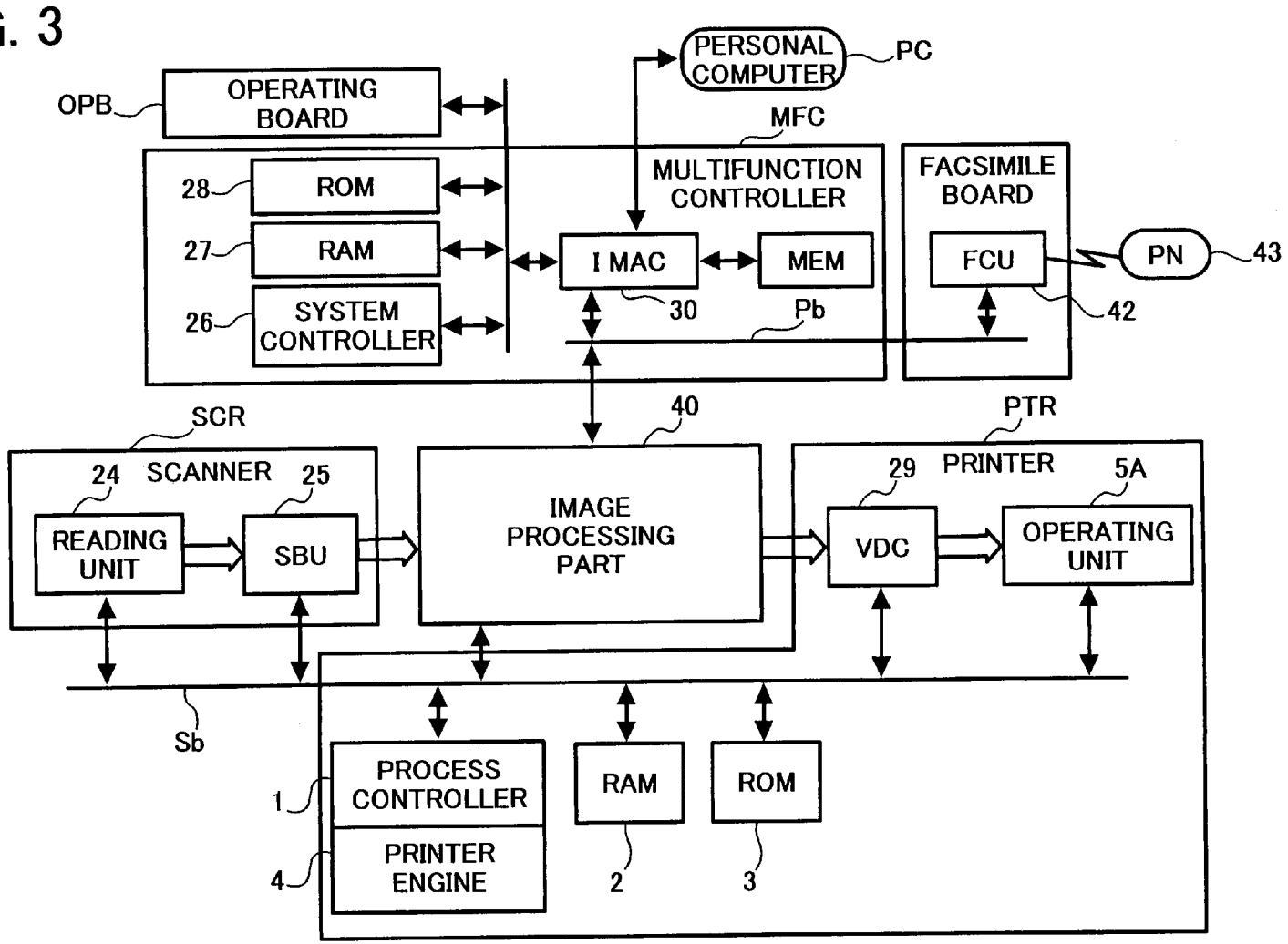
FIG. 3 is a block diagram showing the construction of the control system of the same color image forming device.

The construction of the electrical system of this color image forming device is shown in FIG. 3. The scanner SCR that optically reads the original illuminates the original with light from a lamp, focuses the reflected light on a light-receiving element by means of a mirror and lens, and converts this light into an electrical signal. This light-receiving element (a CCD in the case of the present digital color copier (1)) is located in a sensor board unit (hereafter abbreviated to "SBU") 25, and the image signal obtained by conversion into an electrical signal by this CCD is converted into a digital signal, i.e., read-out image data, by the SBU 25, and is then output to the image processing part 40 from the SBU 25.

The system controller 26 and process controller 1 communicate with each other via a parallel bus Pb and series bus Sb. The image processing part 40 performs data format conversion internally for the interface between the parallel bus Pb and series bus Sb.

The read-out image data from the SBU 25 is transferred to the image processing part 40, and the signal deterioration arising from the optical system and the quantization of the signal into a digital signal (signal deterioration of the scanner system: distortion of the read-out image data according to the scanner characteristics) is corrected by the image processing part 40; then, the data is transferred to a multi-function controller MFC and written into the memory MEM, or is subjected to processing for printer output and is sent to the printer PTR.

Specifically, in the image processing part 40, there are jobs in which the read-out image data is accumulated in the memory MEM and re-utilized, and jobs in which the read-out image data is not accumulated in the memory MEM, but is rather output to the video data control part (hereafter abbreviated to "VDC") 29, and is output as images by the laser printer PTR. As an example of the accumulation of read-out image data in the memory MEM, in cases where a plurality of copies of a single original are made, a method may be used in which the read-out unit 4 is operated once, the read-out image data is accumulated in the memory MEM, and this accumulated image data is read out a plurality of times. As an example of an operation in which the memory MEM is not used, there may be cases in which a single original is copied once (or the like). In such cases, since it is necessary only to process the read-out image data "as is" for printer output, there is no need to write the read-out image data into the memory MEM.

First, in cases where the memory MEM is not used, the image processing part 40 subjects the read-out image data to an image read-out correction, and then performs image quality processing in order to effect a conversion into area halftones; then, the image data following this image quality processing is transferred to the VDC 29. The VDC 29 performs pulse control with respect to the image data from the image processing part 40 that has been converted into area halftones, in order to perform after-processing relating to the dot disposition, and in order to reproduce the dots. The VDC 29 then transfers this data to the exposure unit 5 of the laser printer PTR so that a reproduced image is formed on the transfer paper.

In cases where the read-out image data is accumulated in the memory MEM, and additional processing such as rotation of the image orientation, synthesis of images or the like is performed at the time of read-out from the memory MEM, the image data that has been subjected to an image read-out correction in the image processing part 40 is sent to an image memory access control part (hereafter abbreviated to "IMAC") 30 via the parallel bus Pb. The IMAC 30 performs access control of the image data and memory modules MEM on the basis of control performed by the system controller 26, development of print data from external host PCs (character code/character bit conversion), and compression/expansion of image data for the effective utilization of memory.

The image data sent to the IMAC 30 is subjected to data compression by the IMAC 30, and is then accumulated in the memory MEM; this accumulated image data is read out as necessary by the IMAC 30. The image data that is read out from the memory MEM is expanded by the IMAC 30, and thus restored to the original image, and this data is returned to the image processing part 40 from the IMAC 30 via the parallel bus Pb. When the image data is returned to the image processing part 40, image quality processing is performed in this image processing part 40, and pulse control is performed by the VDC 29; then, the data is transferred to the exposure unit 5, so that images (toner images) are formed on the transfer paper.

In the case of the facsimile transmission function, which is one of the multiple functions, the read-out image data of the scanner SCR is subjected to image read-out correction by the image processing part 40, and is transferred to a facsimile control unit (hereafter abbreviated to "FCU") 42 via the parallel bus Pb. The FCU 42 converts the image data into data for a public circuit communications network (hereafter abbreviated to "PN"), and transmits this data as facsimile data to the PN 43. In the case of facsimile reception, circuit data from the PN 43 is converted into image data by the FCU 42, and is transferred to the image processing part 40 via the parallel bus Pb and CDIC. This image data is not subjected to special image quality processing by the image processing part 40; the re-disposition of dots and pulse control are performed in the VDC 29, and the data is transferred to the exposure unit 5, so that a sensible image is formed on the transfer paper.

Under conditions in which a plurality of jobs, e. g., copying function, facsimile transmitting and receiving function and printer output function (print output function) are performed in parallel, the assignment of authorization to use the read-out unit 24, exposure unit 5 and parallel bus Pb to the jobs is controlled by the system controller 26 and process controller 1.

The process controller 1 controls the flow of image data, and the system controller 6 controls the overall system and manages the starting of resources. The functions of this digital color copier (1) with digital multiple functions are selected by the operating board OPB, and the processing contents of the copying function, facsimile function and the like are thus set.

The printer engine 4 shown in FIG. 3 is a mechanism-driving electrical system including electrical devices such as motors, solenoids, chargers, heaters, lamps and the like, electrical sensors, an electrical circuit (driver) that drives these devices, and a detection circuit (signal processing circuit), which are built into the printing mechanism, i.e., the image forming device, shown in FIG. 2. The operation of this printer engine 4 is controlled by the process controller 1, and the detection signals (operating states) of the above-mentioned electrical sensors are read in by the process controller 1.

Referring again to FIG. 2, four latent image carrying units, each of which includes a charging roller 62, photosensitive drum 6*a*, 6*b*, 6*c* or 6*d*, cleaning mechanism used as cleaning means, and de-charging lamp, and four developing units 7*a* through 7*d*, constitute process cartridges constructed as units that are freely detachable with respect to the main body of this digital color copier (1).

Figure 4A:
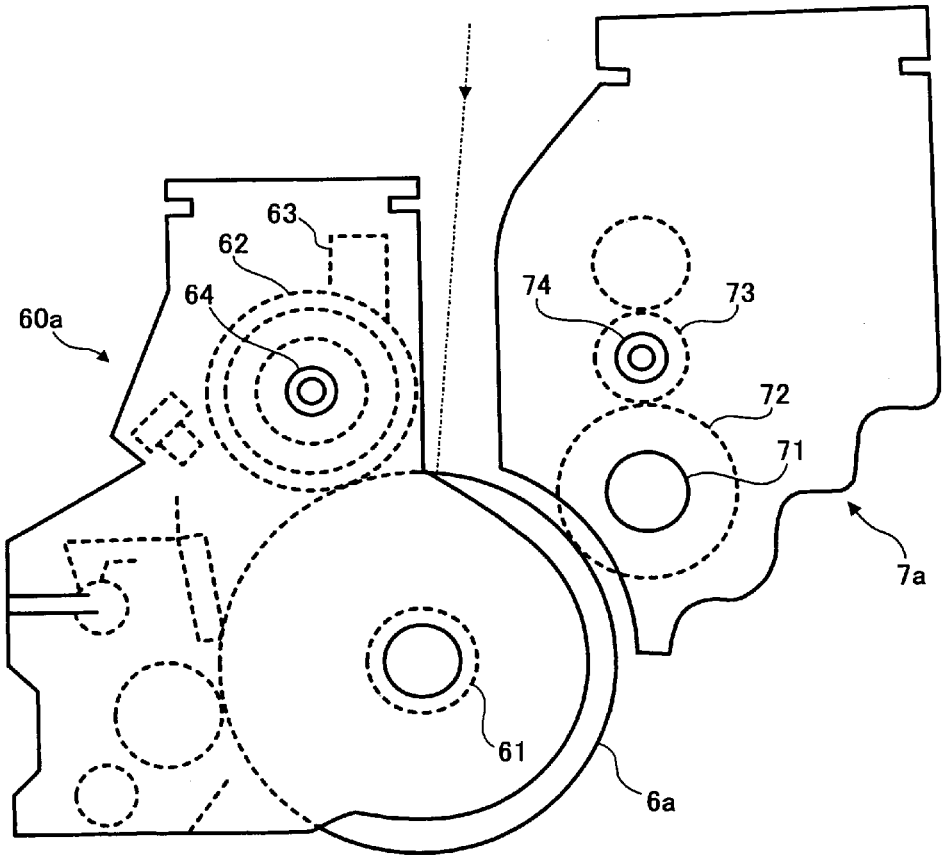
FIG. 4A is a front view showing the front surfaces of the latent image forming unit and developing unit of the same color image forming device.

FIG. 4A shows the unit front surfaces of the latent image carrying unit 60*a* that includes the photosensitive drum 6*a*, and the developing unit 7*a* that develops the latent image on the photosensitive drum 6*a*. The front end portion 61 of the shaft body of the photosensitive drum 6*a* in the latent image carrying unit 60*a* protrudes through the front surface cover 67 of the latent image carrying unit 60*a* (see FIG. 4B). This end portion 61 is pointed in a circular conical shape so as to facilitate entry into a positioning hole (not shown in the figures) for the photosensitive drum 6*a* that is opened in the face plate 81 of the face plate unit 80 used for axial alignment (see FIG. 4B).

Positioning holes that respectively receive the shafts 61 of the photosensitive drums 6*a* through 6*d* and the developing roller shafts 71 of the developing units 7*a* through 7*d* are disposed in the front plate 81, and the positions of the front end portions of the shafts 61 of the photosensitive drums 6*a* through 6*d* and the developing roller shafts 71 of the developing units 7*a* through 7*d* are precisely determined by the fastening of the front plate 81 to a base frame. Large-diameter holes into which normally closed micro-switches 69*a* through 69*d* and 79*a* through 79*d* used to detect the respective presence or absence of the latent image carrying units 60*a* through 60*d* and used to detect the respective presence or absence of the developing units 7*a* through 7*d* (see FIG. 6) are inserted are formed in the face plate 81, and these micro-switches 69*a* through 69*d* and 79*a* through 79*d* are supported by a printed board 82. The inside surface of the face plate 81 is covered by an inside cover 84, and the outside surface on the side of the printed board 82 is covered by an outside surface cover 83.

A screw-threaded pin 64 which is used to operate the micro-switch 69*a*, and which protrudes from the unit front surface, is disposed in the latent image carrying unit 60*a*, and a similar screw-threaded pin 74 is also disposed in the developing unit 7*a*. The same is true in the other latent image carrying units and developing units.

Figure 4B:
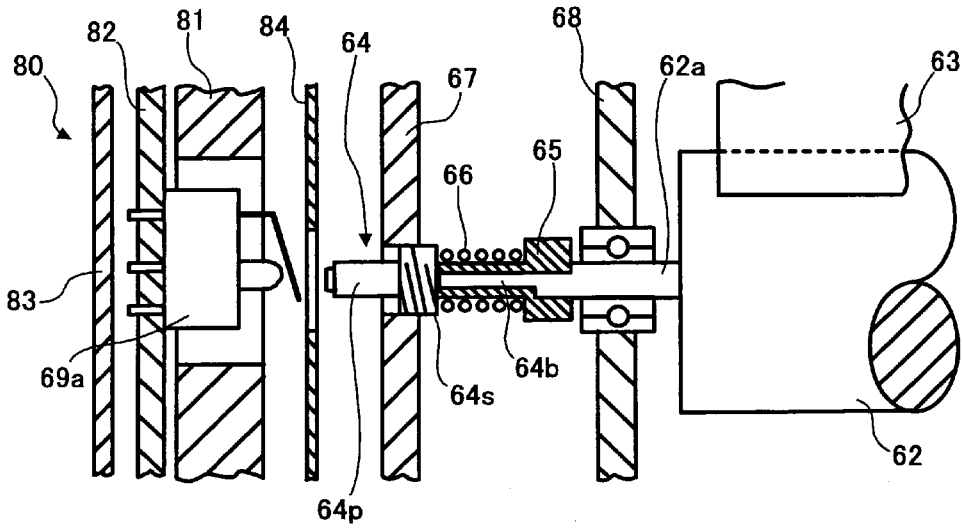
FIGS. 4B and 4C are longitudinal sectional views showing the state immediately following mounting in the copier in the case of unit replacement of the attachment pin parts of the same latent image forming unit, and the state following the rotational driving of the charging roller subsequent to this mounting.
Figure 4C:
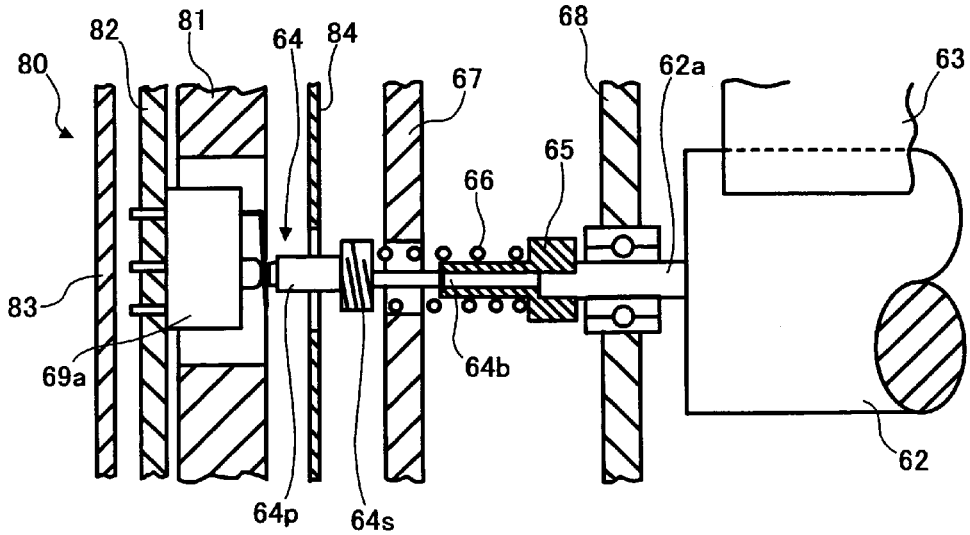

FIGS. 4B and 4C show longitudinal sectional views of the portion of the latent image carrying unit 60*a* located in the vicinity of the screw-threaded pin 64. FIG. 4B shows a state in which the latent image carrying unit 60*a* mounted in this digital color copier (1) is a new part, and in which the charging roller 62 has not yet been rotationally driven, while FIG. 4C shows a state in which the charging roller 62 has already been rotationally driven.

The charging roller 62 that is used to uniformly charge the photosensitive drum 6*a* contacts the photosensitive drum 6*a*, and rotates at substantially the same circumferential speed as the photosensitive drum 6*a*. Contaminants on the surface of the charging roller 62 are wiped away by a cleaning pad 63. The rotating shaft 62*a* of the charging roller 62 is supported by a front side supporting plate 68 of the latent image carrying unit 60*a* via a bearing so that this shaft is free to rotate. A connecting sleeve 65 is fastened to the tip end of the rotating shaft 62*a*, and rotates as a unit with the rotating shaft 62*a*. A hole with a square cross-sectional shape is formed in the center of the connecting sleeve 65, and a leg 64*b* (which has a substantially square columnar shape) on the screw-threaded pin 64 is inserted into this hole. A region constituting approximately ⅔ of the length of this leg 64*b* on the side of the male screw 64*s* constitutes a square column that engages with the square hole in the connecting sleeve 65; on the other hand, a region constituting roughly the remaining ⅓ of the length on the tip end side of the leg 64*b* has a round rod shape that can idle with respect to the connecting sleeve 65.

As is shown in FIG. 4B, a large-diameter male screw 64*s* is located between the tip head pin 64*p* and leg 64*b* of the screw-threaded pin 64. In the case of a new (unused) latent image carrying unit 60*a*, the male screw 64*s* is screw-connected with a female screw hole in the unit front surface cover 67, and a return spring 66 is compressed between the connecting sleeve 65 and the male screw 64*s*. In this state, the length of the pin 64 that protrudes from the unit front surface is short. However, when the charging roller 62 is rotationally driven in this state, the screw-threaded pin 64 rotates as a result, so that the screw-threaded pin 64 moves toward the face plate 81 as a result of the screw connection with the female screw hole in the unit front surface cover 67, and thus contacts the switching operating element of the micro-switch 69*a*. Immediately before the male screw 64*s* of the screw-threaded pin 64 passes through the female screw hole of the unit front surface cover 67, the normally-closed micro-switch is switched from closed to open.

As is shown in FIG. 4C, when the male screw 64*s* passes through the female screw hole of the unit front surface cover 67, the pin 64 is caused to protrude by the return spring 66. As a result, the square columnar part of the leg 64*b* of the pin 64 protrudes from the square hole of the sleeve 65, so that even if the charging roller 62 rotates, the pin 64 does not rotate.

Accordingly, in cases where a latent image carrying unit 60*a* whose use has already been started is mounted "as is" in this digital color copier (1), the micro-switch 69*a* is normally open (off). Even if a new (unused) latent image carrying unit 60*a* is mounted, i.e., even if the latent image carrying unit 60*a* is replaced, the micro-switch 69*a* is closed (on) until the charging roller 62 is rotationally driven. When the power supply of this copier (1) is switched on, the micro-switch 69*a* is closed (on), and when the driving of the image creating mechanism (image forming mechanism) is started so that the micro-switch 69*a* is opened (switched off), it is ascertained that the power supply has been switched on for the first time since the replacement of the latent image carrying unit 60*a*. Specifically, it is ascertained that the latent image carrying unit 60*a* has been replaced immediately prior to the switching on of the power supply.

The detection of the mounting of the other latent image carrying units 60*b* through 60*d* and other developing units 7*a* through 7*d* and the detection of the replacement of these parts with new parts are also similarly performed using a similar construction. Furthermore, in the developing units 7*a* through 7*d*, a screw-threaded pin 74 similar to the screw-threaded pin 64 is connected via a supporting mechanism (similar to the supporting mechanism of the front surface cover 67 part of the charging roller 62) to a leveling roller 73 which rotates in synchronization with the developing roller 72 and in the same direction as the developing roller 72.

Figure 5:
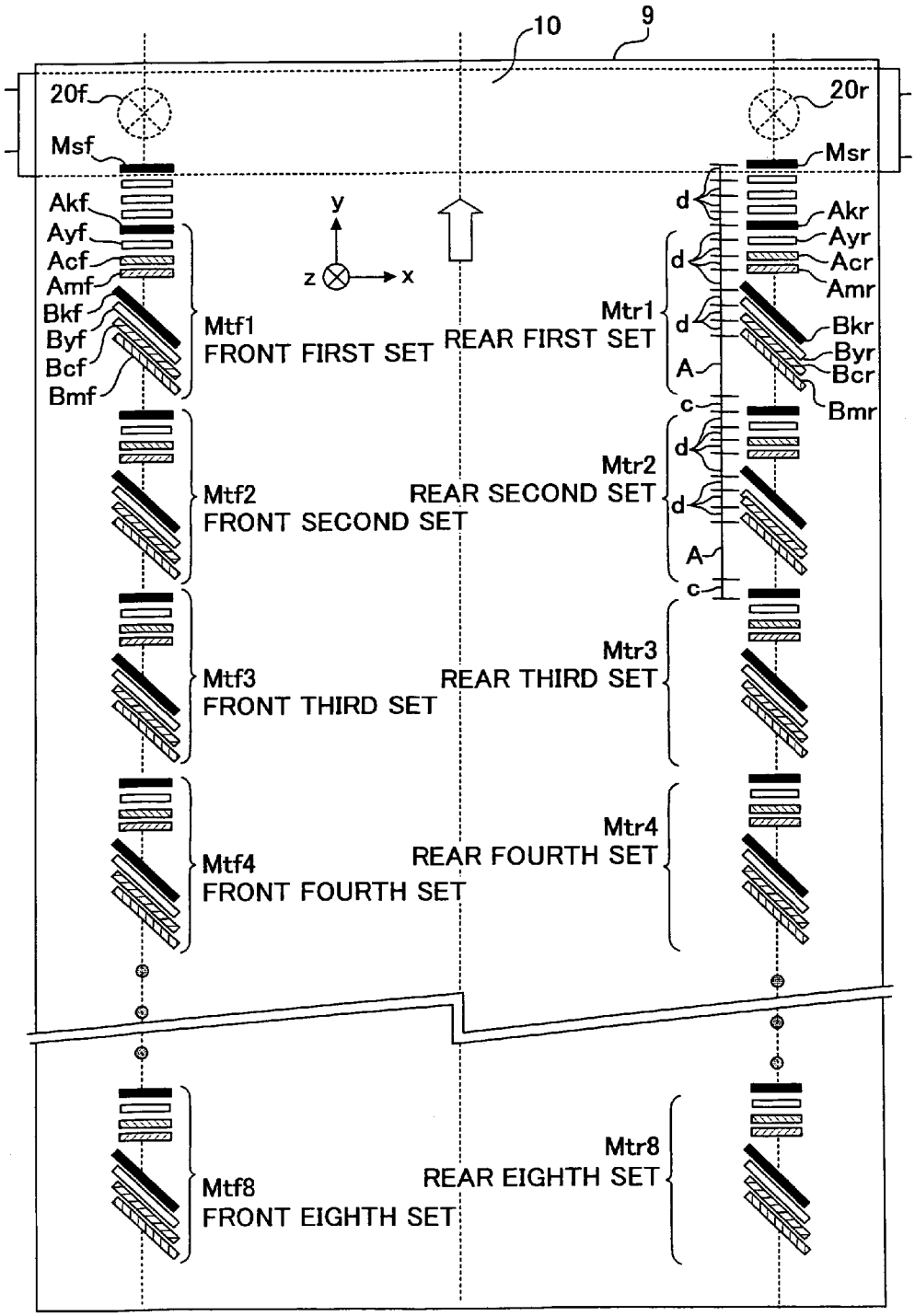
FIG. 5 is a plan view showing the transfer belt of the same color image forming device.

As is shown in FIG. 5, when "color adjustment" is performed, test patterns are formed on the surface of the transfer belt 10 of the printer PTR. Specifically, on the rear of the transfer belt 10, a Bk starting mark Msr is formed first; then, following a blank equal to four pitch parts 4*d* of the mark pitch d, eight mark sets Mtr1 through Mtr8 are successively formed at a set pitch (fixed pitch) of 7*d*+A+c within one circumferential length of the transfer belt 10.

In this digital color copier (1), a starting mark Msr and eight mark sets Mtr1 through Mtr8 are formed as rear side test patterns within one circumferential length on the rear of the transfer belt 10, and this starting mark Msr and eight mark sets Mtr1 through Mtr8 comprise a total of 65 marks.

The first mark set Mtr1 includes a
first orthogonal mark Akr for Bk,
second orthogonal mark Ayr for Y,
third orthogonal mark Acr for C, and
fourth orthogonal mark Amr for M, as a group of orthogonal marks comprising a group of marks that are parallel to the main scanning direction x (lateral direction of the transfer belt 10), and a first oblique mark Bkr for Bk,
second oblique mark Byr for Y,
third oblique mark Bcr for C, and
fourth oblique mark Bmr for M, as a group of oblique marks comprising a group of marks that form an angle of 45° with respect to the main scanning direction x.

The respective marks Akr through Amr and Bkr through Bmr are lined up at a mark pitch of d in the sub-scanning direction (direction of movement of the transfer belt 10). The second through eighth mark sets Mtr2 through Mtr8 are the same as the first mark set Mtr1; the respective mark sets Mtr1 through Mtr8 are lined up with spaces of c left between the adjacent mark sets in the sub-scanning direction (direction of movement of the transfer belt 10).

On the front of the transfer belt 10, a Bk starting mark Msf is similarly formed first; then, following a blank equal to four pitch parts 4*d* of the mark pitch d, eight mark sets Mtf1 through Mtf8 are successively formed at a set pitch (fixed pitch) of 7*d*+A+c within one circumferential length of the transfer belt 10.

In this digital color copier (1), a starting mark Msf and eight mark sets Mtf1 through Mtf8 are formed as rear side test patterns within one circumferential length on the rear of the transfer belt 10, and this starting mark Msf and eight mark sets Mtf1 through Mtf8 comprise a total of 65 marks.

The first mark set Mtf1 includes a
first orthogonal mark Akf for Bk,
second orthogonal mark Ayf for Y,
third orthogonal mark Acf for C, and
fourth orthogonal mark Amf for M, as a group of orthogonal marks comprising a group of marks that are parallel to the main scanning direction x (lateral direction of the transfer belt 10), and a first oblique mark Bkf for Bk, second oblique mark Byf for Y, third oblique mark Bcf for C, and fourth oblique mark Bmf for M, as a group of oblique marks comprising a group of marks that form an angle of 45° with respect to the main scanning direction x.

The respective marks Akf through Amf and Bkf through Bmf are lined up at a mark pitch of d in the sub-scanning direction (direction of movement of the transfer belt 10). The second through eighth mark sets Mtf2 through Mtf8 are the same as the first mark set Mtf1; the respective mark sets Mtf1 through Mtf8 are lined up with spaces of c left between the adjacent mark sets in the sub-scanning direction (direction of movement of the transfer belt 10). The final r in the symbols assigned to the respective marks Msr, Akr through Amr and Bkr through Bmr contained in these test patterns indicates that these marks are rear side marks, and the final f in the symbols assigned to the respective marks Msf, Akf through Amf and Bkf through Bmf indicates that these marks are front side marks.

Figure 16A:
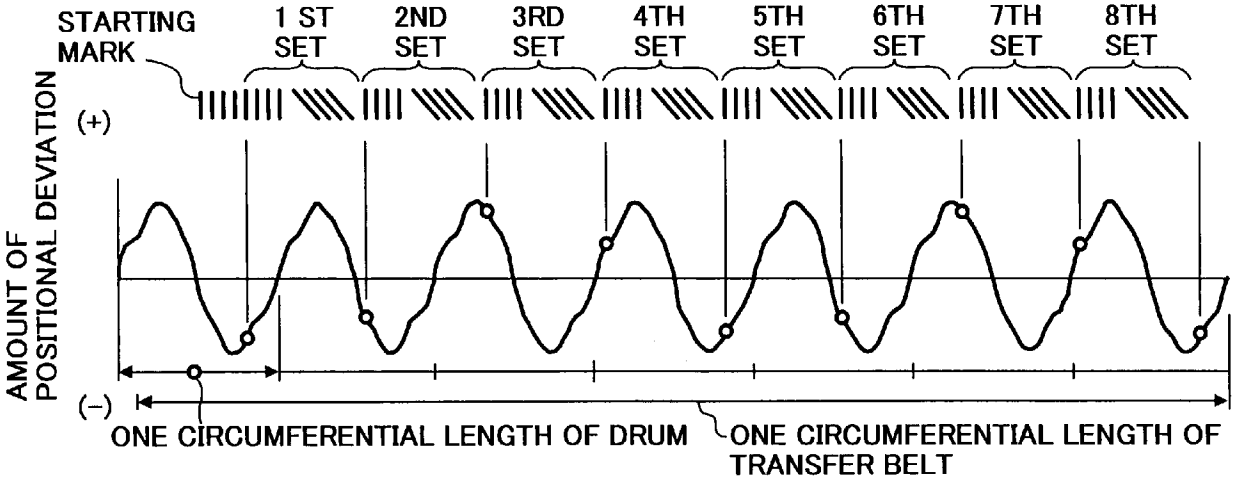
FIG. 16A is a diagram showing the distribution of the test patterns formed in one circumferential length of the transfer belt in the abovementioned color image forming device and in another color image forming device.
Figure 16B:
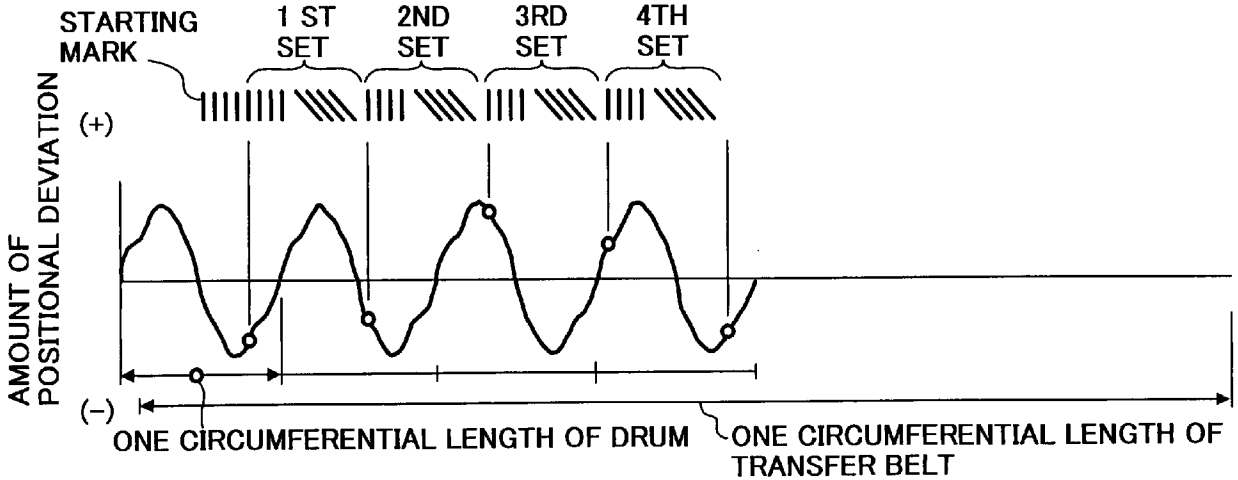
FIG. 16B is a diagram showing the deviation of the mark formation positions corresponding to the rotational angle of the photosensitive drums.

FIGS. 16A and 16B show the amounts of deviation of the mark formation positions with respect to a reference position caused by the eccentricity of the circumferential surfaces of the photosensitive drums 6*a* through 6*d*, a single circumferential length of the transfer belt 10, and the mark sets transferred to this transfer belt from the photosensitive drums 6*a* through 6*d*, in a linear development. In this digital color copier (1), approximately seven circumferential lengths of the photosensitive drums 6*a* through 6*d* are equal to one circumferential length of the transfer belt 10, so that eight mark sets around the circumferences of the photosensitive drums 6*a* through 6*d* are transferred onto the transfer belt 10 from the photosensitive drums 6*a* through 6*d*. Since the starting marks are formed preceding the eight mark sets, a total of 65 marks including both the starting marks and the eight mark sets are respectively formed overall on the front and rear around seven circumferences of the photosensitive drums.

In an image forming device applied to a case in which the total length of the eight mark sets is shorter than one circumference of the transfer belt, the color deviation correction time becomes waiting time for the user; accordingly, a shorter time is naturally better. Furthermore, in cases where the total length of the mark patterns is shorter, a smaller amount of toner is consumed. On these grounds, it is desirable to shorten to total length of the mark sets. However, if the total length of the mark patterns is merely shortened, an erroneous correction amount will be calculated as a result of fluctuations in the period of the transfer belt.

Figure 59A:
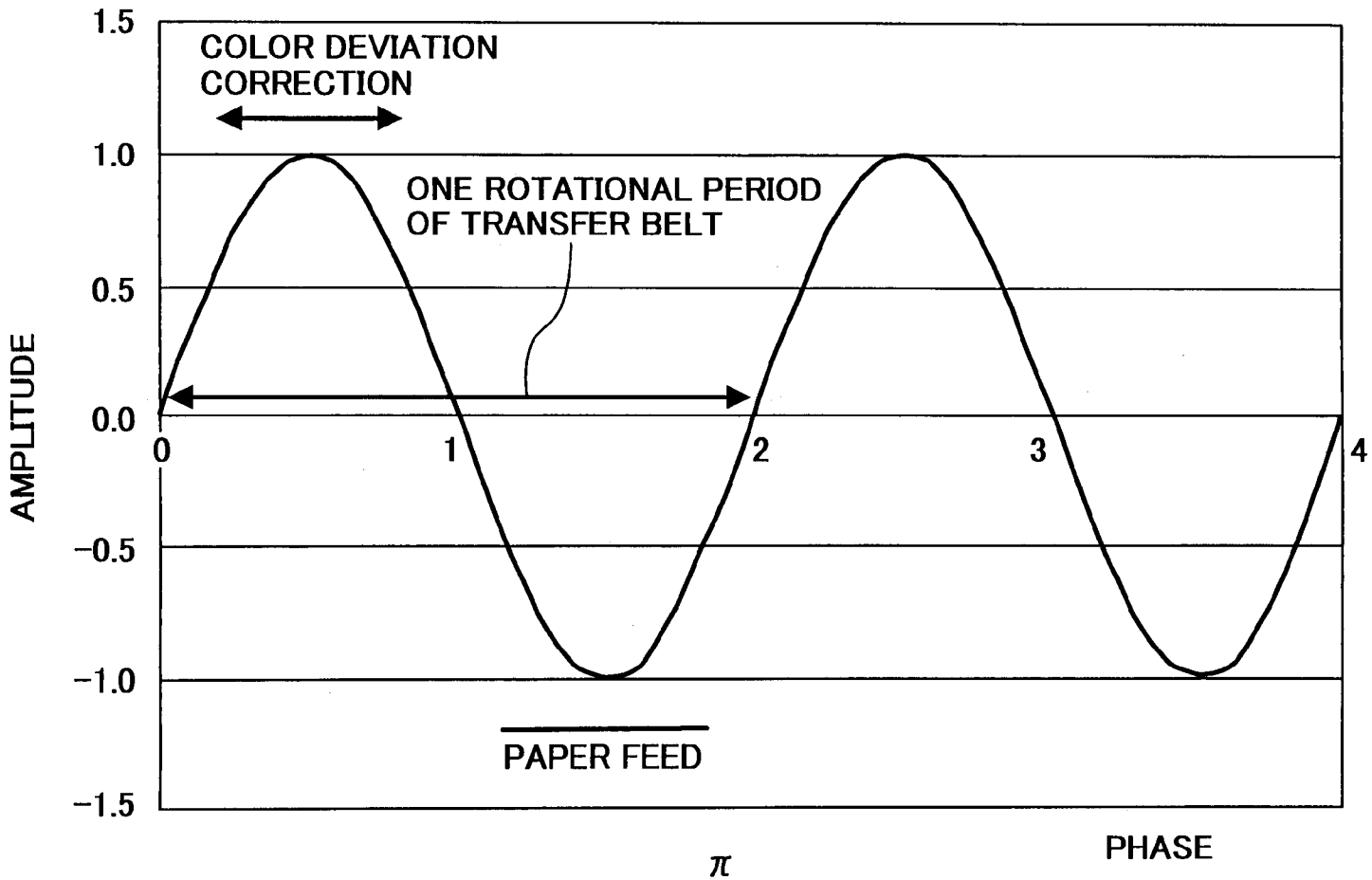
FIGS. 59A and 59B are diagrams which show the color deviation correction timing and paper feed timing in the fluctuation of one circumference of the transfer belt in the abovementioned embodiment.

This is easily seen by examining FIG. 59A. In the case of FIG. 59A, color deviation correction is performed in places with the largest plus side fluctuation within the period of one revolution of the transfer belt. In this case, the transfer belt is judged to be early, and the correction values are determined on this basis. Accordingly, if color deviation correction is performed in places where the image formation region shows the largest minus side fluctuation when an image is formed, the color deviation assumes the worst state.

Figure 59B:
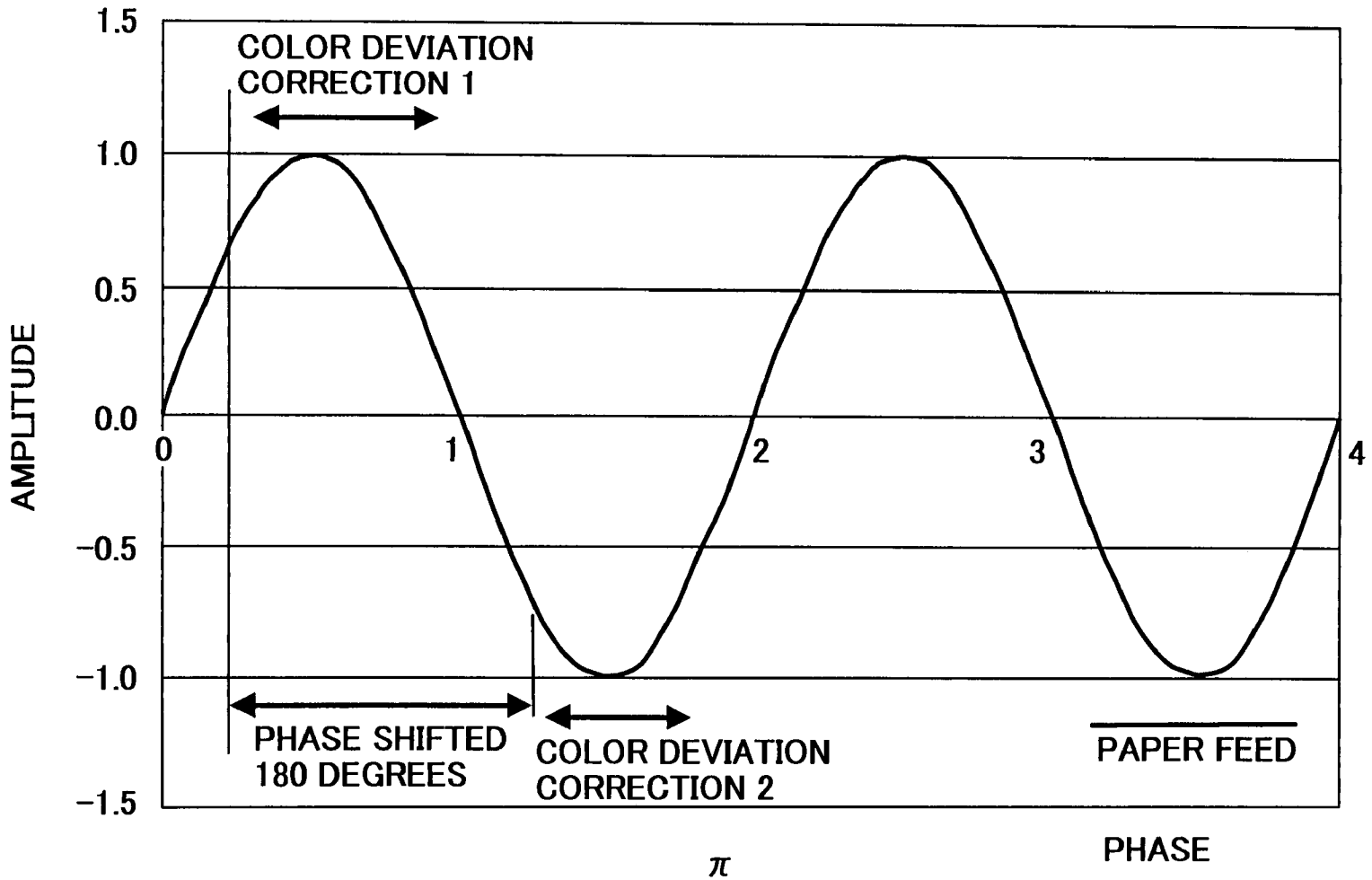

In order to avoid the abovementioned problem, mark sets used for color deviation correction are stored in memory as shown in FIG. 59B in one embodiment of the present invention. Specifically, two or more groups of mark sets in which a specified number of marks are taken as one group within a single color deviation correction operation are formed, and the plurality of mark sets are disposed so that the write timing of the intervals between the mark sets of the respective groups is shifted in phase by 360 degrees/number of groups of mark sets with a wave having a frequency per revolution that is lower than the frequency determined from the length of the mark sets of all of the groups being taken as an object. Accordingly, the color deviation correction precision can be improved, and an increase in cost can be suppressed.

Furthermore, in the calculation of the correction values that are finally reflected in image formation, mark sets are disposed as shown in FIG. 59B, and the correction amount used in image formation is determined as (a+b)/2 from the correction amount a determined by the color deviation correction 1 and the correction amount b determined by the color deviation correction 2, i.e., the correction amount used in image formation is determined by averaging the calculated values obtained from the respective mark sets. For example, in a case where color deviation correction is performed four times, the correction amount used in image formation is determined as (a+b+c+d)/4 from the correction amounts a, b, c and d determined by the four color deviation corrections.

By doing this, it is possible to cancel the fluctuation in one rotational period of the transfer belt that occurs in color deviation correction.

Furthermore, in regard to the timing of the detection and correction of the abovementioned color deviation amount, such detection and correction are performed at least when the part in question is changed to a part in which the above-mentioned frequency per revolution is lower than the frequency determined from the length of the mark sets of all of the groups. Specifically, when the transfer belt or a unit using the transfer belt is replaced, color deviation correction is performed in order to handle the new transfer belt.

The abovementioned description is one example of the consideration of a case in which an amplitude is given for only one rotational period of the transfer belt. In actuality, the wave is a synthesize wave in which various driving irregularities are added in addition to one revolution of the transfer belt. However, since the approach relating to the cancellation of the fluctuation components is the same in both a simple wave and a synthesized wave, the color deviation correction precision can be improved by using the abovementioned approach.

Since the mark sets are formed at a pitch that is equal to ¾ of the circumference of the photosensitive drums 6*a* through 6*d*, the first through fourth mark sets are formed in different positions on the circumferential surfaces of the photosensitive drums 6*a* through 6*d*, and the fifth through eighth mark sets are respectively formed in positions that are substantially the same as those of the first through fourth mark sets. FIG. 16 clearly illustrates how pattern disposition with respect to the fluctuation generated by the driving system can be arranged so that the driving irregularities can be canceled. This is one example of the consideration of a case in which seven of the driving irregularity frequencies in a synthesize wave comprising eight driving irregularity frequencies generated by the driving system of the photosensitive drums 6*a* through 6*d* used as the image carrying body driving system of this digital color copier (1) and the driving system of the transfer belt 10 used as the transfer driving system are taken as having no amplitude, with an amplitude being given only for one driving irregularity frequency.

Figure 6:
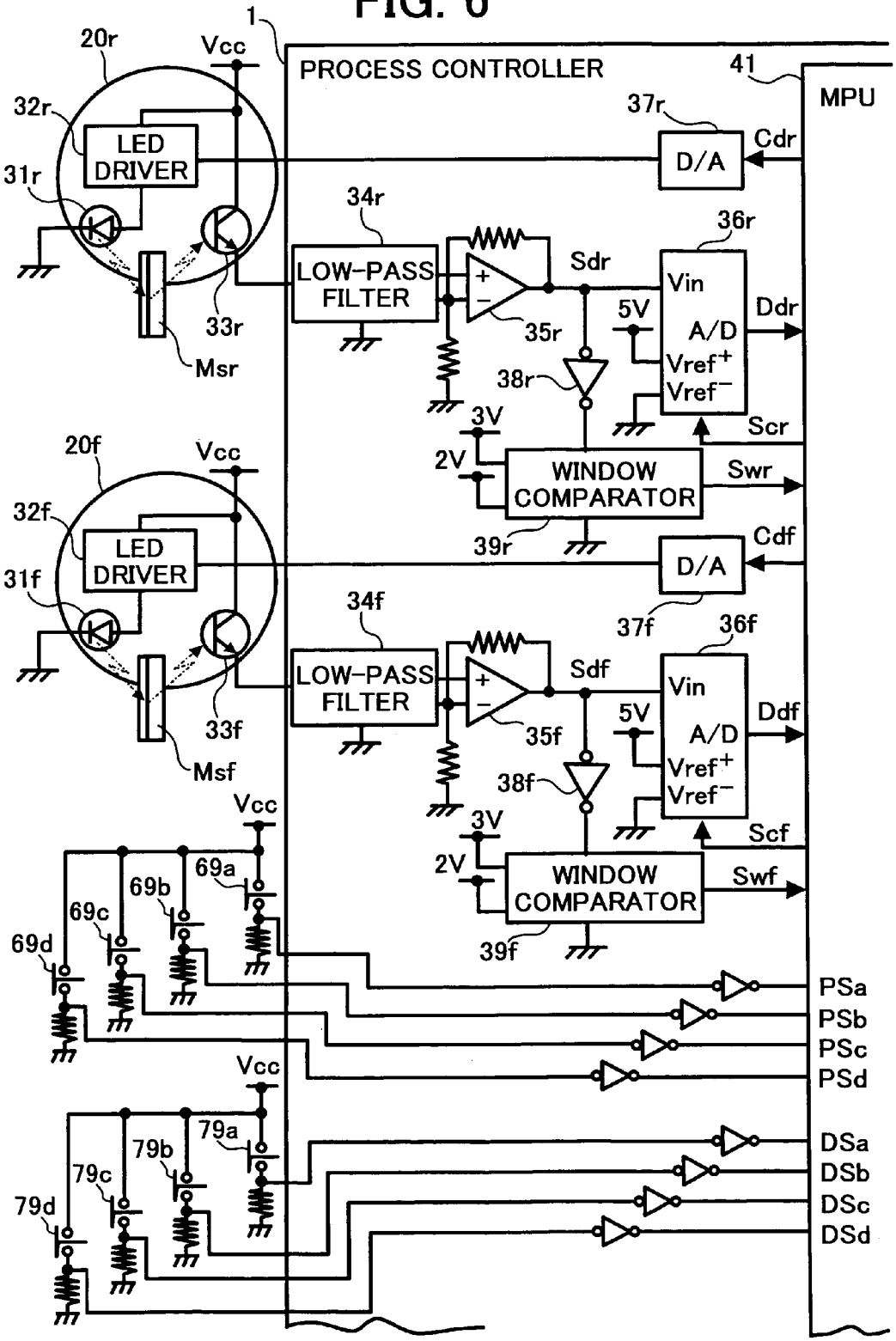
FIG. 6 is a block diagram showing a portion of the process controller of the same color image forming device.

FIG. 6 shows the abovementioned micro-switches 69*a* through 69*d* and 79*a* through 79*d* and optical sensors 20*r* and 20*f* used for unit mounting detection, and the electrical circuit that reads in the detection signals from these parts. In the mark detection stage, a microcomputer (hereafter referred to as "MPU") 41 (i.e., the CPU of this microcomputer) which comprises mainly a ROM, RAM, CPU, FIFO memory used for detection data storage and the like, sends powering data that designates the powering current values of the light-emitting diodes (LEDs) 31*r* and 31*f* of the optical sensors 20*r* and 20*f* to the D/A converters 37*r* and 37*f*, and the D/A converters convert this data into analog voltages, and send these analog voltages to LED drivers 32*r* and 32*f*. These drivers 32*r* and 32*f* power the LEDs 31*r* and 31*f* with a current that is proportional to the analog voltages from the D/A converters 37*r* and 37*f*.

The light generated by the LEDs 31*r* and 31*f* passes through slits (not shown in the figures) and strikes the transfer belt 10. The major portion of this light passes through the transfer belt 10, and is reflected by a back surface reflective plate 21 that makes sliding contact with the back surface of the transfer belt 10 and prevents vibration in the direction perpendicular to the transfer belt 10. This reflected light passes through the transfer belt 10 and further passes through the slits (not shown in the figures), so that this light strikes photo-transistors 33*r* and 33*f*. As a result, the collector-emitter portions of the transistors 33*r* and 33*f* are placed at a low impedance, so that the emitter potentials of the transistors 33*r* and 33*f* rise.

When the abovementioned marks on the transfer belt 10 reach positions that face the LEDs 31*r* and 31*f*, these marks interrupt the light from the LEDs 31*r* and 31*f*; accordingly, the collector/emitter portions of the transistors 33*r* and 33*f* assume a high impedance, so that the emitter voltages of the transistors 33*r* and 33*f* drop, i.e., so that the level of the detection signals of the optical sensors 20*r* and 20*f* drops.

Accordingly, when test patterns are formed on the surface of the moving transfer belt 10 as described above, the detection signals of the optical sensors 20*r* and 20*f* fluctuate between high and low. The high level of these detection signals means that no mark is present, while the low level of these detection signals means that a mark is present. The detection signals of the optical sensors 20*r* and 20*f* pass through low-pass filters 34*r* and 34*f* used to eliminate high-frequency noise; the levels of these signals are calibrated to a value of 0 to 5 V by amplifiers 35*r* and 35*f* used for level calibration, and the signals are then applied to A/D converters 36*r* and 36*f*.

Figure 13:
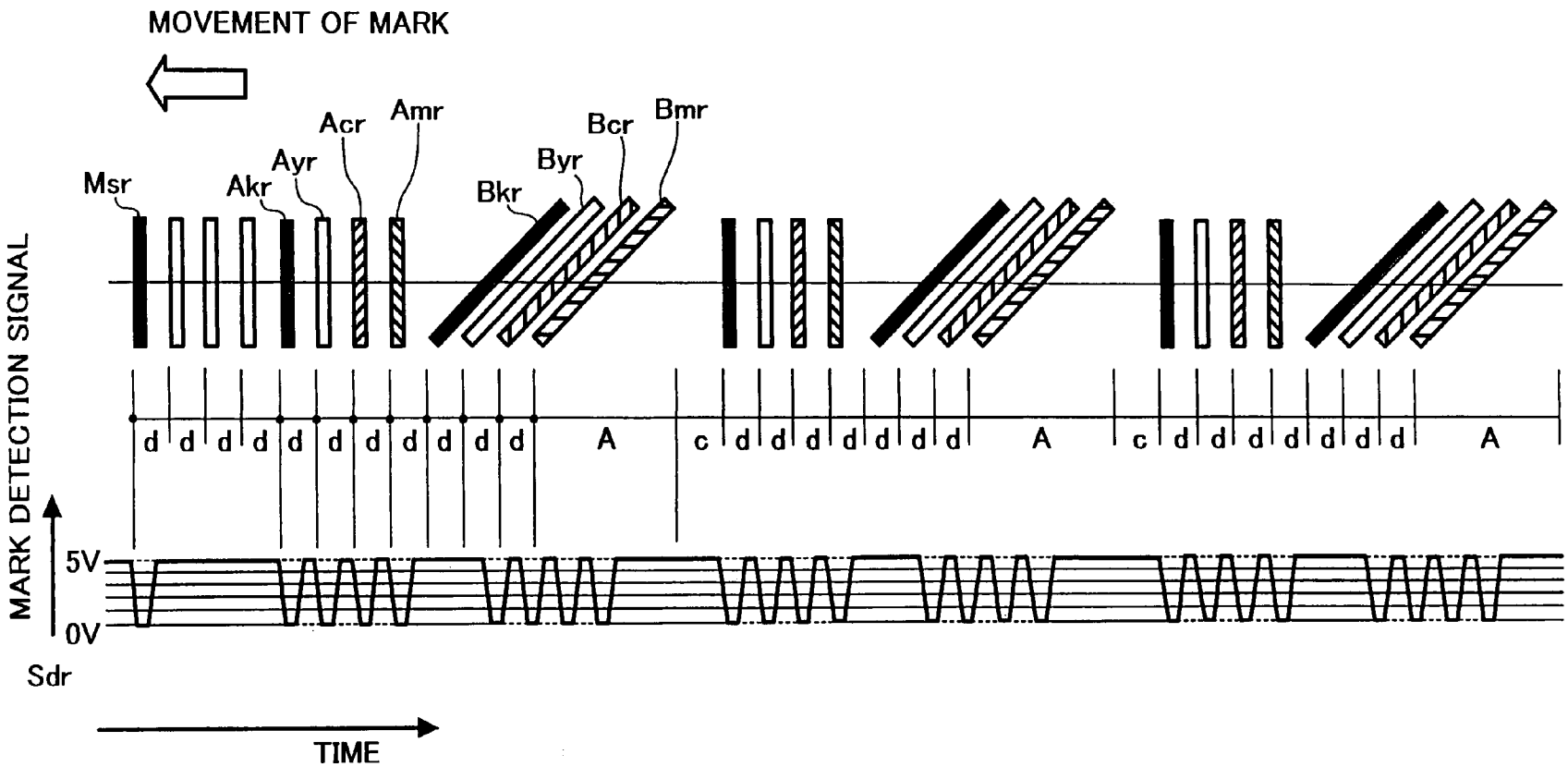
FIG. 13 shows a plan view illustrating the distribution of the color marks formed on the abovementioned transfer belt, and a timing chart illustrating the variation in the level fo the color mark detection signals Sdr of the optical sensors 20*r* in the abovementioned color image forming device.

FIG. 13 shows the detection signal SGU calibrated by the amplifier 35*r*. Referring again to FIG. 6, these detection signals Sdr and Sdf are sent to the A/D converters 36*r* and 36*f*, and are further sent to window controllers 39*r* and 39*f* via amplifiers 38*r* and 38*f*.

The A/D converters 36*r* and 36*f* comprise internal ample holding circuits on the input side, and comprise data latches (output latches) on the output side. When A/D conversion command signals Scr and Scf are sent from the MPU 41, the voltages of the detection signals from the amplifiers 35*r* and 35*f* in this case are held, converted into digital data, and held in the data latches. Accordingly, when the read-out of detection signals Sdr and Sdf is required, the MPU 41 can send A/D conversion command signals Scr and Scf to the A/D converters 36*r* and 36*f*, so that digital data expressing the levels of the detection signals Sdr and Sdf, i.e., detection data Ddr and Ddf, can be read in.

In cases where the detection signals from the amplifiers 38*r* and 38*f* are within the range of 2 V to 3 V, the window comparators 39*r* and 39*f* generate low level L level judgement signals Swr and Swf, while in cases where the detection signals from the amplifiers 38*r* and 38*f* are outside the range of 2 V to 3 V, the window comparators 39*r* and 39*f* generate high level H level judgement signals Swr and Swf. By referring to these level judgement signals Swr and Substantially wave-form constituent elements, the MPU can immediately recognize whether or not the detection signals Sdr and Sdf are within these ranges. Furthermore, the MPU 41 takes in signals from the micro-switches 69*a* through 69*d* and 79*a* through 79*d* that indicate the open or closed state of these micro-switches.

Figure 7:
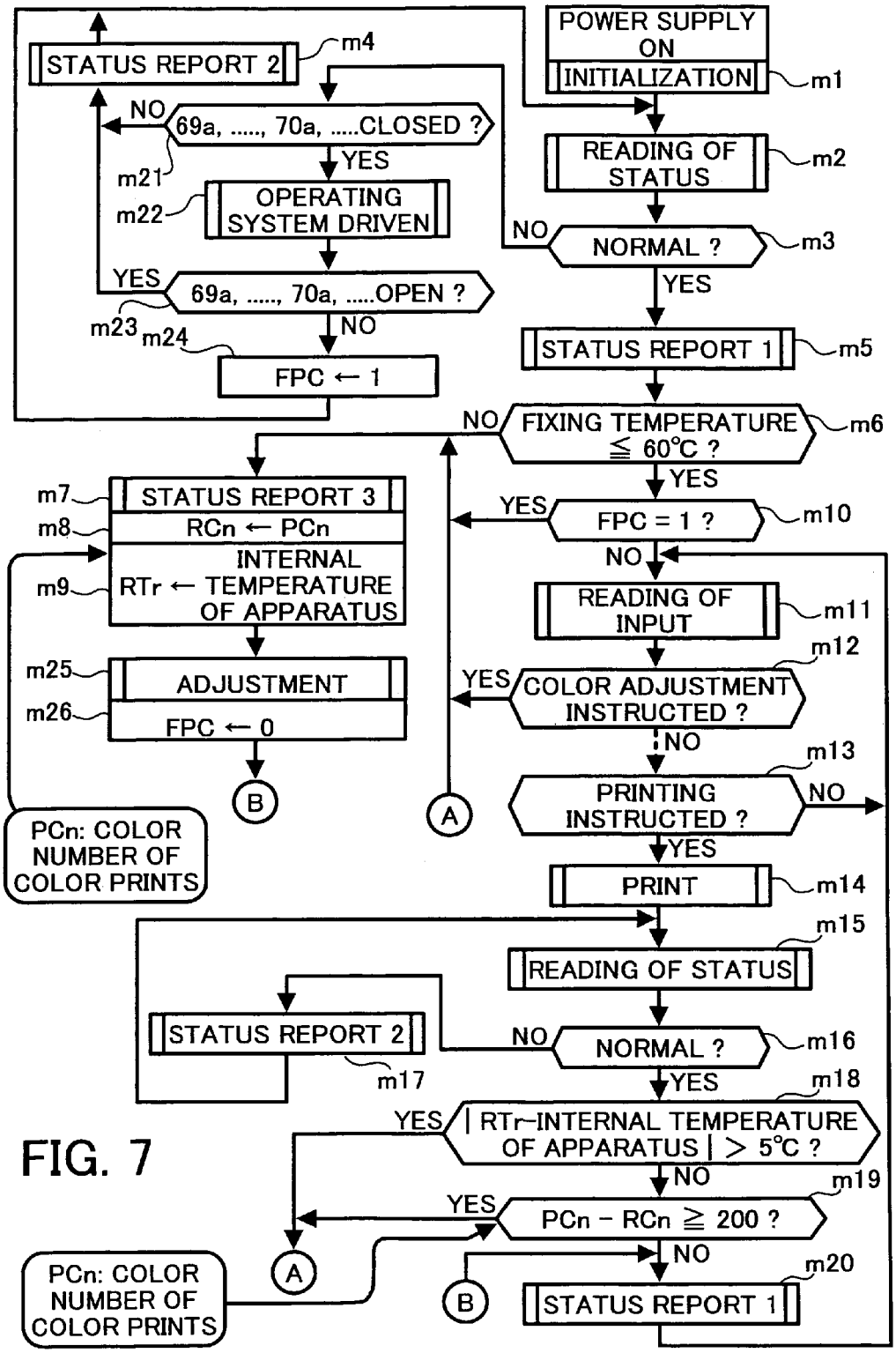
FIG. 7 is a flow chart showing the printing control flow of the micro-computer of the same process controller.

FIG. 7 shows an outline of the printer engine control, i.e., printing control, of the MPU 41. When the power supply is switched on so that an operating voltage is applied, the signal level of the input-output port is set as the signal of a waiting state, and the internal register, timer and the like are also set in a waiting state (step m1). Hereafter, furthermore, when a step number or step symbol is indicated in parentheses, the word "step" is omitted, and only the number or symbol is noted.

When the MPU 41 completes this initiation (m1), the MPU 41 reads the status of the various mechanism parts and electrical circuits of the digital color copier (1), and checks in order to ascertain whether there is any abnormality that interferes with image formation, or whether the system is normal (m2, m3). In cases where there is an abnormality, the MPU 41 checks the open or closed states of the micro-switches 69*a* through 69*d* and 79*a* through 79*d* (m21). In cases where any of the micro-switches 69*a* through 69*d* and 79*a* through 79*d* are closed (on), this means that the units (latent image forming units or developing units) corresponding to these closed micro-switches have not been mounted, or that these units are in a state in which the power supply of the copier (1) has been switched on immediately after replacement with a new unit.

In order to check which of these states is involved, the MPU 41 checks the open or closed states of the micro-switches 69*a* through 69*d* and 79*a* through 79*d* by temporarily driving the four operating systems described above that respectively form images on the photosensitive drums 6*a* through 6*d* (m22, m23). As a result, the transfer belt 10 is driven in the conveying direction of the transfer paper, and the charging rollers 62, . . . that contact these photosensitive drums and the developing rollers 72, . . . of the developing units 7*a* through 7*d* rotate, so that in cases where this operation is performed immediately after any of the units (latent image forming units or developing units) have been replaced by new units, the micro-switches that were closed are switched to an open state (indicating the mounting of units). In cases where there has been no mounting of units, the micro-switches remain closed.

In cases where a micro-switch that was closed is switched to an open state as a result of the driving of the operating system, e.g., when the micro-switch 69*d* that ascertains the attachment or detachment of the latent image forming unit 60*d* is switched from open (PSd=H) to closed (PSd=L), the MPU 41 clears the print multiple number register (one region in the nonvolatile memory) corresponding to the Bk latent image forming unit 60*d* (i.e., initializes the Bk print multiplication number to 0), an writes "1", indicating that the unit has been replaced, into a register FPC (m24).

In cases where a given micro-switch has not been switched to an open state, the MPU 41 judges that no unit has been mounted, and notifies the operating and display board OPB of an abnormality indicating this (m4). Furthermore, if other abnormalities are present, the MPU 41 displays these abnormalities on the operating and display board OPB (m4). The MPU 41 repeats this status reading, abnormality checking and abnormality notification (m2 through m4) until the abnormality is eliminated.

If there are no abnormalities, the MPU 41 initiates the powering of the fixing unit 12, and performs a check as to whether or not the fixing temperature of the fixing unit 12 is a temperature that allows fixing. If this temperature is not a temperature that allows fixing, the MPU 41 causes a "wait" display to be displayed on the operating and display board OPB; if this temperature is a temperature that allows fixing, the MPU 41 causes a "printing possible" display to be displayed on the operating and display board OPB (m5).

Furthermore, the MPU 41 performs a check in order to ascertain whether or not the fixing temperature is 60° C. or greater (m6), and if the fixing temperature of the fixing unit 12 is less than 60° C., the MPU 41 tentatively judges that the power supply of the copier (1) has been switched on after a long idle period (non-use period) (e.g., the power supply being switched on first thing in the morning: large variation in the internal environment of the apparatus during the idle period). In this case, the MPU 41 causes "performing color adjustment" to be displayed on the operating and display board OPB (m7); furthermore, the MPU 41 writes the color print multiple number PCn held in the nonvolatile memory at this time into the register (memory region) RCn of the MPU 41 (m8), writes the internal temperature of the apparatus at this time into the register RTr of the MPU 41 (m9), and performs "adjustment" (m25). When this is completed, the MPU 41 clears the register FPC (m26). The content of the abovementioned "adjustment" (m25) will be described with reference to FIG. 8A and subsequent figures.

In cases where the fixing temperature of the fixing unit 12 is 60° C. or greater, the MPU 41 can judge that the elapsed from the previous switching "off" of the power supply of the copier (1) has been short. In this case, it may be inferred that the change in the internal environment of the apparatus from the time immediately preceding the previous switching "off" of the power supply to the present time has been small. However, a check is made (m10) in order to ascertain whether or not there has been a replacement of the latent image forming units 60*a*, . . . or developing units 7*a* through 7*d* of any of the colors, i.e., whether or not information indicating unit replacement (FPC=1) has been produced in the abovementioned step m24. If information indicating unit replacement has been produced (FPC=1), i.e., if there has been a replacement of any of the units, the MPU 41 performs the abovementioned steps m7 through m9, and performs the "color adjustment" (the adjustment of step m25, and step m26) described below.

In cases where there has been no replacement of units (latent image forming units or developing units), the MPU 41 waits for the input of the operator via the operating and display board OPB or commands from the personal computer PC (m11), and reads these input items or commands (m12). When a "color adjustment" instruction is given by the operator via the operating and display board OPB, the MPU 41 performs the abovementioned steps m7 through m9, and then performs the "color adjustment" (the adjustment of step m25, and step m26) described below.

In cases where the fixing temperature of the fixing unit 12 is a temperature that allows fixing, and the respective parts are ready, if there is a "copy start" instruction ("print" instruction) from the operating and display board OPB, or if there is a "print start" instruction from the system controller 26 corresponding to a printing command from the personal computer PC, the MPU 41 causes the operating system to perform a designated number of image formation operations (m13, m14).

In this image formation, each time that the MPU 41 completes image formation on one sheet of the transfer paper and discharges the transfer paper (if this image formation is color image formation), the MPU 41 increases the respective data in the total print number register, color print multiple number register PCn and each of the print multiple number registers for the respective colors Bk, Y, C and M (assigned to the nonvolatile memory) by one increment. In cases where the image formation is monochromatic image formation, the MPU 41 increases the respective data in the total print number register, monochromatic print multiple number register and Bk print multiple number register by one increment.

Furthermore, in cases where any of the latent image carrying units 60*a* through 60*d* have been replaced by new units, the data in the print multiple number registers for the respective colors Bk, Y, C and M is respectively initialized (cleared) to data indicating 0.

Each time that image formation is performed on one sheet, the MPU 41 checks for the presence or absence of abnormalities such as paper trouble or the like, and when image formation has been completed on a designated number of sheets, the MPU 41 reads in the developing concentration, fixing temperature, temperature inside the apparatus and status values of various other parts (m15), and performs a check in order to ascertain whether or not there are any abnormalities (m16). If there are abnormalities, the MPU 41 causes such abnormalities to be displayed on the operating and display board OPB-(m17), and repeats steps m15 through m17 until the abnormalities are eliminated.

In the case of a state in which image formation can be initiated, i.e., a normal state, the MPU 41 performs a check in order to ascertain whether or not the temperature inside the apparatus at this time has undergone a temperature variation exceeding 5° C. from the temperature inside the apparatus at the time of the previous color adjustment (data RTr in the register RTr) (m18). In cases where there has been a temperature variation exceeding 5° C. from the temperature inside the apparatus at the time of the previous color adjustment (data RTr in the register RTr), the MPU 41 performs the abovementioned steps m7 through m9, and performs the "color adjustment" (the adjustment of step m25, and step m26) described below.

In cases where there has not been any temperature variation exceeding 5° C. from the temperature inside the apparatus at the time of the previous color adjustment (data RTr in the register RTr), the MPU performs a check in order to ascertain whether or not the value of the color print multiple number register PCn exceeds the value RCn of the color print multiple number register PCn (data in the register RCn) at the time of the previous color adjustment by an amount equal to 200 sheets or greater (m19), and if the value of the color print multiple number register PCn exceeds the value RCn of the color print multiple number register PCn (data in the register RCn) at the time of the previous color adjustment by an amount equal to 200 sheets or greater, the MPU 41 performs the abovementioned steps m7 through m9, and performs the "color adjustment" (the adjustment of step m25, and step m26) described below. In cases where the value of the color print multiple number register PCn does not exceed the value RCn of the color print multiple number register PCn (data in the register RCn) at the time of the previous color adjustment by an amount equal to 200 sheets or greater, the MPU 41 performs a check in order to ascertain whether or not the fixing temperature of the fixing unit 12 is a temperature that allows fixing, and if the fixing temperature of the fixing unit 12 is not a temperature that allows fixing, the MPU 41 causes a "wait" display to be displayed on the operating and display board OPB. On the other hand, if the fixing temperature of the fixing unit 12 is a temperature that allows fixing, the MPU 41 causes a "printing possible" display to be displayed on the operating and display board OPB (m20), and proceeds to "reading of input" (m11).

In accordance with the control flow shown in the above-mentioned FIG. 7, the MPU 41 performs the abovementioned "adjustment" (m25) (1) in cases where the power supply is switched on when the fixing temperature of the fixing unit 12 is less than 60° C., (2) in cases where any of the units (latent image forming units or developing units) for Bk, Y, C and M have been replaced by new units, (3) in cases where there has been a color adjustment instruction from the operating and display board OPB, (4) in cases where the print-out of a designate number of sheets has been completed, and the temperature inside the apparatus shows a change exceeding 5° C. from the internal temperature of the apparatus at the time o the previous color adjustment, and (5) in cases where the print-out of a designate number of sheets has been completed, and the color print multiple number PCn exceeds the value RCn at the time of the previous color adjustment by 200 or greater.

Figure 8A:
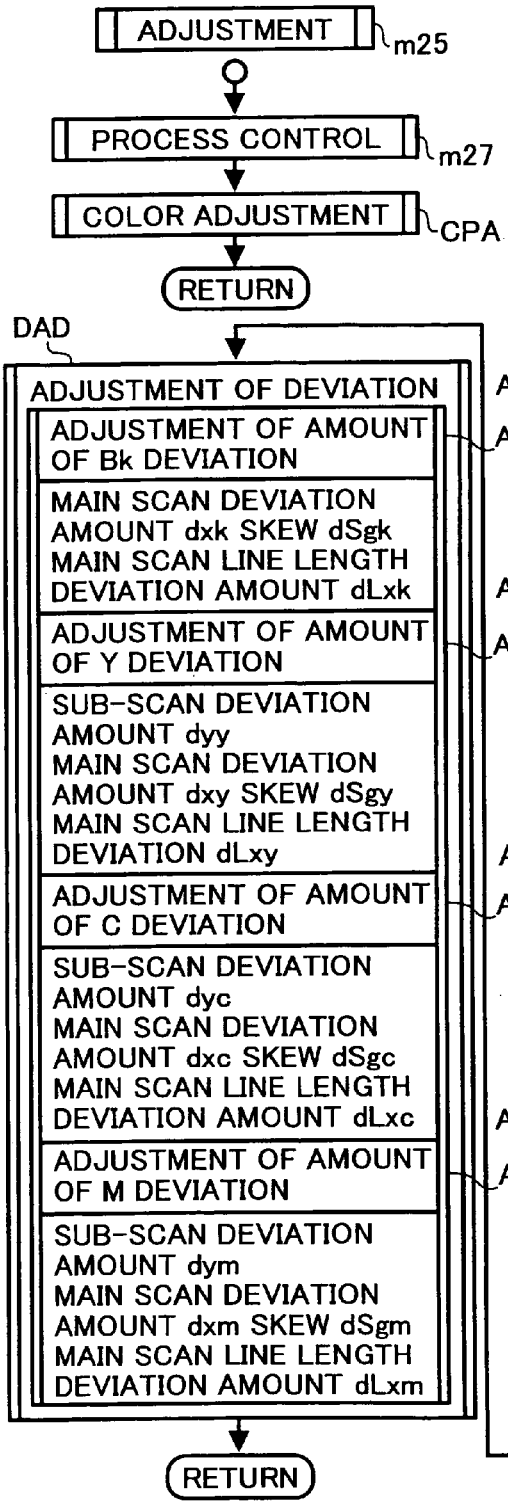
FIGS. 8A and 8B are flow charts showing the "adjustment" and "color adjustment" of the same printing control flow.

FIG. 8A shows the content of the above-mentioned "adjustment" (m25). In the above-mentioned "adjustment" (m25), the MPU 41 first sets all of the image forming conditions such as charging, exposure, development, transfer and the like at reference values, forms images of Bk, Y, C and M on the rear r and front f of the transfer belt 10, detects the image density by means of the optical sensors 20*r* or 20*f*, and adjusts and sets the voltage applied to the charging roller 62 from the power supply, the exposure intensity of the write unit 5 and the developing biases of the developing units 7*a*, 7*b*, 7*c* and 7*d*, so that this image density is maintained at the reference value, in "process control" (m27). Next, the MPU 41 performs "color adjustment" (CPA).

Figure 8B:
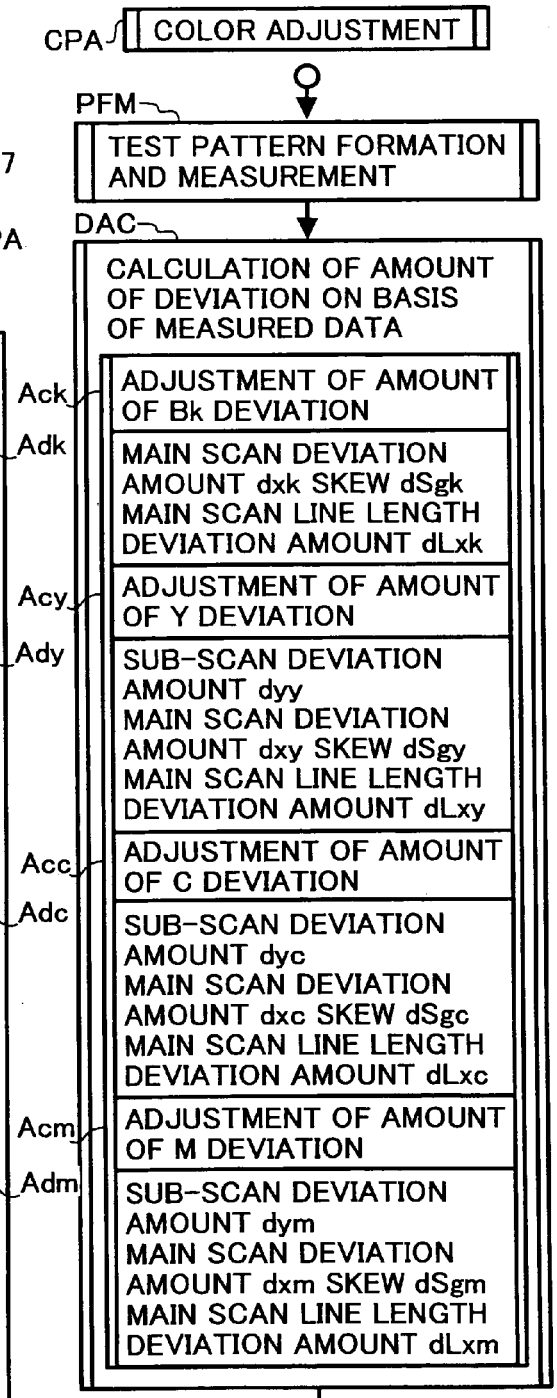

FIG. 8B shows the content of the "color adjustment" (CPA). In this "color adjustment" (CPA), the MPU 41 first forms starting marks Msr and Msf and eight mark sets as respective test patterns on the rear r and front f of the transfer belt 10 as shown in FIG. 5 by causing a test pattern signal generator (not shown in the figures) to send test pattern signals to the write unit 5 in accordance with the image forming conditions (PFM) set in the abovementioned "process control" (m27), causes the respective marks of these test patterns to be detected by the optical sensors 20*r* and 20*f*, causes the resulting mark detection signals Sdr and Sdf to be converted into digital data, i.e., mark detection data Ddr and Ddf, by the A/D converters 36*r* and 36*f*, and reads in this data, "test pattern formation and measurement" (PFM).

Then, the MPU 41 calculates the positions (distribution) of the center points of the respective marks of the test patterns on the transfer belt 10 from the abovementioned mark detection data Ddr and Ddf. Furthermore, the MPU 41 calculates the mean patterns (groups of mean values) for the eight mark sets on the rear side, and the mean patterns for the similar eight mark sets on the front side. This "test pattern formation and measurement" (PFM) will be described with reference to FIG. 9 and subsequent figures.

When the MPU 41 calculates the above-mentioned mean patterns, the MPU 41 calculates the amount of deviation in image formation according to the image formation units (the abovementioned image formation system) for Bk, Y, C and M on the basis of these mean patterns (DAC), and performs an adjustment that is used to eliminate the deviation in image formation on the basis of the calculated amounts of deviation in image formation (DAD).

Figure 9:
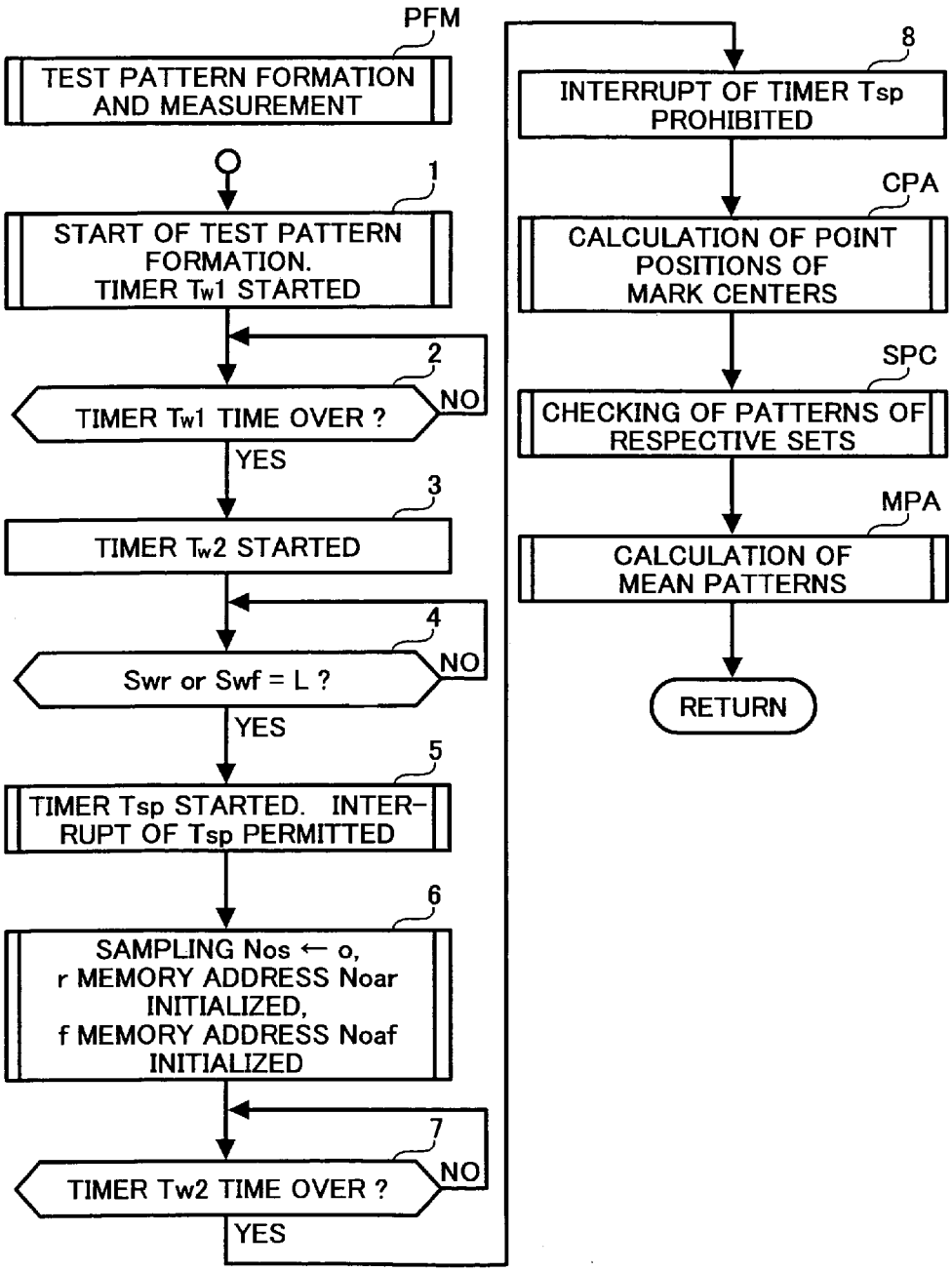
FIG. 9 is a flow chart showing the "test pattern formation and measurement" in the same "color adjustment"

FIG. 9 shows the content of the above-mentioned "test pattern formation and measurement" (PFM). In this "test pattern formation and measurement" (PFM), the MPU 41 causes test pattern signals to be sent to the write unit 5 from the test pattern signal generator, thus causing the formation of starting marks Msr and Msf and eight mark sets in which (for example) the width w of the marks in the y direction is 1 mm, the length A of the marks in the x direction (i.e., the length A of the marks on the tail ends of the mark sets in the x direction) is 20 mm, the pitch d is 6 mm, and the spacing c between mark sets is 9 mm, to be simultaneously initiated on the respective surfaces of the rear side r and front side f of the transfer belt 10 which is driven at a constant speed of (for example) 125 mm/sec by the image formation system as shown in FIG. 5; furthermore, the MPU 41 starts a timer Tw1 (whose time limit value is Tw1) that is used to measure the timing up to the point in time immediately preceding the point in time at which the starting marks Msr and Msf arrive at a point directly beneath the optical sensors 20*r* and 20*s* (1), and waits for this timer Tw1 to go over this time ("time up") (2). When the timer Tw1 goes over the abovementioned time, the MPU 41 then starts a timer Tw2 (whose time limit value is Tw2) that is used to measure the timing at which the last of the respective eight mark sets on the rear and front of the transfer belt 10 passes the optical sensors 20*r* and 20*f* (3).

Figure 14A:
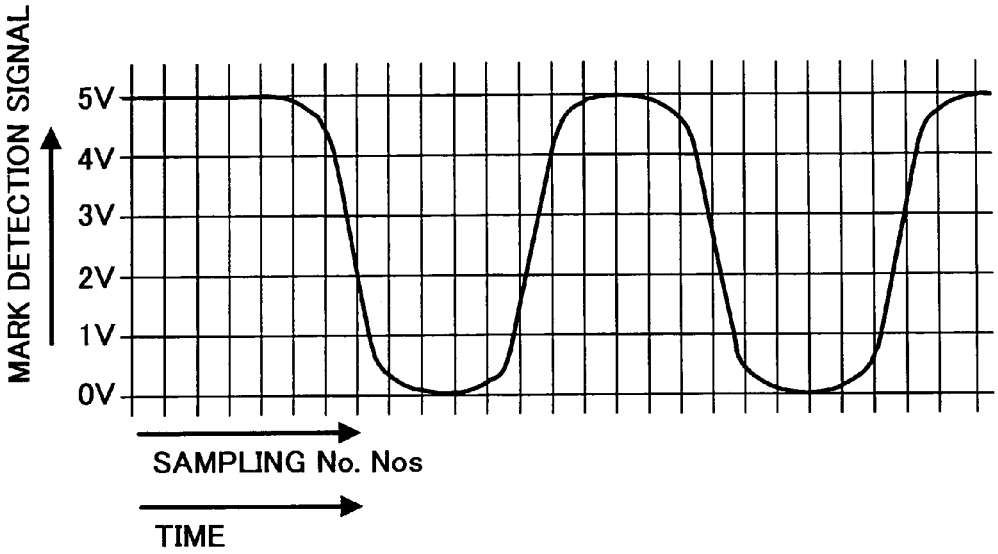
FIG. 14A is a timing chart showing an enlargement of a portion of the timing chart of the detection signals Sdr shown in FIG. 13.

As was already described above, when no mark for Bk, Y, C or M is present in the visual fields of the optical sensors 20*r* and 20*f*, the detection signals Sdr and Sdf from the optical sensors 20*r* and 20*f* are at a high level H (5 V), and when such marks are present in the visual fields of the optical sensors 20*r* and 20*f*, the detection signals Sdr and Sdf from the optical sensors 20*r* and 20*f* are at a low level L (0 V). Thus, the detection signal Sdr shows a level fluctuation such as that shown in FIG. 13 as a result of the constant-speed movement of the transfer belt 10. FIG. 14A shows an enlargement of a portion of this level fluctuation. In FIG. 14A, the falling regions in which the levels of the mark detection signals are falling correspond to the leading end edges of the marks, while the rising regions in which levels of the mark detection signals are rising correspond to the trailing end edges of the marks. The areas between these falling regions and rising regions are regions that have the width w of the marks.

In step 4, as is shown in FIG. 9, the MPU 41 waits for the detection signal Swr or Swf from the window comparator 39*r* or 39*f* shown in FIG. 6 to reach L, which indicates that the detection signal Sdr or Sdf is at 2 to 3 V, in the process of the starting mark Msr or Msf reaching the visual field of the optical sensor 20*r* or 20*f* so that the detection signal Sdr or Sdf changes from H to L. Specifically, the MPU 41 monitors whether or not the edge region of at least one of the starting marks, i.e., the starting mark Msr or Msf, has reached the visual field of the optical sensor 20*r* or 20*f*.

Figure 10:
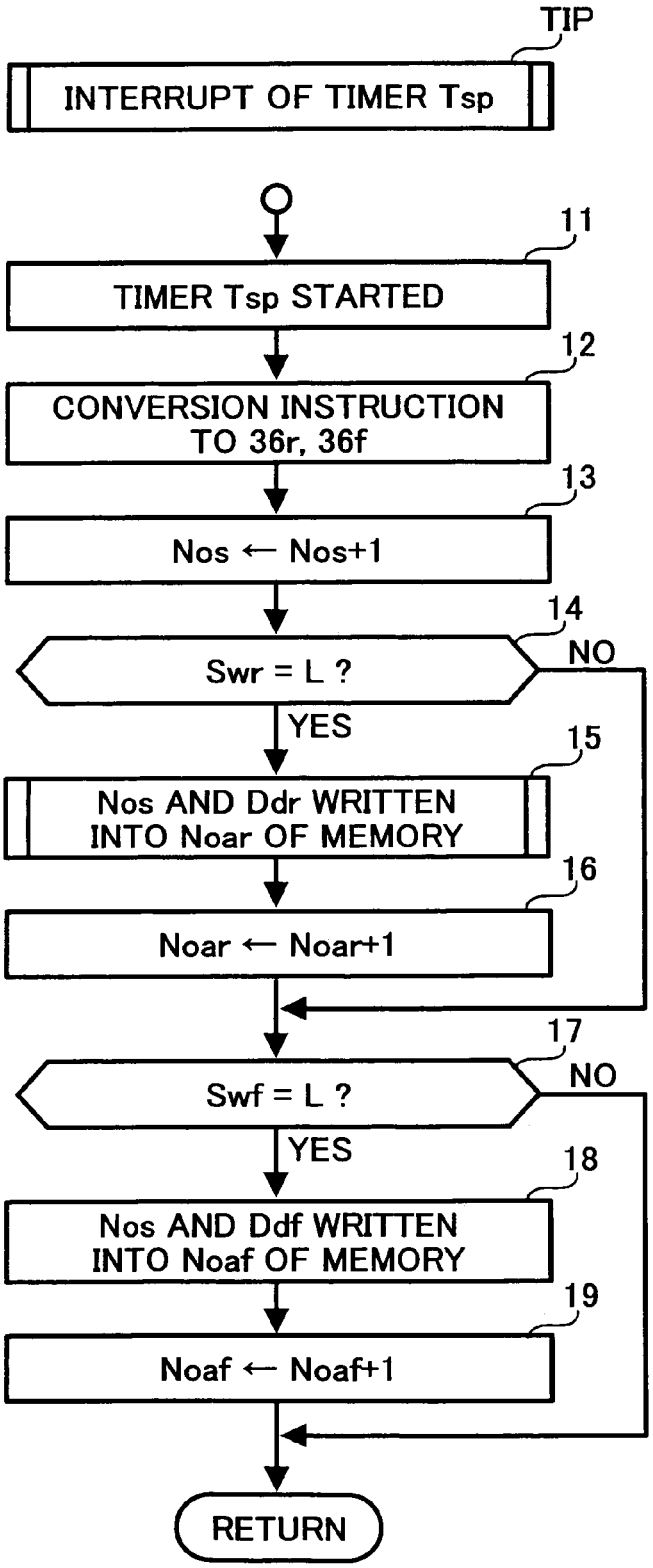
FIG. 10 is a flow chart showing the interrupt processing in the same "test pattern formation and measurement"

When the edge region of at least one of the starting marks, i.e., the starting mark Msr or Msf, arrives in the visual field of the optical sensor 20*r* or 20*f*, the MPU 41 starts a timer Tsp whose time limit value is Tsp (e.g., 50 μsec), and when this timer goes over this time, the MPU 41 allows the "interrupt of the timer Tsp" (TIP) shown in FIG. 10, and causes this interrupt to be performed (5). Next, the MPU 41 initializes the value of the number of times of sampling Nos in the register Nos for the number of times of sampling to 0, and initializes the write-in addresses Noar and Noaf of the r memory (rear side mark read-out data memory region) and f memory (front side mark read-out data memory region) assigned to the FIFO memory inside the MPU 41 to the starting addresses (6). The MPU 41 then waits for the timer Tw2 to go over the abovementioned time, i.e., waits for all of the eight sets of test patterns to finish passing through the visual fields of the optical sensors 20*r* and 20*f* (7).

Here, the content of the above-mentioned "interrupt of the timer Tsp" (TIP) will be described with reference to FIG. 10. This processing of the "interrupt of the timer Tsp" (TIP) is performed each time that the timer Tsp with a time limit value of Tsp runs over time. At the beginning of this processing, the MPU 41 starts the timer TsP (11), and instructs the A/D converters 36*r* and 36*f* to perform A/D conversion (12), i.e., temporarily places the command signals Scr and Scf at the A/D conversion command level L. Furthermore, the MPU 41 increases the value Nos of the number of times of sampling of the register Nos for the number of times of sampling, which indicates the number of times that there has been an instruction for A/D conversion, by one increment (13).

As a result, Nos×Tsp expresses the time elapsed from the detection of the leading end edge of the starting mark Msr or Msf (this equals the current position on the transfer belt 10 detected by the optical sensor 20*r* or 20*f* in the movement direction y of the transfer belt 10 along the surface of the transfer belt 10, with the starting mark Msr or Msf taken as a base point).

The MPU 41 performs a check in order to ascertain whether or not the detection signal Swr from the window comparator 39*r* is L (i.e., whether or not the edge part of the mark is being detected by the optical sensor 20*r*, so that 2 V≦Sdr≦3 V) (14), and if the detection signal Swr from the window comparator 39*r* is L, the MPU 41 writes the value Nos of the number of times of sampling from the register Nos for the number of times of sampling, and the data Ddr obtained by A/D conversion (i.e., the digital value of the mark detection signal Sdr from the optical sensor 20*r*), into the address Noar of the r memory as write-in data (15), and increases the write-in address Noar of the r memory by one increment (16).

In cases where the detection signal Swr from the window comparator 39*r* is H (Sdr<2 V or 3 V<Sdr), the MPU 41 does not write data into the r memory. This is done in order to reduce the amount of data that is written into the memory, and in order to facilitate subsequent data processing.

Next, the MPU 41 similarly performs a check in order to ascertain whether or not the detection signal Swf from the window comparator 39*f* is L (i.e., whether or not the edge part of a mark is being detected by the optical sensor 20*f*, so that 2 V≦Sdf≦3 V) (17), and if the detection signal Swf from the window comparator 39*f* is L, the MPU 41 writes the value Nos of the number of times of sampling from the register Nos for the number of times of sampling, and the data Ddf obtained by A/D conversion (i.e., the digital value of the mark detection signal Sdf from the optical sensor 20*f*), into the address Noaf of the f memory as write-in data (18), and increases the write-in address Noaf of the f memory by one increment (19).

Figure 14B:
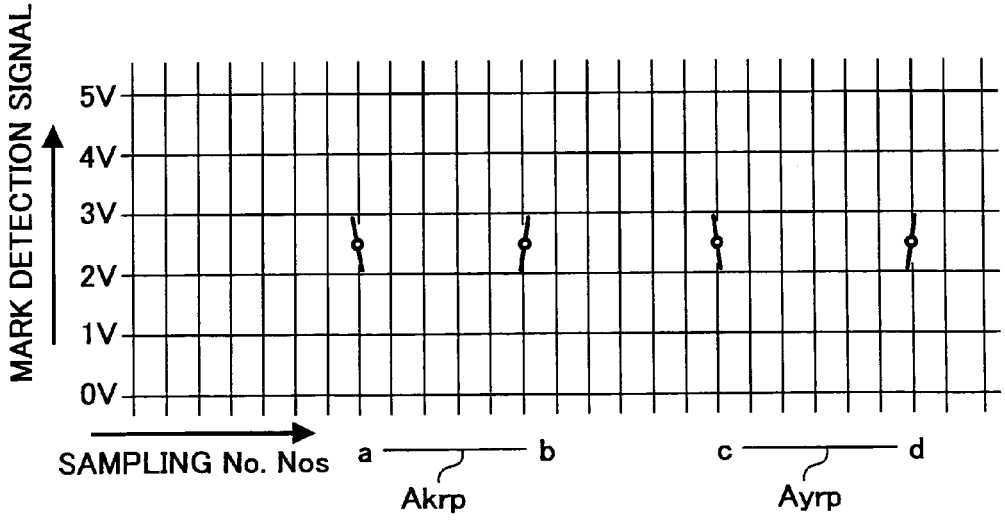
FIG. 14B is a timing chart showing an extraction of only the range in which the A/D converted data is written into the FIFO memory (within the detection signals shown in FIG. 14A)

Such interrupt processing is repeated during the period of Tsp. Accordingly, when the mark detection signals Sdr and Sdf from the optical sensors 20*r* and 20*f* vary between high and low as shown in FIG. 14A, only the digital data Ddr and Ddf of the detection signals Sdr and Sdf within the range of 2 V to 3 V shown in FIG. 14B are stored along with the value Nos of the number of times of sampling in the r memory and f memory assigned to the FIFO memory inside the MPU 41. Since the value Nos of the number of times of sampling in the register Nos for the number of times of sampling is increased by one increment in the period of Tps, and the transfer belt 10 moves at a constant speed, the value Nos of the number of times of sampling indicates the positions of the respective marks in the y direction along the surface of the transfer belt 10 with the detected starting marks taken as base points.

Furthermore, the center point Akrp between the center position a of the falling region in which the level of the mark detection signal is falling and the center position b of the next rising region in which the level of the mark detection signal is rising (within the range of 2 V to 3 V as shown in FIG. 14B) is the center position of one mark Akr in the y direction; similarly, the subsequently appearing center point Ayrp between the center position c of the falling region in which the mark detection signal is falling and the center position d of the next rising region in which the level of the mark detection signal is rising is the center position of another mark Ayr in the y direction. In the calculation CPA (FIGS. 11 and 12) of the center positions of the marks that will be described below, these mark center positions Akrp, Ayrp, . . . are calculated.

Referring again to FIG. 9, after the last mark of the final eighth mark set in the test pattern passes the optical sensor 20*r* or 20*f*, so that the timer Tw2 runs over the abovementioned time, the MPU 41 prohibits the interrupt of the timer Tsp (7, 8). As a result, the A/D conversion of the detection signals Sdr and Sdf in the period of Tsp shown in FIG. 10 stops. The MPU 41 calculates the center positions of the marks (CPA) on the basis of the detection data Ddr and Ddf in the r memory and f memory of the internal FIFO memory, verifies the suitability of the distribution of the mark center positions respectively detected for each of the eight mark sets on the rear r and front f, deletes inappropriate detection patterns (mark sets) (SPC), and determines the mean patterns of appropriate detection patterns (MPA).

Figure 11:
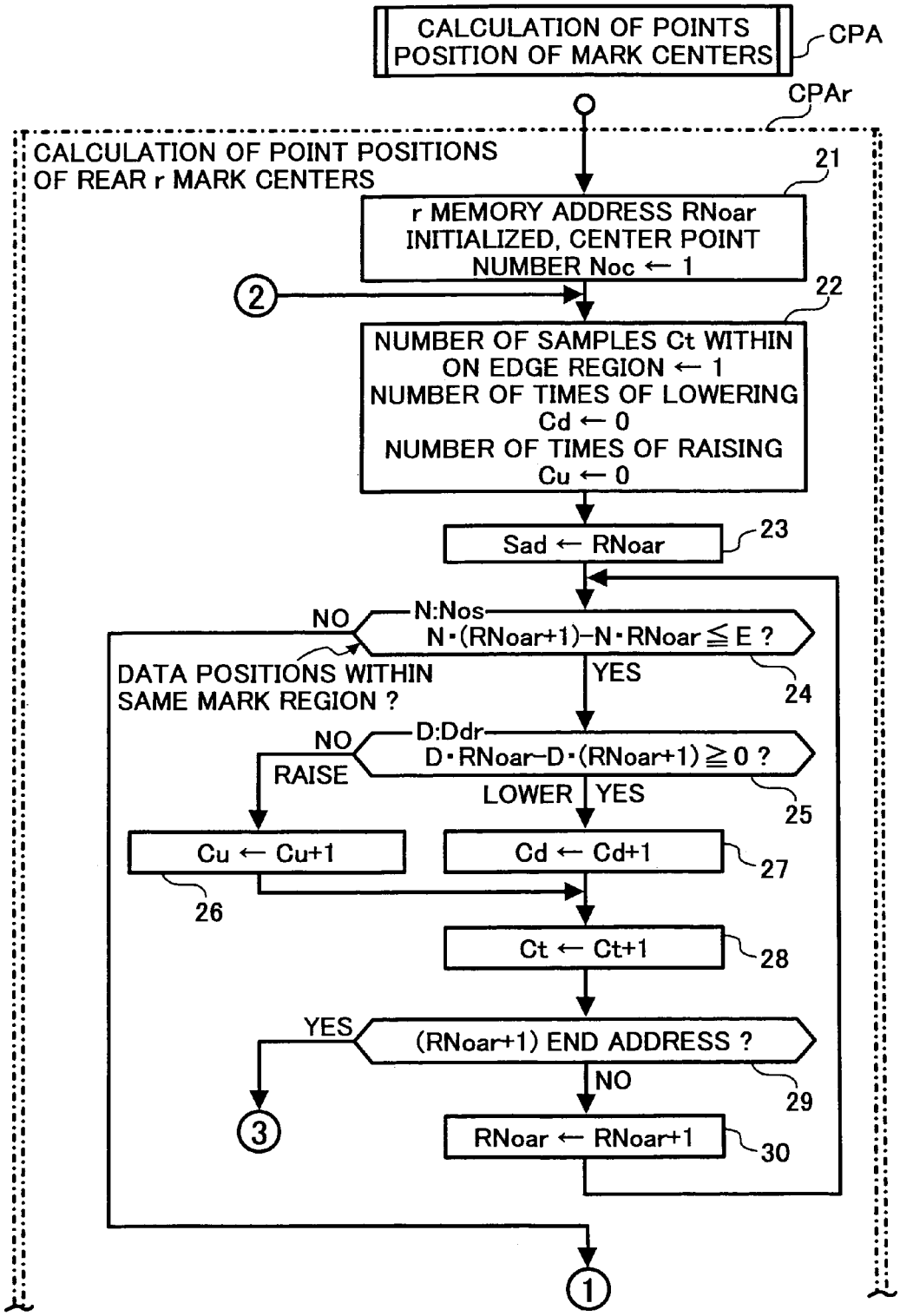
FIG. 11 is a flow chart showing a portion of the "calculation of the mark center point positions" in FIG. 9.
Figure 12:
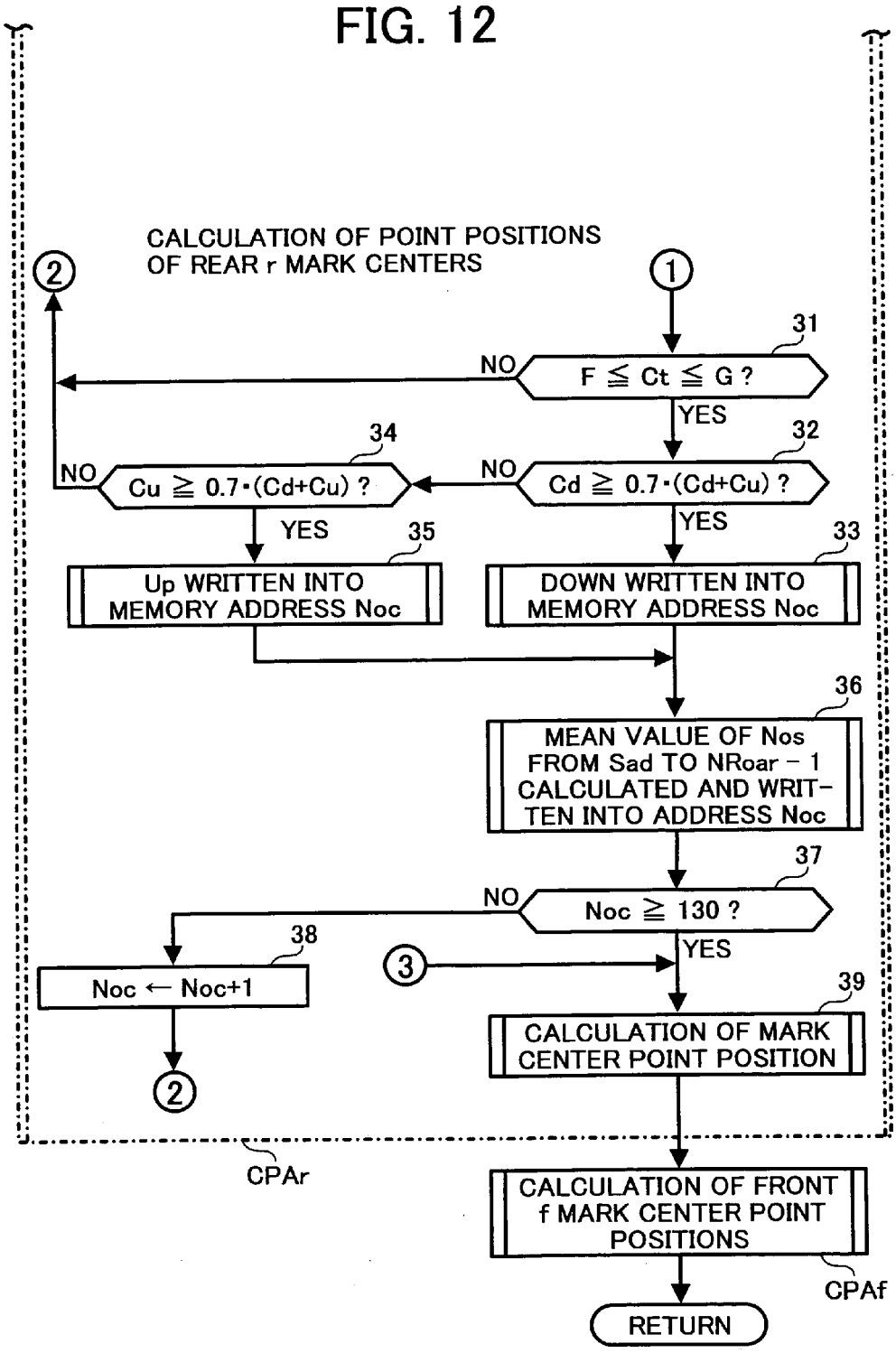
FIG. 12 is a flow chart showing another portion of the "calculation of the mark center point positions" CPA.

FIGS. 11 and 12 show the content of the abovementioned "calculation of mark center positions" (CPA). Here, the "calculation of mark center positions on the rear r" (CPAr) and "calculation of mark center positions on the front f" (CPAf) are performed.

In the "calculation of mark center position on the rear r" (CPAr), the MPU 41 first initializes the read-out address RNoar of the r memory assigned to the internal FIFO memory, and initializes the center point number register Noc to 1, which indicates the first edge (21). Next, the MPU 41 initializes the data Ct of the register Ct for the number of samples within one edge region to 1, and initializes the data Cd and Cu of the register Cd for the number of times of falling and the register Cu for the number of times of rising to 0 (22). Next, the MPU 41 writes the read-out address RNoar into the edge region data group head address register Sad (23). The above processing is preparatory processing for the data processing of the first edge region.

Next, the MPU 41 reads out the data (y position Nos: N-RNoar, detection level Ddr: D-RNoar) from the address RNoar of the r memory, and also reads out the data (y position Nos: N-(RNoar+1), detection level Ddr: D-(RNoar+1)) from the next address RNoar+1, and performs a check in order to ascertain whether or not the difference (N-(RNoar+1)−N-RNoar) between the positions of the two sets of read-out data in the y direction is E (for example, E=w/2=(e.g.) a value corresponding to ½ mm) or less (in the same edge region) (24). If the difference between the positions of the two sets of read-out data in the y direction is E or less, the MPU 41 performs a check in order to ascertain whether the mark detection data Ddr is showing a falling trend or a rising trend by judging whether or not the detection level difference between the abovementioned two sets of read-out data (D-RNoar−D-(RNoar+1)) is equal to or greater than 0 (25). If the mark detection data Ddr is showing a falling trend, the data Cd in the register Cd for the number of times of falling is increased by one increment (27); if the mark detection data Ddr is showing a rising trend, the data Cu in the register Cu for the number of times of rising is increased by one increment (26).

Next, The MPU 41 increases the data Ct in the register Ct for the number of samples within one edge region by one increment (28). Then, the MPU 41 performs a check in order to ascertain whether or not the r memory read-out address RNoar is the end address of the r memory (29). If the r memory read-out address RNoar is not the end address of the r memory, the memory read-out address RNoar is increased by one increment (30), and the abovementioned processing (24 through 30) is repeated.

When the y position (Nos) of the read-out data changes to that of the next edge region, the difference in position between the respective position data of the preceding and following memory addresses (N-(RNoar+1)−N-RNoar) that is checked in step 24 becomes greater than E, an the MPU 41 proceeds to step 31 in FIG. 12 from step 24. Here, checking of the falling and rising trends of all of the sampling data in one mark edge region (leading edge or trailing edge region) is completed.

Accordingly, the MPU 41 performs a check in order to ascertain whether or not the sampling number data Ct in the register Ct for the sampling number within one edge in this case is the corresponding value within one edge region (within a range of 2 V to 3 V); specifically, the MPU 41 performs a check in order to ascertain whether or not $F \leqq Ct \leqq G$ (31). Here, F indicates the lower limit value (set value) of the number of times of writing of the sampling value Ddr into the r memory when the detection signal Sdr is 2 V to 3. V in a case where the leading end edge or trailing end edge of a normally formed mark is detected, and G is the upper limit value (set value) of the number of times of writing of the sampling value Ddr into the r memory when the detection signal Sdr is 2 V to 3 V in a case where the leading end edge or trailing end edge of a normally formed mark is detected.

If Ct is such that $F \leqq Ct \leqq G$, the MPU 41 completes the error check of the data for one mark edge for which read-out and data storage have been performed in a normal manner, an the result is "correct"; accordingly, a check is made in order to ascertain whether the detection data group obtained in relation to this mark edge is showing a falling trend or rising trend in terms of the edge region (2V to 3V) overall (32, 34). In the case of this digital copier (1), if the data Cd in the register Cd for the number of times of falling is equal to or greater than 70% of the sum Cd+Cu of this data and the data Cu in the register Cu for the number of times of rising (i.e., if $Cd \geqq 0.7(Cd+Cu)$), the MPU 41 writes information Down that indicates falling into the address of the memory for the edge No. Noc (33). On the other hand, if the data Cu in the register Cu for the number of times of rising is equal to or greater than 70% of Cd+Cu, (i.e., if $Cu \geqq 0.7(Cd+Cu)$), the MPU 41 writes information Up that indicates rising into the address of the memory for the edge No. Noc (34, 35). Furthermore, the MPU 41 calculates the mean values of the y position data for the corresponding edge regions, i.e., the center point positions of the edge regions (a, b, c, d, . . . in FIG. 14B), and writes these values into the address of the memory for the edge No. Noc (36).

Next, the MPU 41 performs a check in order to ascertain whether or not the edge No. Nos has reached 130 or greater, i.e., in order to ascertain whether or not the calculation of the center positions of the respective marks of the leading end edge regions and trailing end edge regions of the starting mark Msr and all of the eight mark sets has been completed. If the calculation of the center positions of these respective marks has been completed, or if all of the read-out of the stored data from the r memory has been completed so that the r memory read-out address RNoar is the end address of the r memory in step 39, the MPU 41 calculates the mark center point positions on the basis of the edge center point position data i.e., the y positions calculated in step 36 (step 39).

Specifically, the MPU 41 reads out the data of the address of the memory for the edge No. Noc (falling/rising data and edge center point position data), and performs a check in order to ascertain whether or not the position difference between the center point position of the preceding falling edge region and the center point position of the immediately following rising edge region is within a range corresponding to the with of the marks in the y direction. If the position difference between the center point position of the preceding falling edge region and the center point position of the immediately following rising edge region deviates from this range corresponding to the width of the marks in the y direction, the MPU 41 deletes this data. If the position difference between the center point position of the preceding falling edge region and the center point position of the immediately following rising edge region, the MPU 41 determines the mean value of the data, and writes this value into the memory in the address of the mark No. from the head position. If the mark formation, mark detection and all of the detected mark processing are correct, then center point position data for a total of 65 marks, i.e., the starting mark Msr and eight mark sets (8 marks in each mark set×8 sets=64 marks), is obtained with regard to the rear r, and is stored in the memory.

Next, the MPU 41 performs the "calculation of mark center positions on the front f" CPAf in the same manner as the abovementioned "calculation of mark center positions on the rear r" CPAr, and processes the measured data in the memory. If the mark formation, mark detection and all of the detected mark processing are correct with respect to the front f, then center point position data for a total of 65 marks, i.e., the starting mark Msf and eight mark sets (64 marks) is obtained, and this data is stored in the memory.

Referring again to FIG. 9, when the mark center point positions are calculated as described above (CPA), the MPU 41 verifies whether or not the mark center point position data groups that have been written into the memory show a center point distribution corresponding to the mark distribution shown in FIG. 5, in the subsequent "checking of patterns of respective sets" (SPC). Here, for the mark center point position data groups that have been written into the memory, the MPU 41 deletes the data that does not correspond to the mark distribution shown in FIG. 5 in set units, and leaves only the data sets (one set has eight data position groups) forming a distribution pattern that corresponds to the mark distribution shown in FIG. 5. In a case where all of the data is correct, the mark center point position data groups written into the memory comprise eight sets on the rear side r, and eight sets on the front side f as well.

Next, the MPU 41 alters the center point position data of the first marks in the respective sets from the second set on to the first center point position of the head set (first set) of the data sets on the rear side r; the center point position data of the second through eighth marks is also altered by an amount corresponding to this altered difference. Specifically, the MPU 41 alters the center point position data groups of the respective sets from the second set on to values that are shifted in the y direction so that the center point positions of the head marks of the respective sets are caused to coincide with the center point position of the head mark of the first set. The MPU 41 also similarly alters the center point position data in the respective sets from the second set on on the front side f as well.

Figure 15:
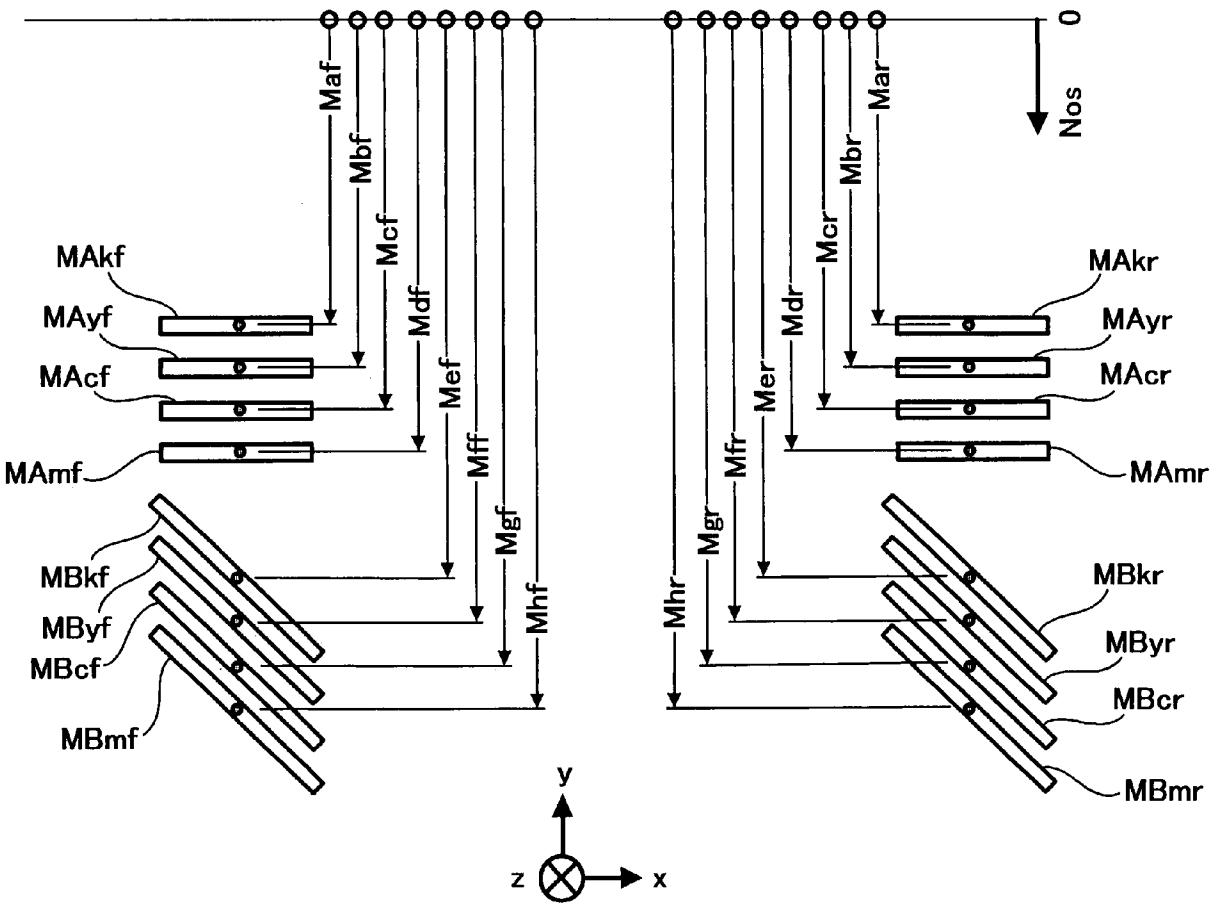
FIG. 15 is a plan view showing the mean value data Mar, . . . calculated by the "mean pattern calculation" MPA shown in FIG. 9, and the virtual marks MAkr, . . . in which these data are the center point positions, i.e., the mark sequences expressed by the mean value data groups.

Next, in the "calculation of mean patterns" (MPA), the MPU 41 calculates the mean values Mar through Mhr (see FIG. 15) of the center point position data of the respective marks of all of the sets on the rear side r, and also calculates the mean values Maf through Mhf (see FIG. 15) of the center point position data of the respective marks of all of the sets on the front side. These mean values indicate the center points positions of the following hypothetical mean position marks (distributed as shown in FIG. 15):

MAkr (representing the rear side orthogonal mark for Bk),
MAyr (representing the rear side orthogonal mark for Y),
MAcr (representing the rear side orthogonal mark for C),
MAmr (representing the rear side orthogonal mark for M),
MBkr (representing the rear side oblique mark for Bk),
MByr (representing the rear side oblique mark for Y),
MBcr (representing the rear side oblique mark for C), and
MBmr (representing the rear side oblique mark for M), as well as
MAkf (representing the front side orthogonal mark for Bk),
MAyf (representing the front side orthogonal mark for Y),
MAcf (representing the front side orthogonal mark for C),
MAmf (representing the front side orthogonal mark for M),
MBkf (representing the front side oblique mark for Bk),
MByf (representing the front side oblique mark for Y),
MBcf (representing the front side oblique mark for C), and
MBmf (representing the front side oblique mark for M).

The above is the content of the "test pattern formation and measurement" (PFM) shown in FIG. 9 and subsequent figures.

Referring again to FIG. 8B, and referring to FIG. 15, in the calculation of the amount of deviation (DAC) shown in FIG. 8B, the MPU 41 calculates the amount of deviation in image formation as follows. Namely, in concrete terms, the MPU 41 performs the calculation of the amount of deviation in Y image formation (Acy) as follows:

The MPU 41 determines the amount of sub-scanning deviation dyy in the formation of the Y image by performing a calculation of $$dyy=(Mbr-Mar)-d$$

as the amount of deviation of the difference (Mbr−Mar) between the center point positions of the Bk orthogonal mark MAkr and Y orthogonal mark MAyr on the rear side r with respect to the reference value d (see FIG. 5).

The MPU 41 determines the amount of main scanning deviation dxy in the formation of the Y image by performing a calculation of $$\begin{aligned} dxy &= (dxyr + dxyf)/2 \\ &= (Mfr - Mbr + Mff - Mbf - Sd)/2 \end{aligned}$$

as the mean value of $$dxyr=(Mfr-Mbr)-4d$$

which is the amount of deviation of the difference (Mfr−Mbr) between the center point positions of the orthogonal mark MAyr and oblique mark MByr on the rear side r with respect to the reference value 4d (see FIG. 5), and $$dxyf=(Mff-Mbf)-4d$$

which is amount of deviation of the difference (Mff−Mbf) between the center point positions of the orthogonal mark MAyf and oblique mark MByf on the front side f with respect to the reference value 4*d* (see FIG. 5)

The MPU 41 determines the skewing dSqy in the image formation of the Y image by performing a calculation of $$dSqy=(Mbf-Mbr)$$

as the difference between the center point positions of the orthogonal mark MAyr on the rear side r and the orthogonal mark MAyf on the front side f. The MPU 41 determines the amount of deviation dLxy in the main scanning line length in the image formation of the Y image by performing a calculation of $$\begin{aligned} dLxy &= (Mff - Mfr) - dSqy \\ &= (Mff - Mfr) - (Mbf - Mbr) \end{aligned}$$

as the value obtained by subtracting the skewing dSqy=(Mff−Mfr) from the difference (Mff−Mfr) between the center point positions of the oblique mark MByr on the rear side r and the oblique mark MByf on the front side f.

The MPU 41 calculates the amounts of deviation in the image formation of the other C and M images (amounts of sub-scanning deviation dyc and dym, amounts of main scanning deviation dxc and dxm, amounts of skewing dsqc and dsqm, and amounts of deviation dLxc and dLxm in the main scanning line length) in the same manner as in the calculations relating to the amounts of deviation in the image formation of the abovementioned Y image (Acc, Acm) The MPU 41 also calculates the amounts of deviation in the image formation of the Bk image (amount of main scanning deviation dxk, amount of skewing dsqk, and amount of deviation dLxk in the main scanning line length) in substantially the same manner as in the calculations relating to the amounts of deviation in the image formation of the Y image; however, in this digital color copier (1), since the color adjustment in the sub-scanning direction y uses Bk as a reference, the amount of positional deviation dyk in the sub-scanning direction is not calculated for Bk (Ack).

In the adjustment (DAD) shown in FIG. 8B, the MPU 41 adjusts the amounts of deviation in image formation for the respective colors as follows. In concrete terms, the MPU 41 performs the Y deviation amount adjustment (Ady) as follows:

In the adjustment of the sub-scanning deviation amount dyy, the MPU 41 sets the starting timing of the image exposure used for Y toner image formation (latent image formation by the exposure performed by the exposure unit 5) so that this timing is shifted by an amount corresponding to the above-mentioned calculated deviation amount dyy from the reference timing (y direction).

In the adjustment of the main scanning deviation amount dxy, the MPU 41 sets the feed-out timing (x direction) of the line head image data to the modulator of the exposure unit 5 for the line synchronizing signal (that expresses the line head) of the image exposure used for Y toner image formation (latent image formation by the exposure performed by the exposure unit 5) so that this timing is shifted by an amount corresponding to the above-mentioned calculated deviation amount dxy from the reference timing.

In the write unit 5, the rear side r of the mirror extending in the x direction that faces the photosensitive drum 6*b* and reflects the laser beam modulated by the Y image data so that this laser beam is projected onto the photosensitive drum 6*b* is supported by a supporting point, and the front side f of this mirror is supported by a block that can move in the y direction. The MPU 41 can adjust the skewing dSqy by driving the abovementioned block of the write unit 5 in a reciprocating motion in the y direction by means of a y driving mechanism comprising mainly a pulse motor and a screw; in the "adjustment of the skewing dSqy", the pulse motor of the abovementioned y driving mechanism is driven so that the above-mentioned block is driven by an amount corresponding to the abovementioned calculated skewing dSqy from the reference y position.

In the adjustment of the main scanning line length deviation amount dLxy, the MPU 41 sets the frequency of a pixel synchronizing clock that assigns image data to the main scanning lines on the photosensitive drum in pixel units at reference frequency×Ls/(Ls+dLxy). Ls is the reference line length. The MPU 41 performs adjustments of the amounts of deviation in image formation for C and M (Adc, Adm) in the same manner as the above-mentioned adjustment of the amount of deviation in image formation for Y. The MPU 41 also performs an adjustment of the amount of deviation in image formation for Bk in substantially in the same manner as the abovementioned adjustment of the amount of deviation in image formation for Y; however, in this digital color copier (1), since the color adjustment in the sub-scanning direction y uses Bk as a reference, the MPU 41 does not perform an adjustment of the of the amount of positional deviation dyk in the sub-scanning direction for Bk (Adk). Then, color image formation is performed under conditions that have been adjusted in this manner until the next "color adjustment".

Next, one embodiment of the present invention will be described.

In this embodiment, in each mark set in the abovementioned digital color copier (1), the first orthogonal mark Akr for Bk and the second orthogonal mark Ayr for Y on the r side are disposed in reverse, the first oblique mark Bkr for Bk and the second oblique mark Byr for Y are disposed in reverse, the first orthogonal mark Akf for Bk and the second orthogonal mark Ayf for Y on the f side are disposed in reverse, and the first oblique mark Bkf for Bk and the second oblique mark Byf for Y are disposed in reverse.

Figure 17:
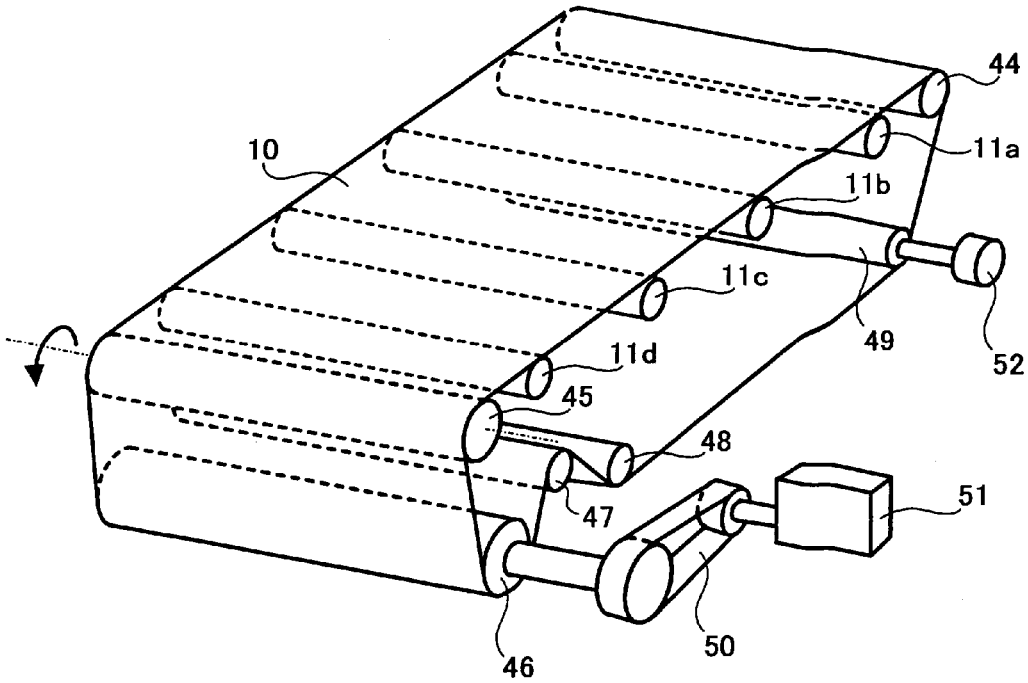
FIG. 17 is a perspective view which shows the area in the vicinity of the transfer belt of one embodiment of the present invention.
Figure 19:
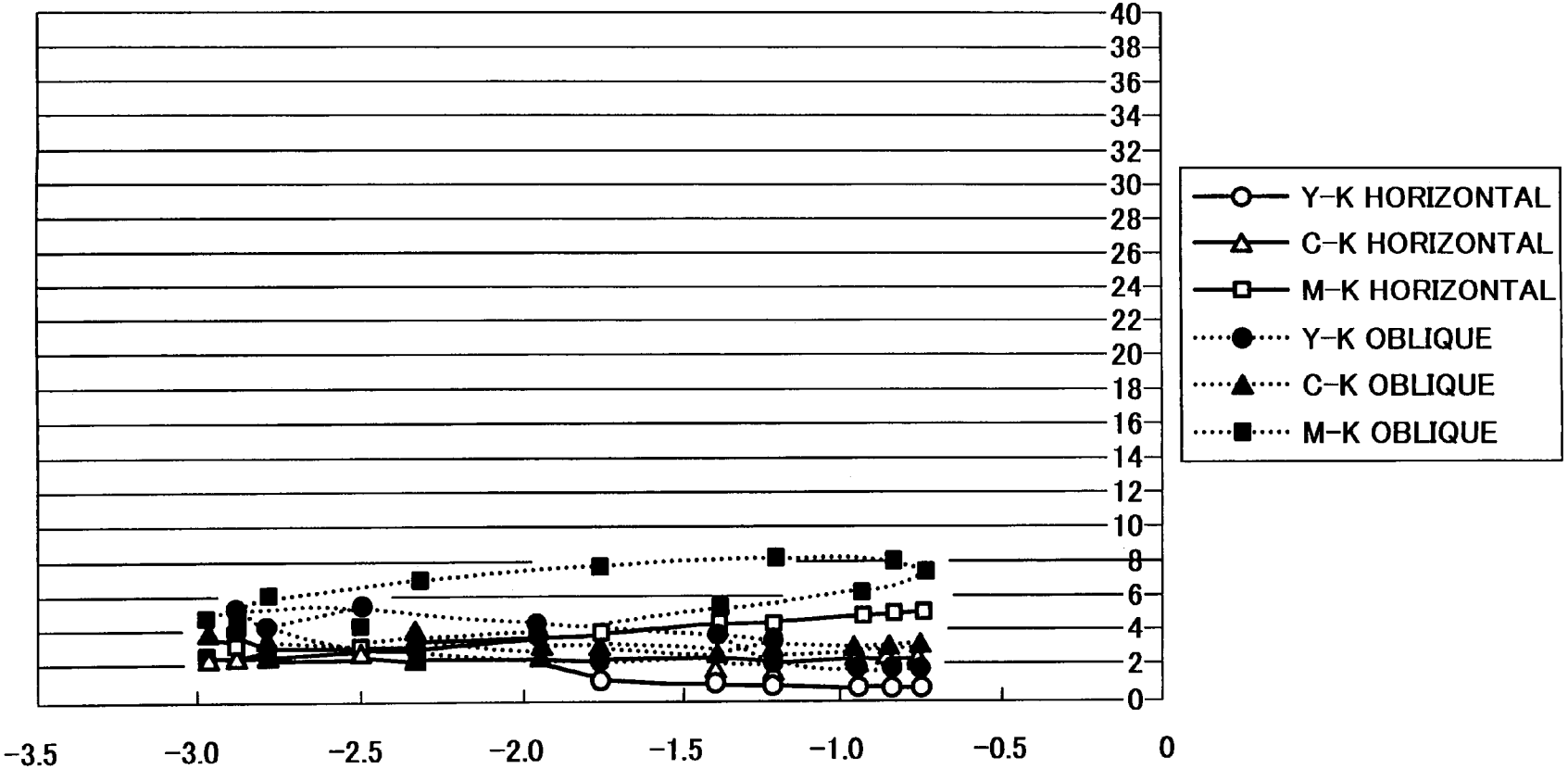
FIG. 19 is a diagram which shows some of the second calculation results used to determine the dispositions of the marks in the same embodiment.
Figure 20:
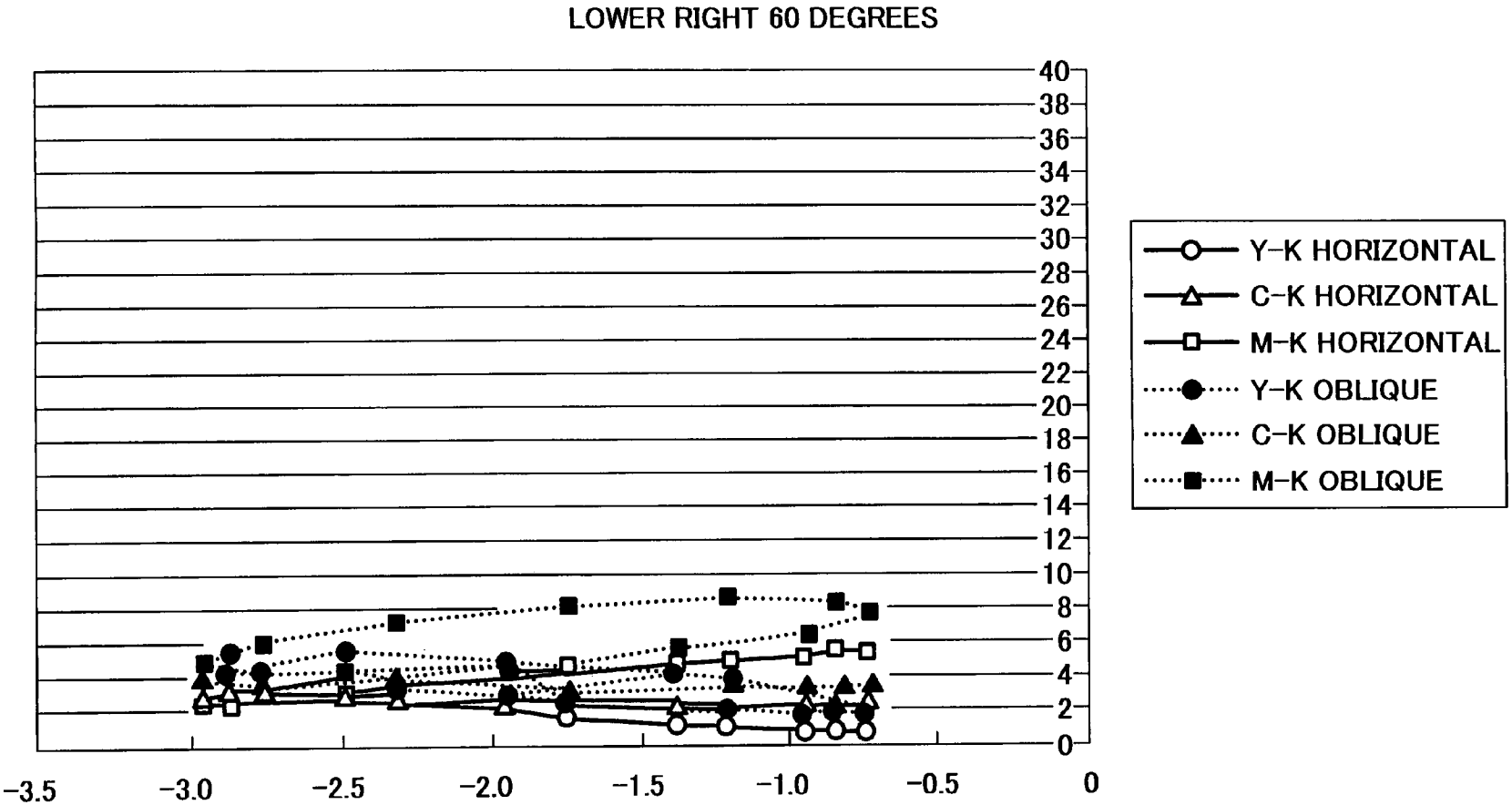
FIGS. 20 through 54 are diagrams which show other portions of the calculation results.
Figure 21:
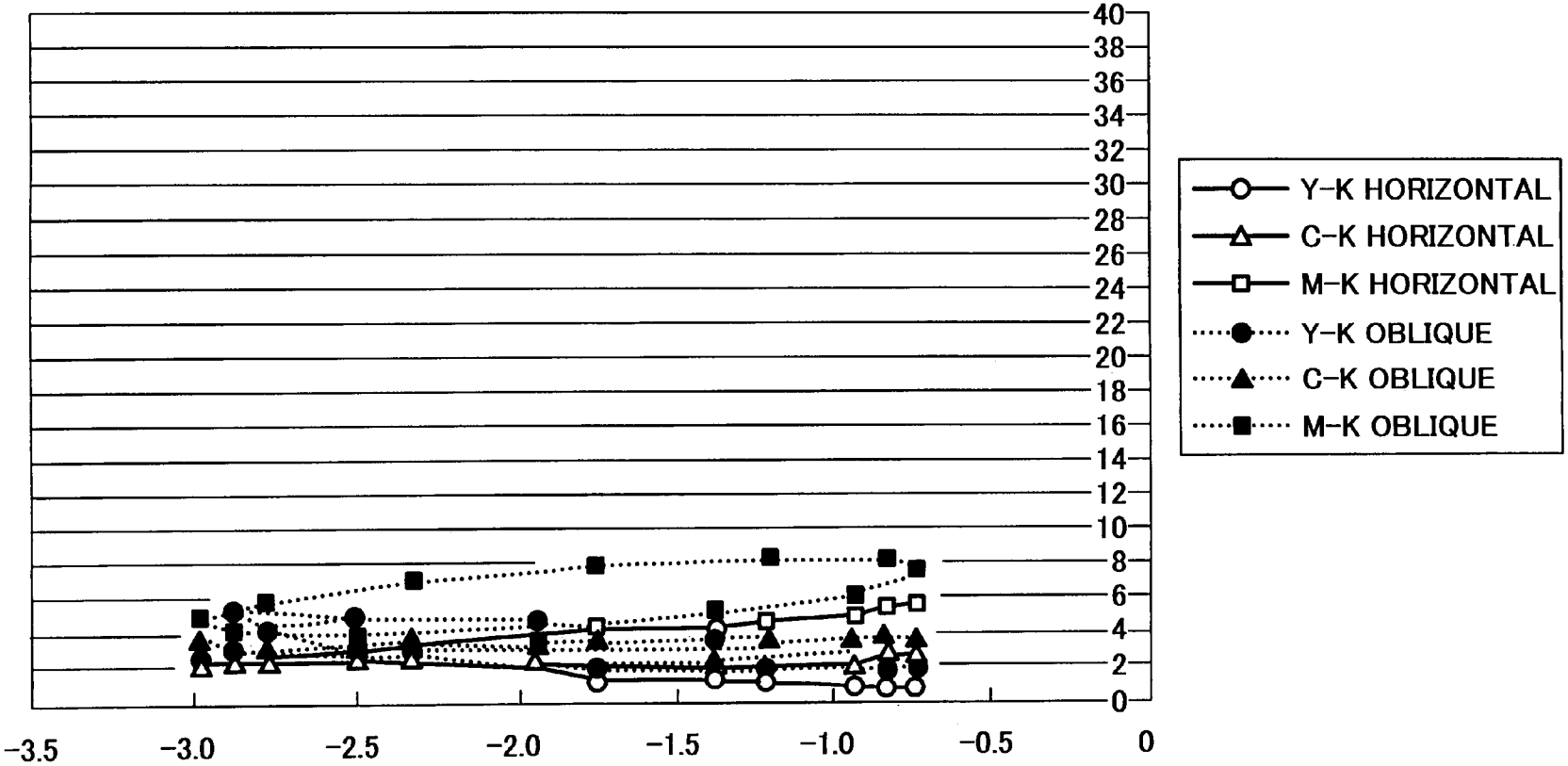
Figure 22:
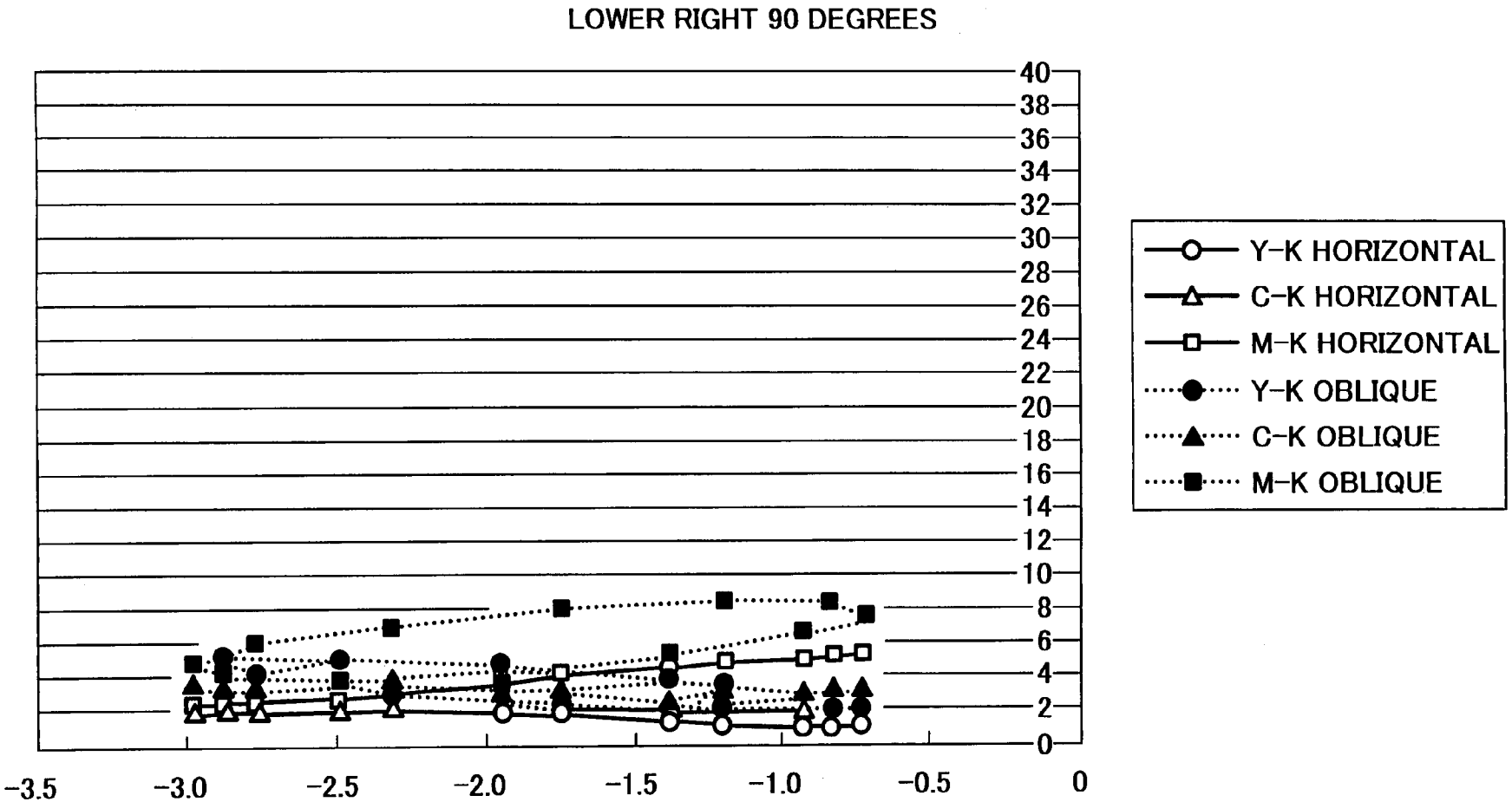
Figure 23:
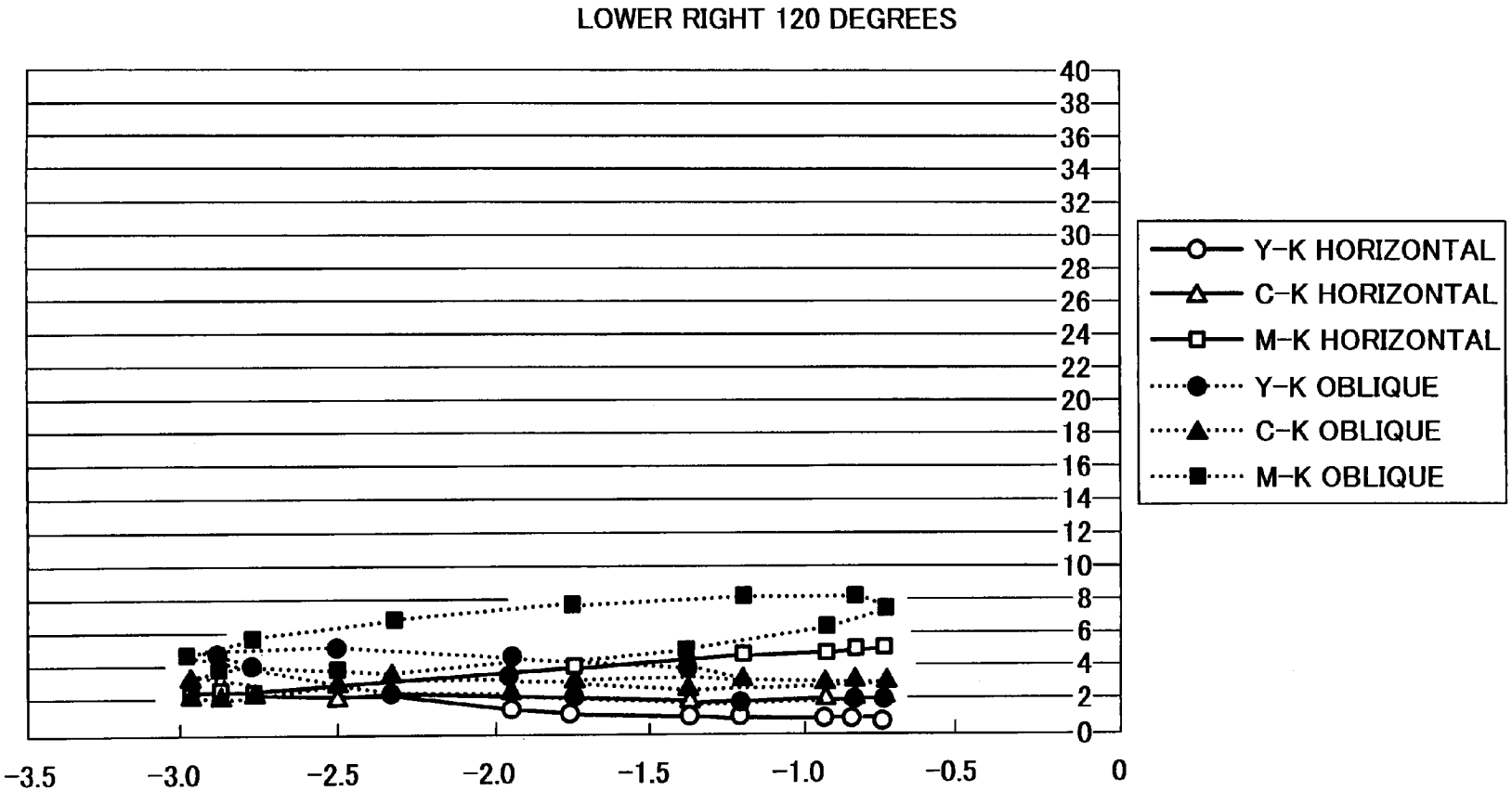
Figure 24:
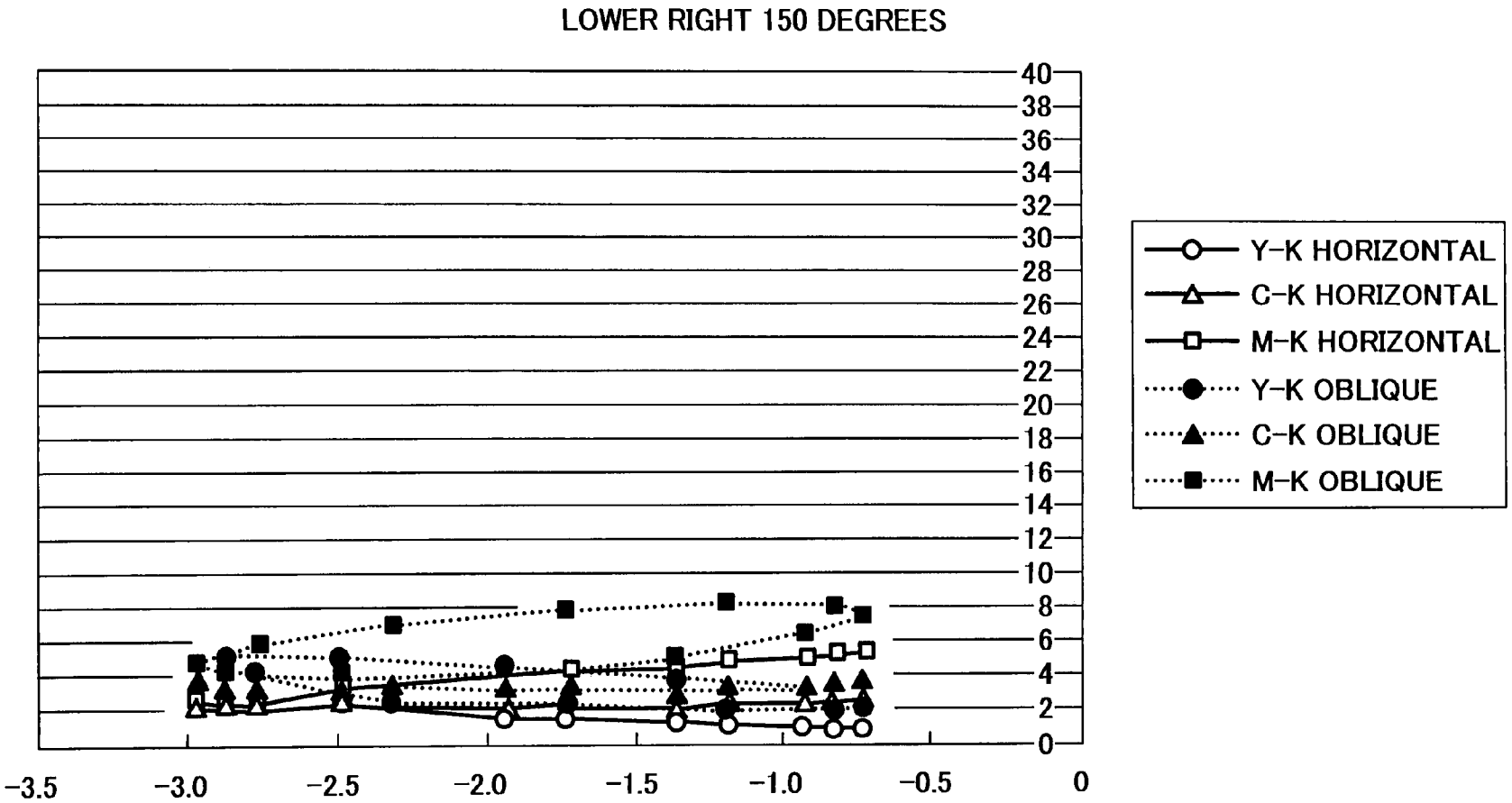
Figure 25:
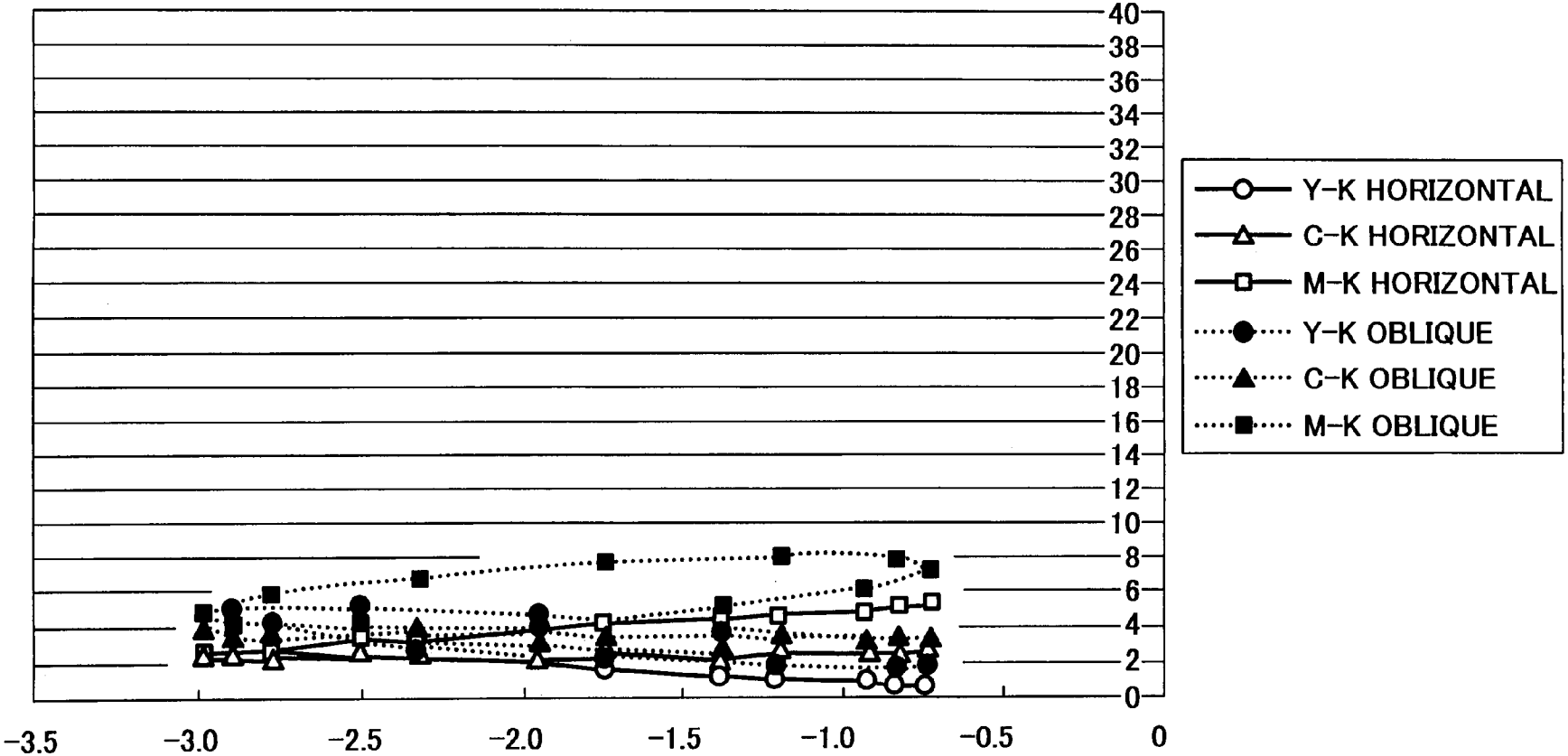
Figure 26:
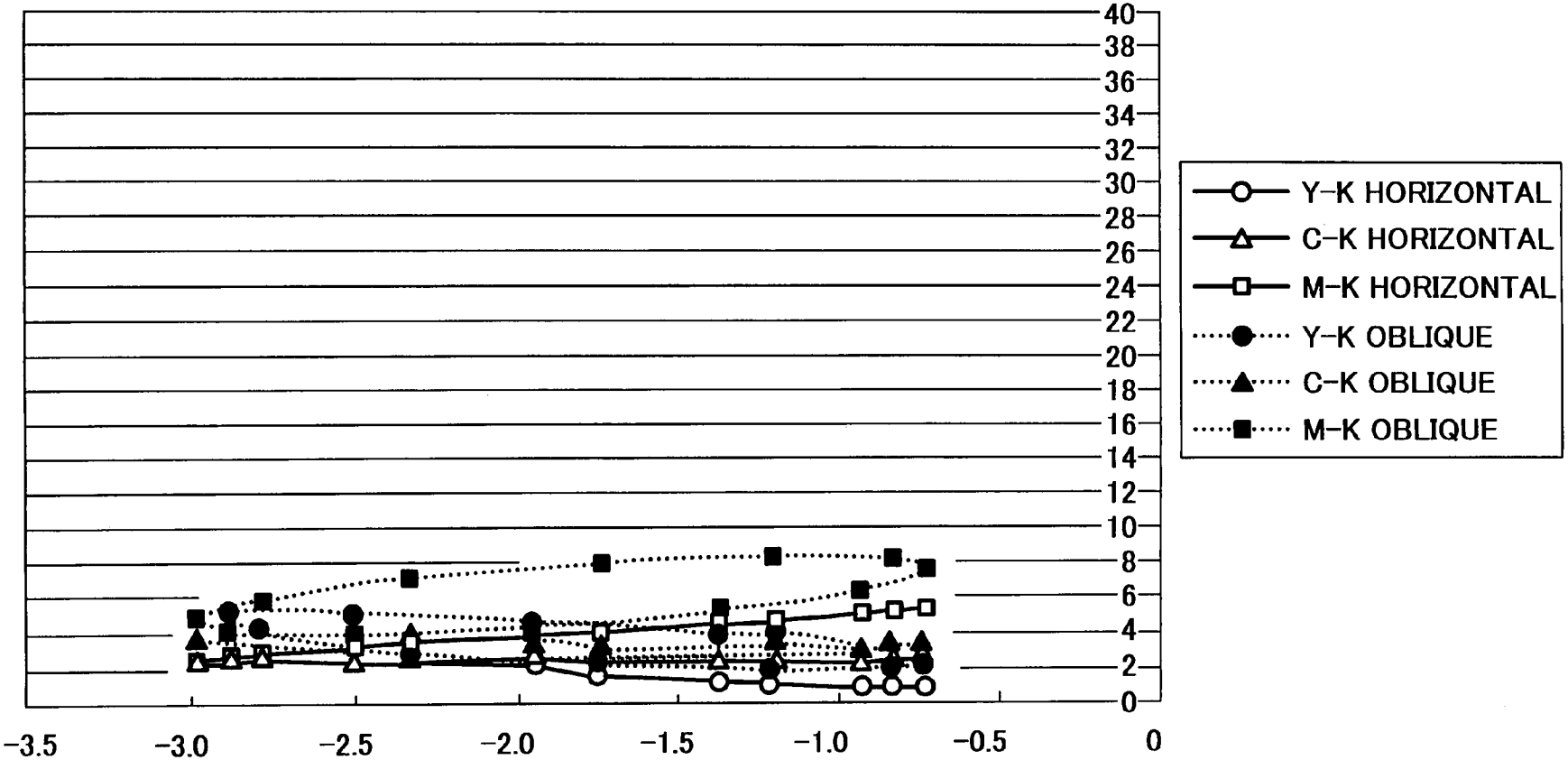
Figure 27:
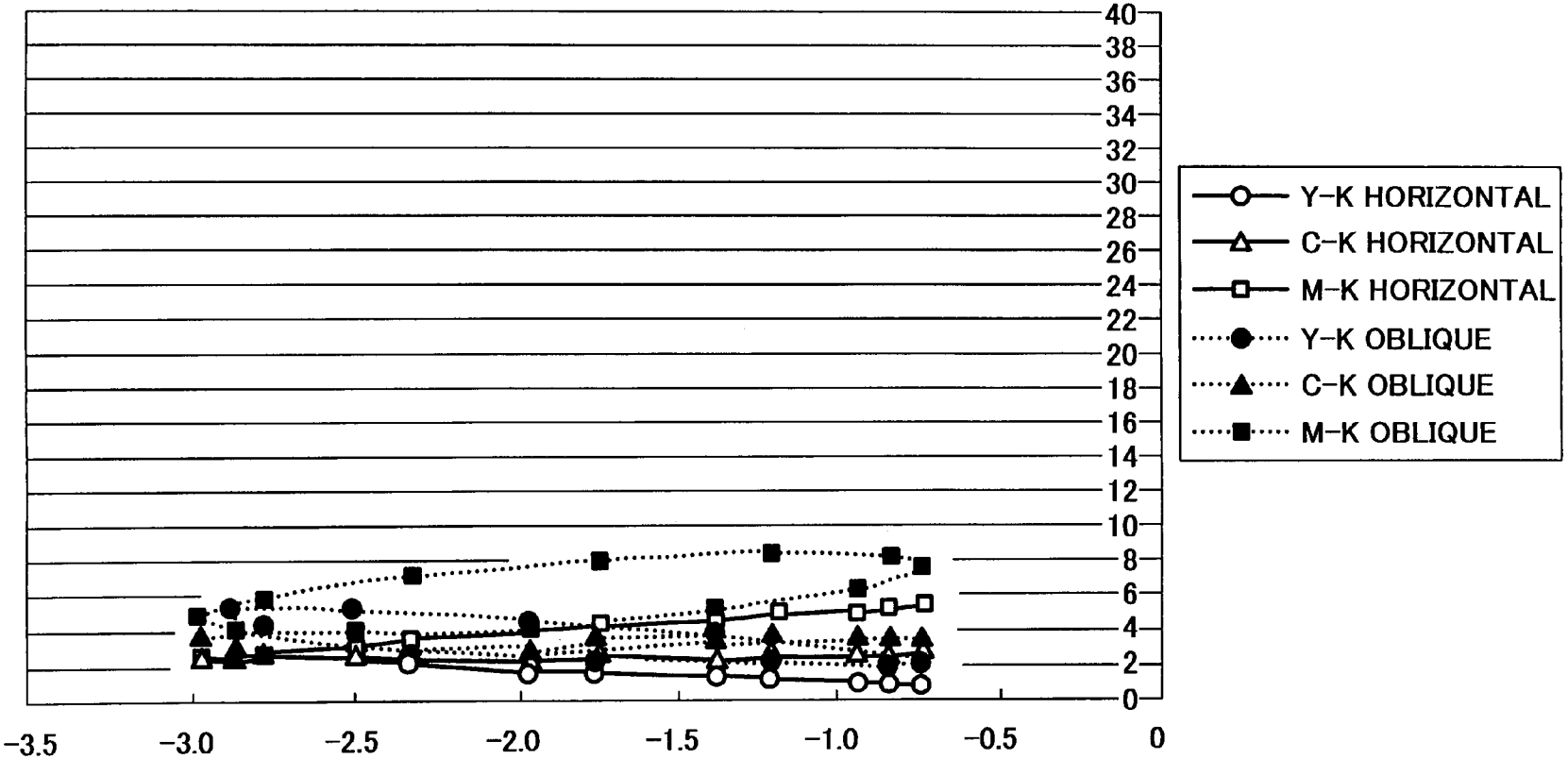
Figure 28:
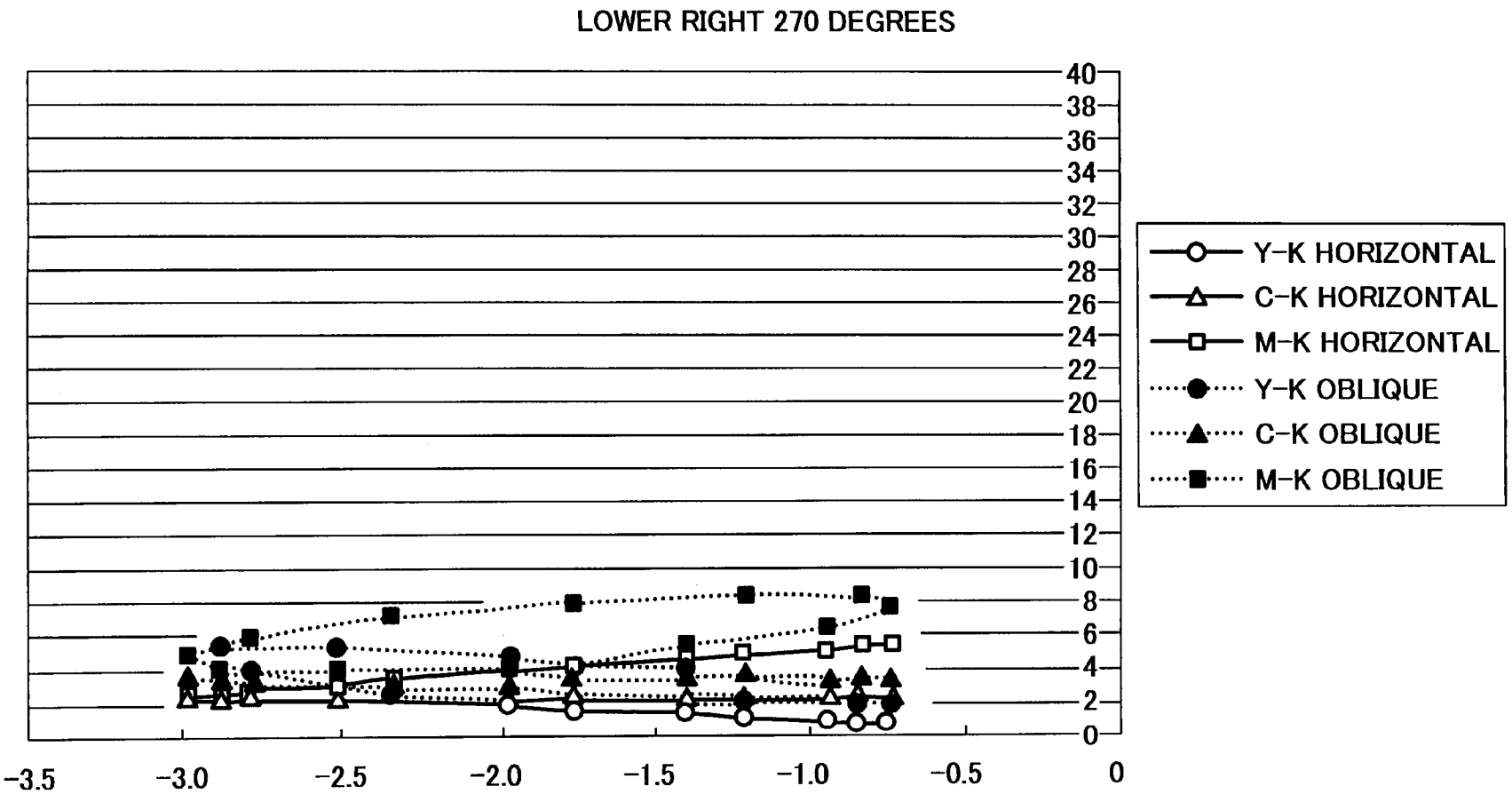
Figure 29:
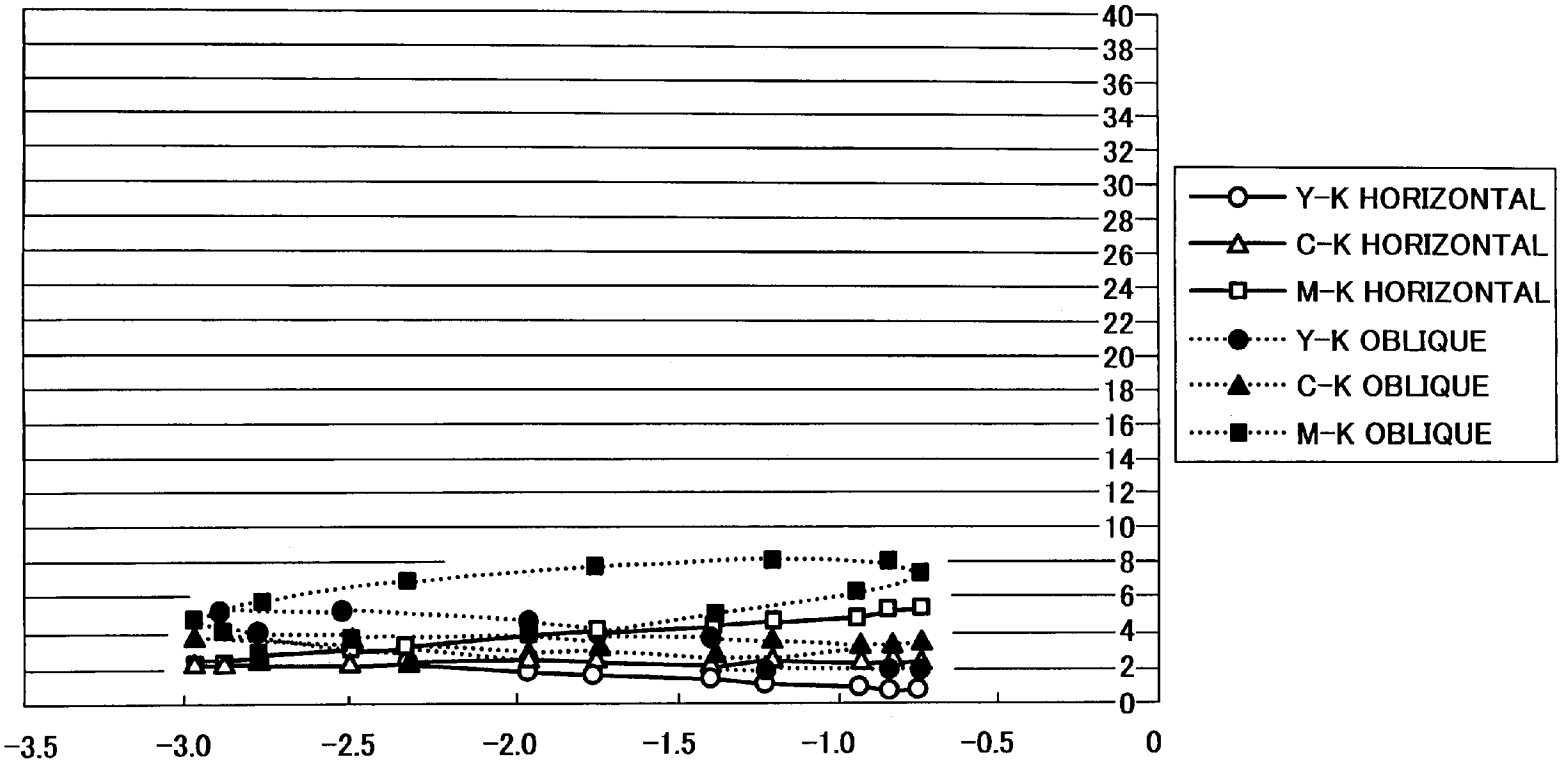
Figure 30:
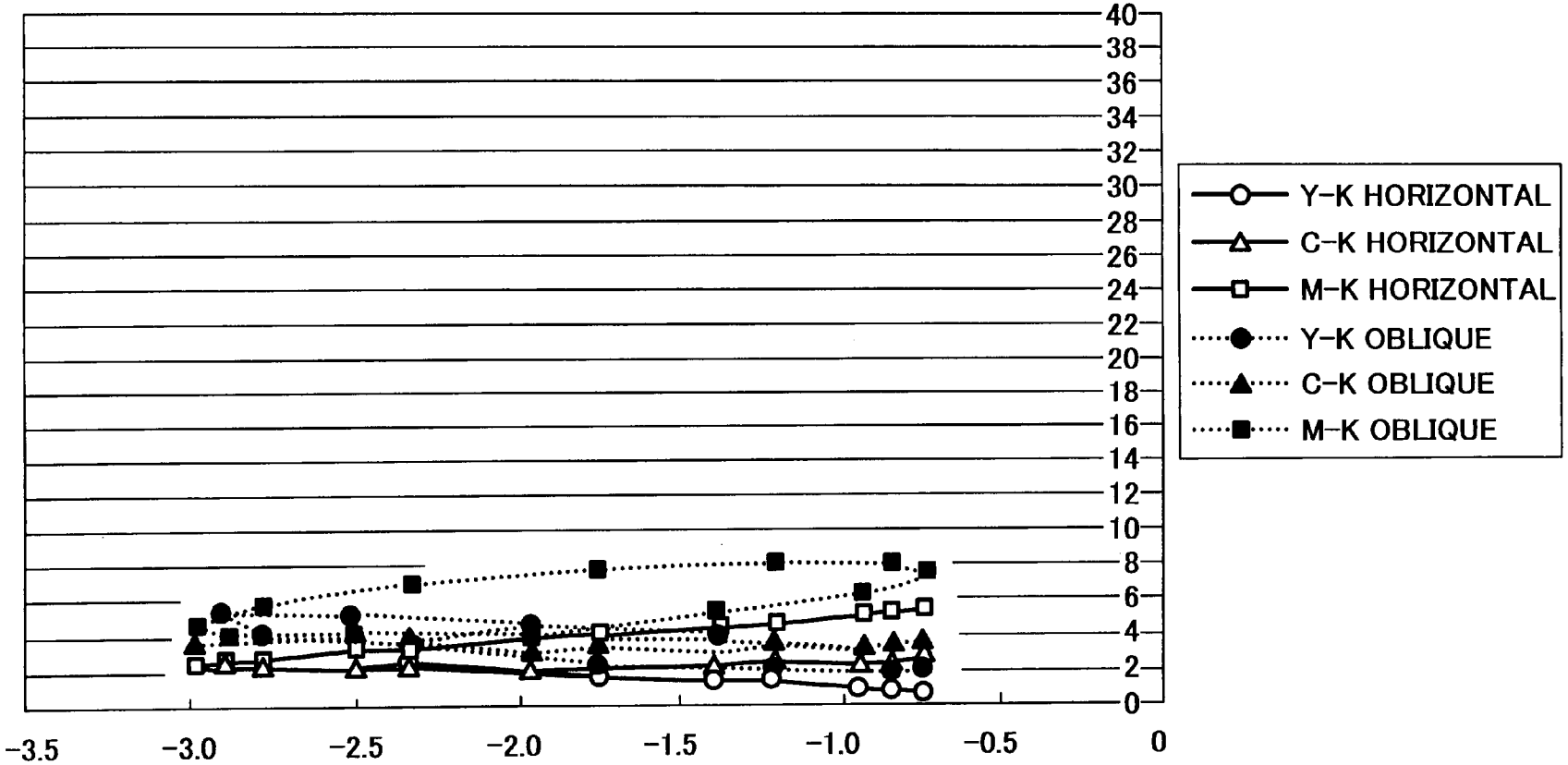
Figure 31:
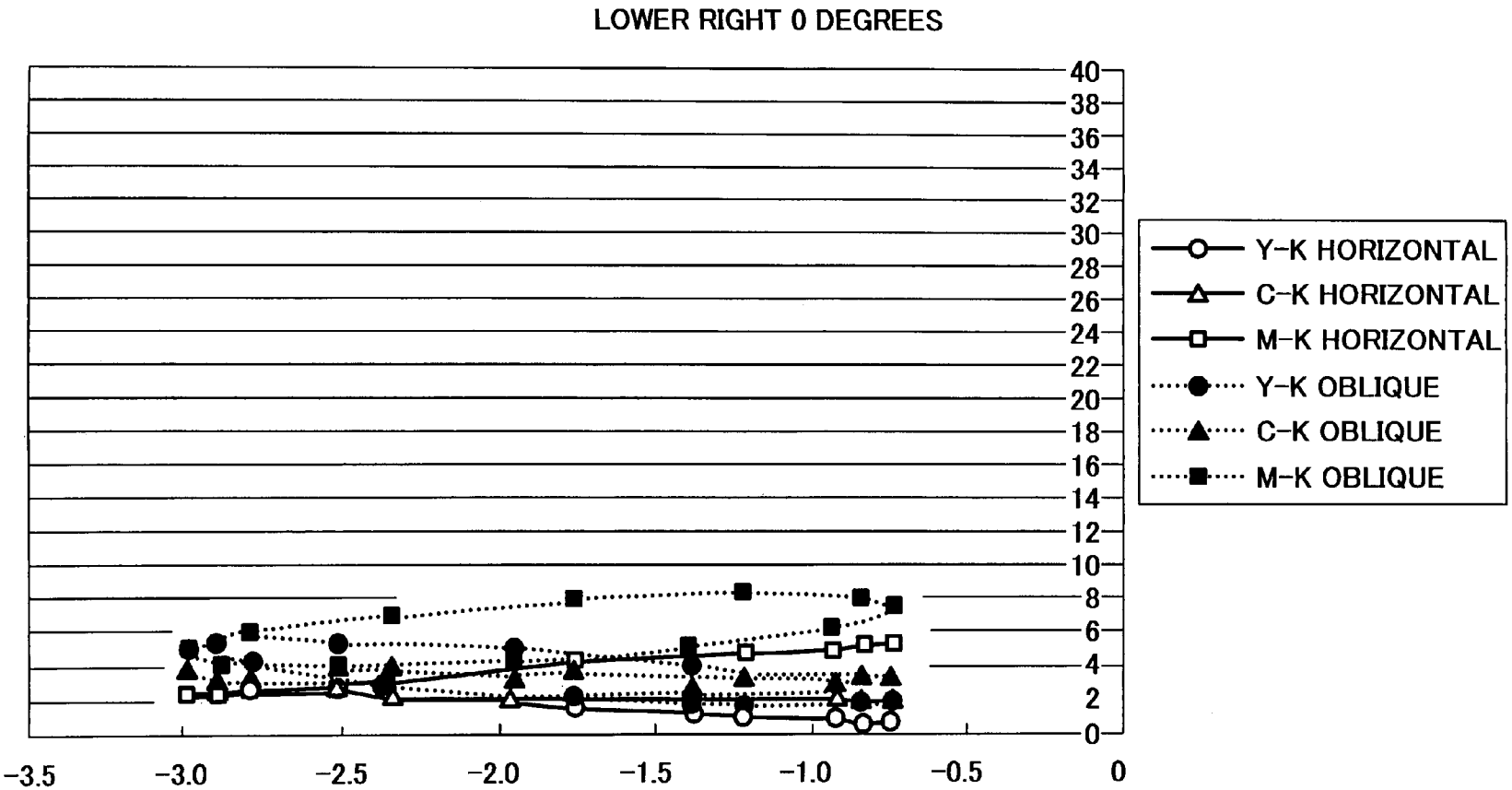
Figure 32:
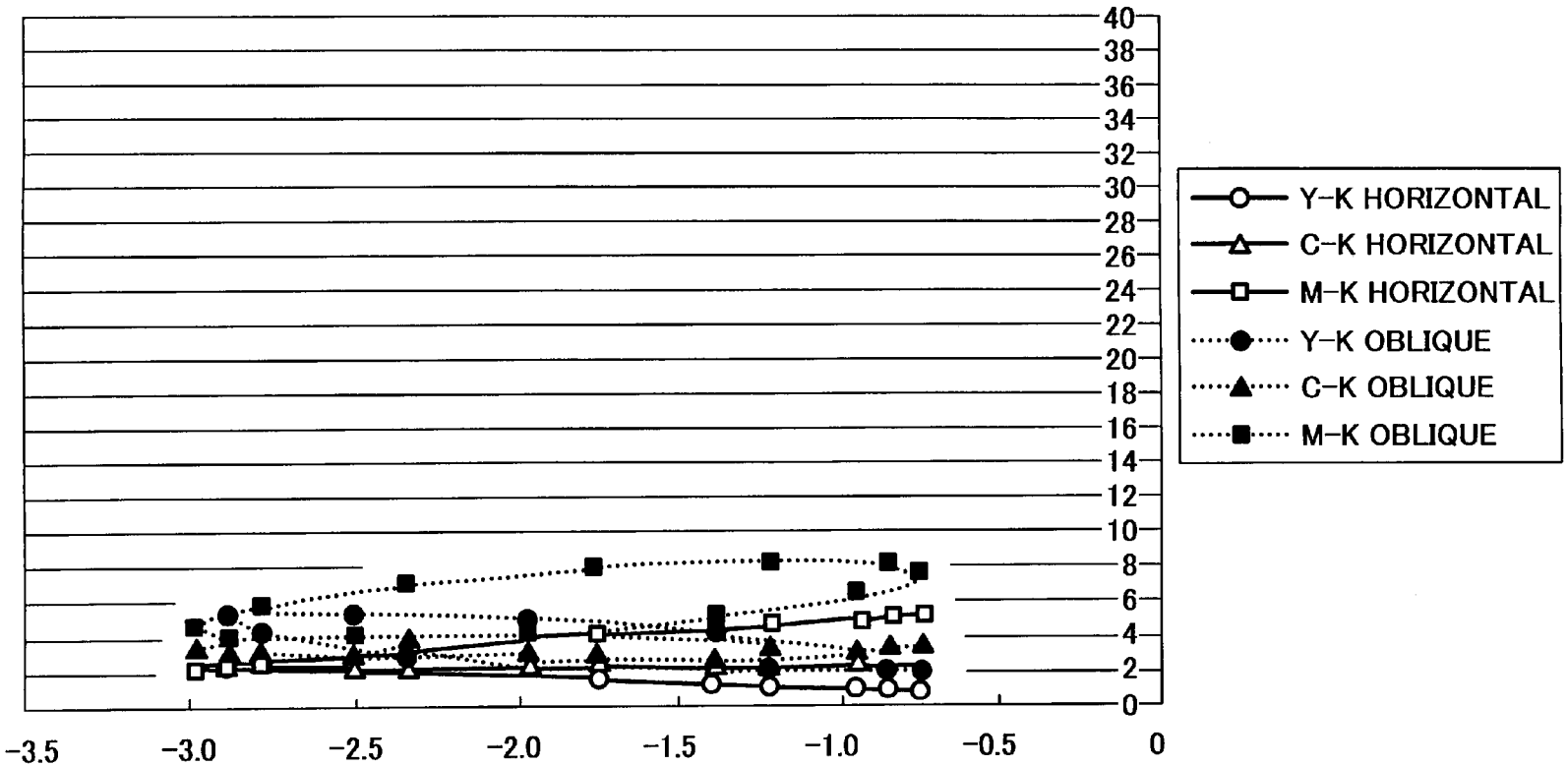
Figure 33:
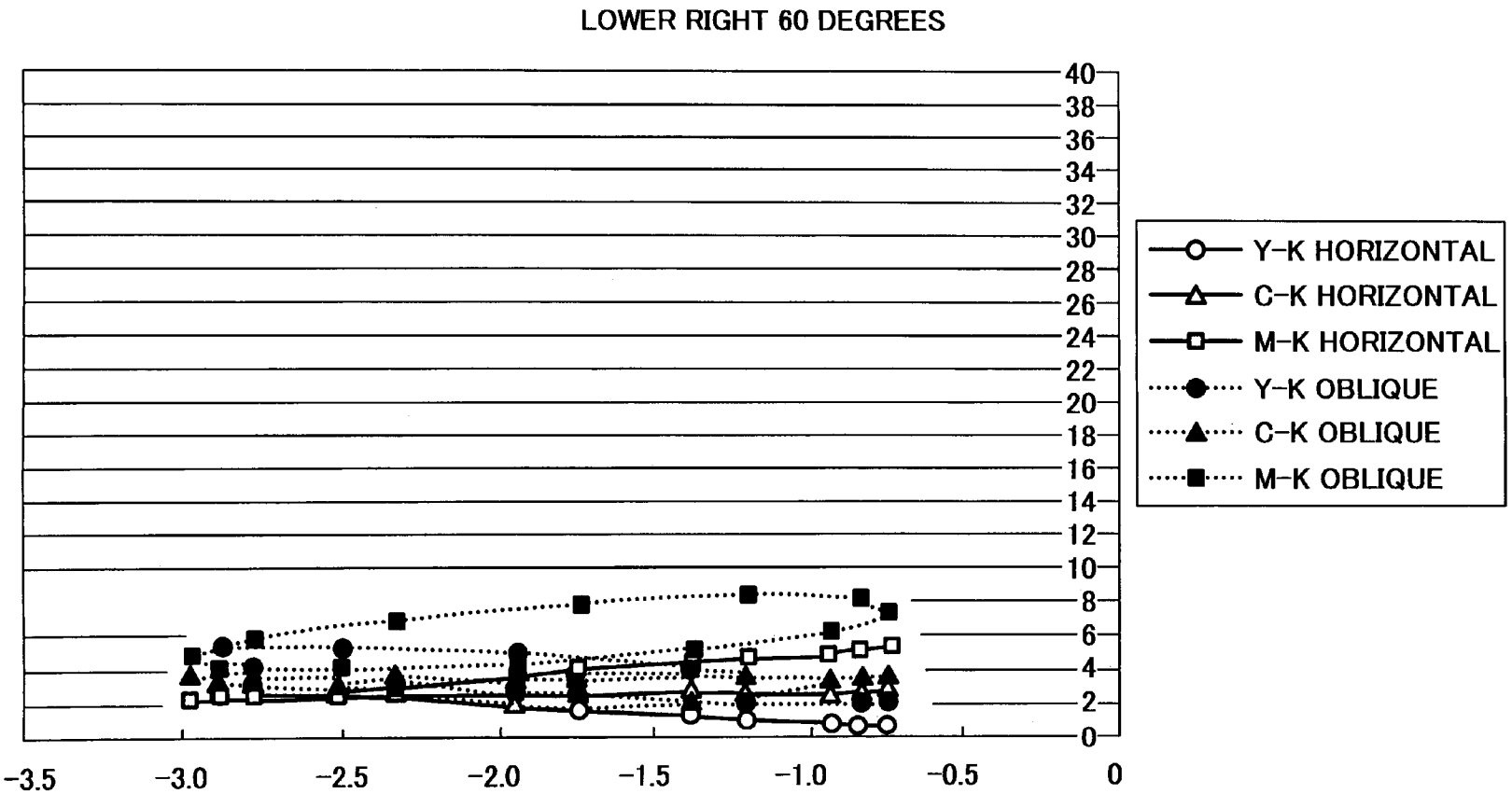
Figure 34:
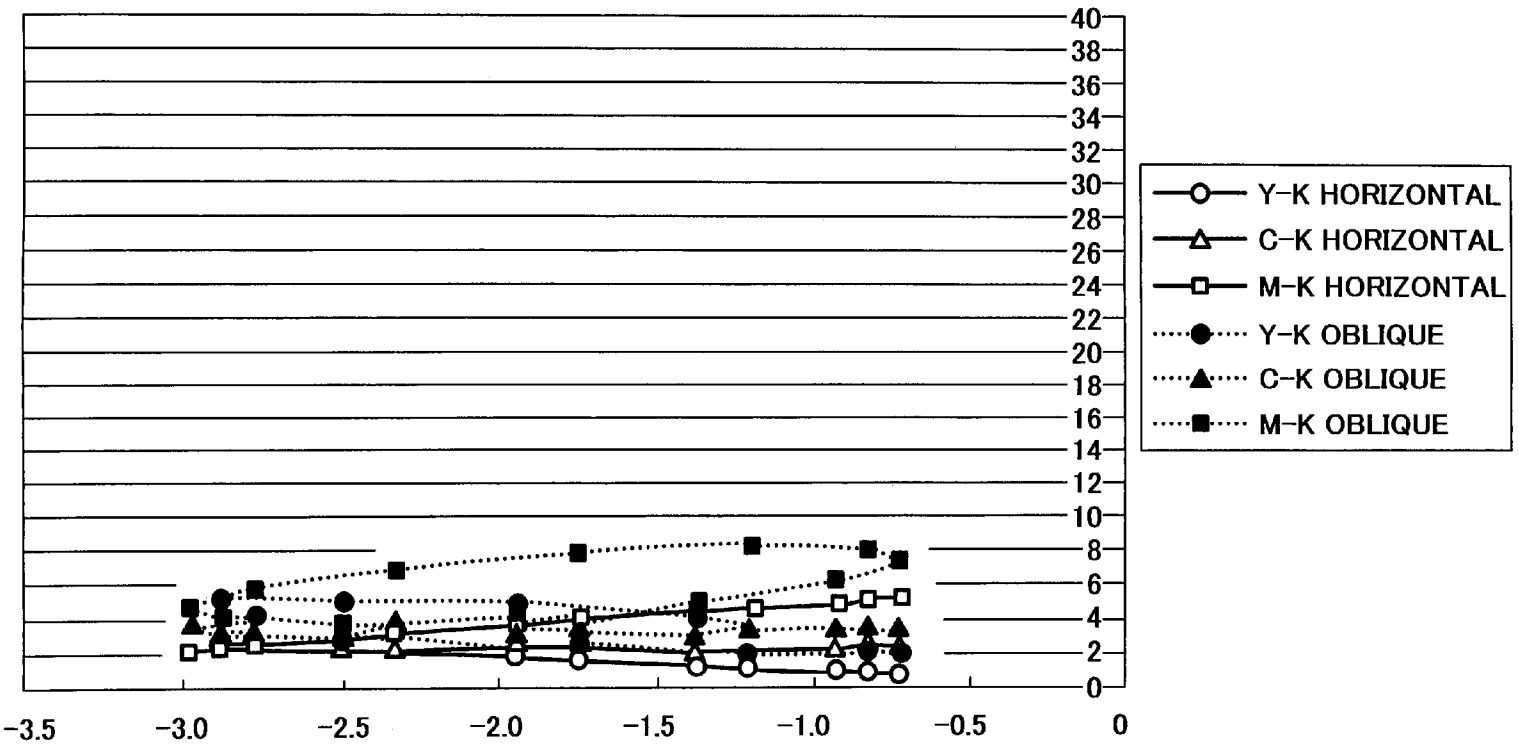
Figure 35:
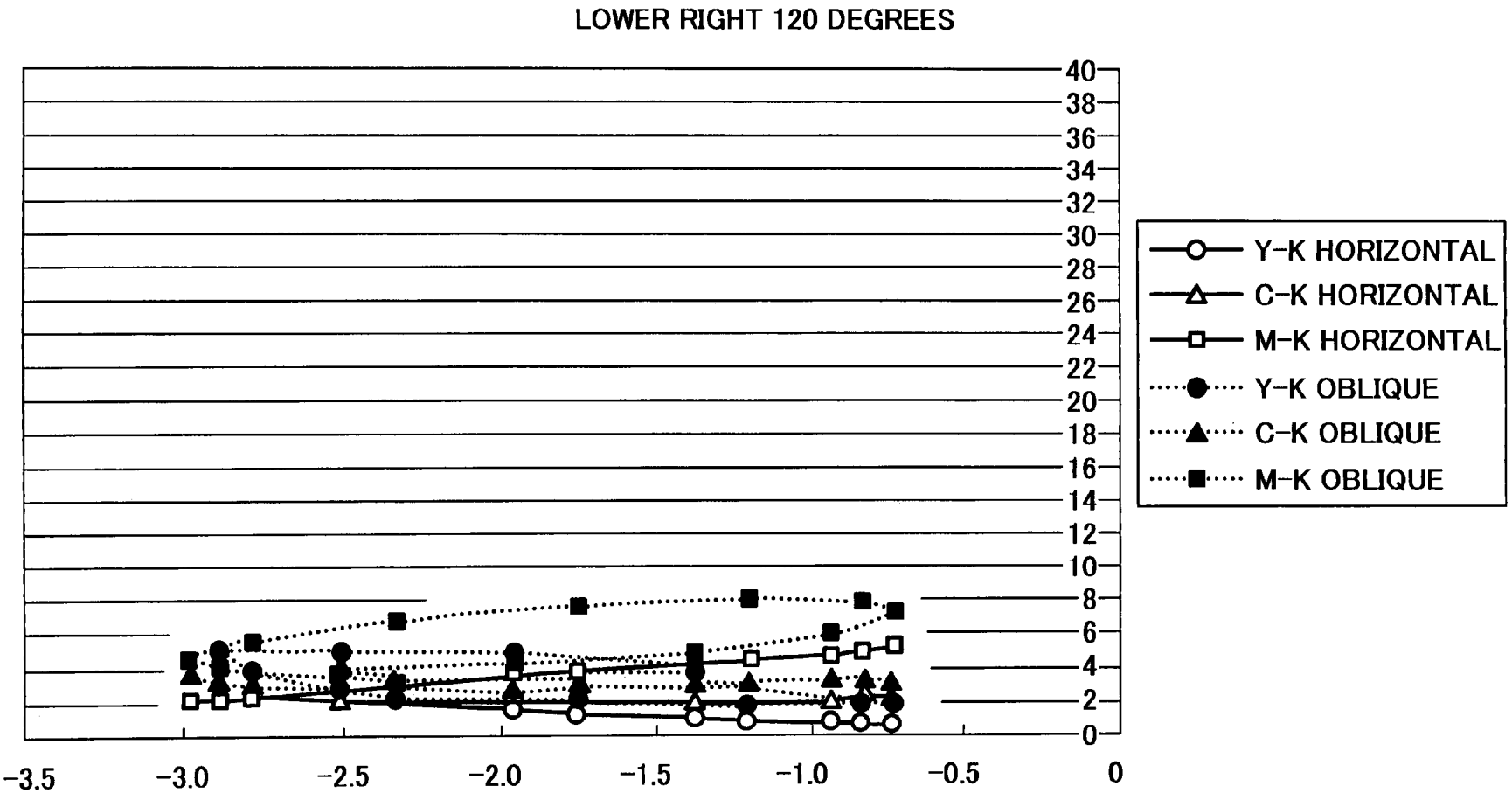
Figure 36:
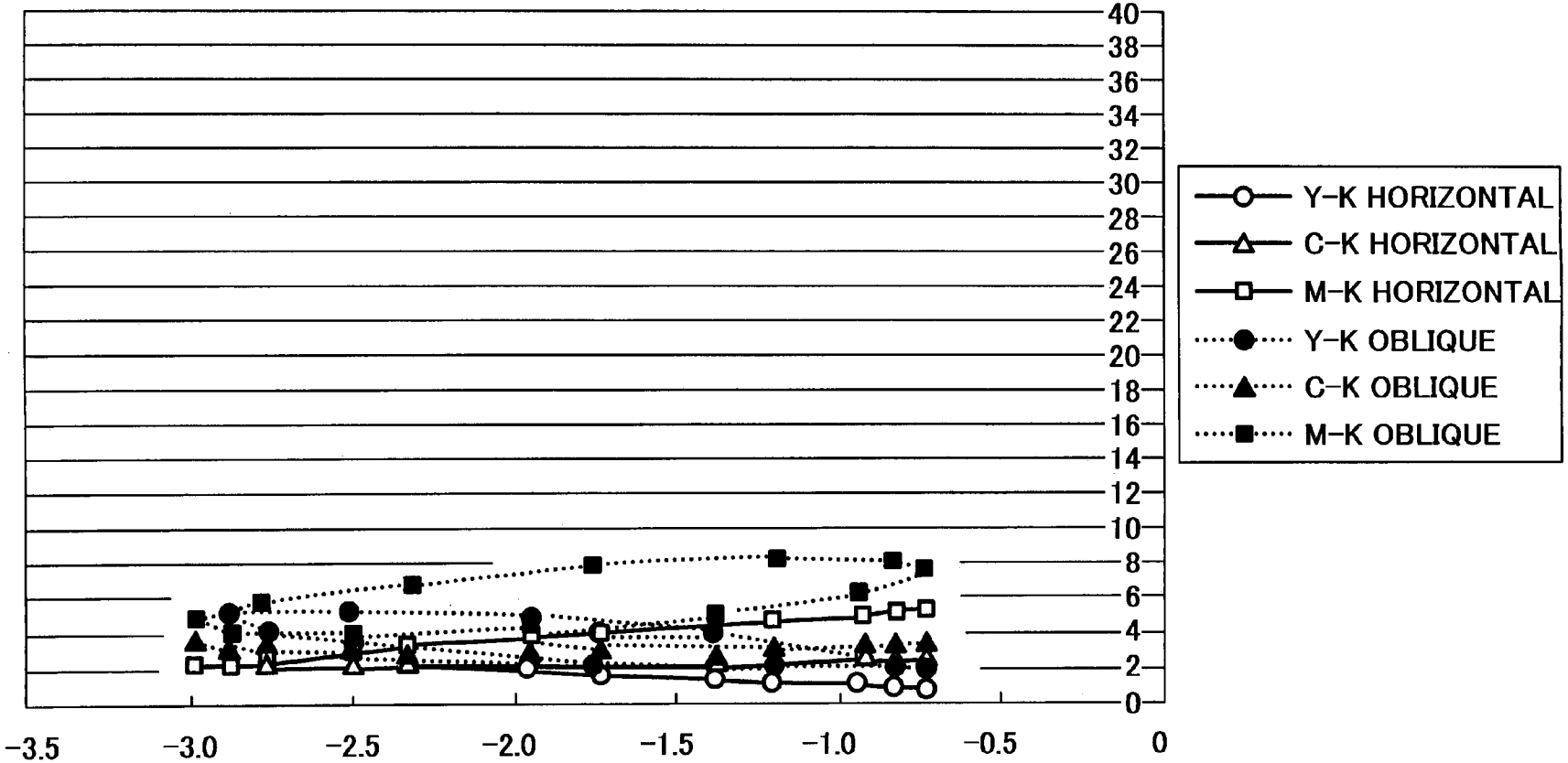
Figure 37:
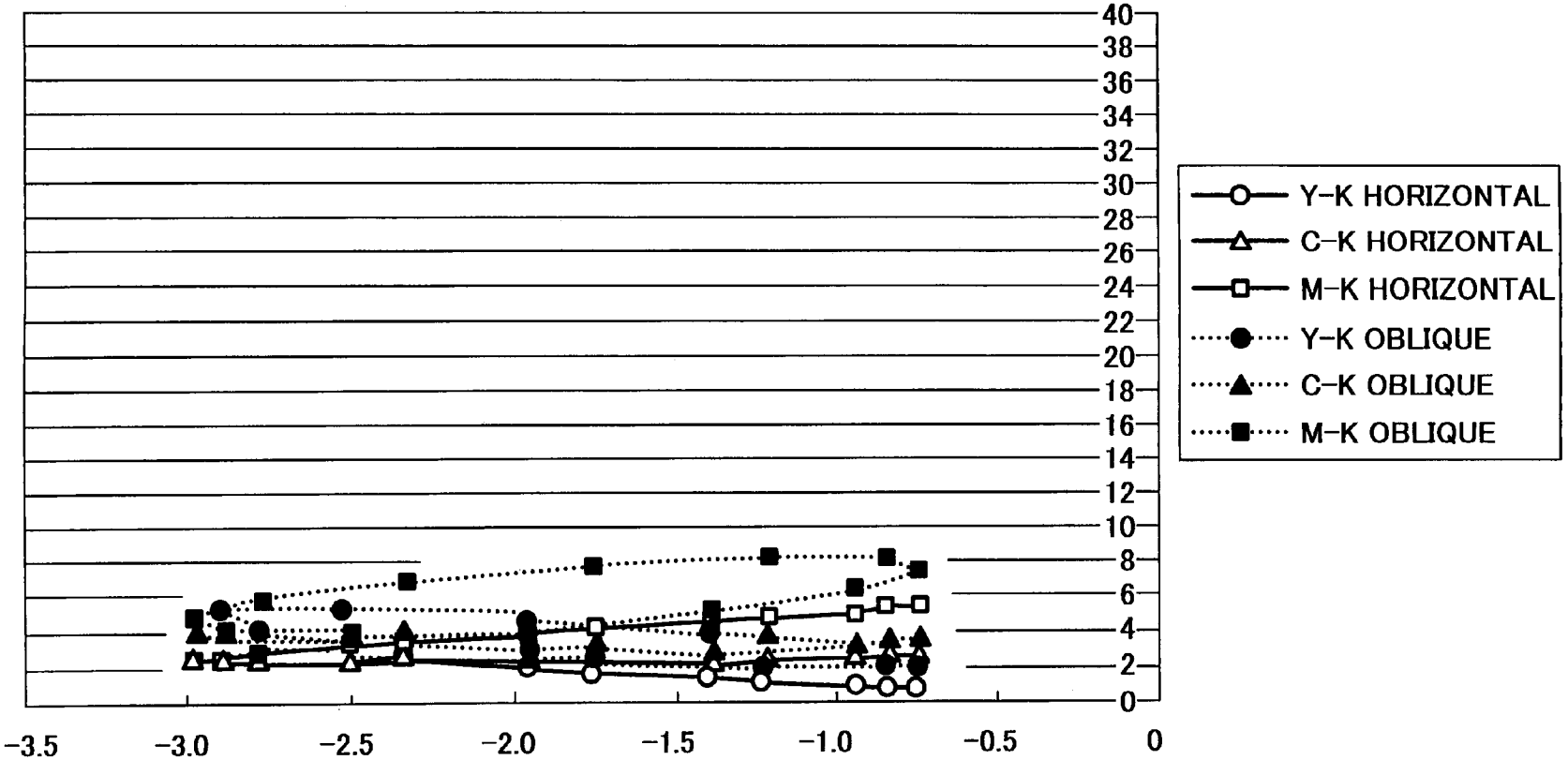
Figure 38:
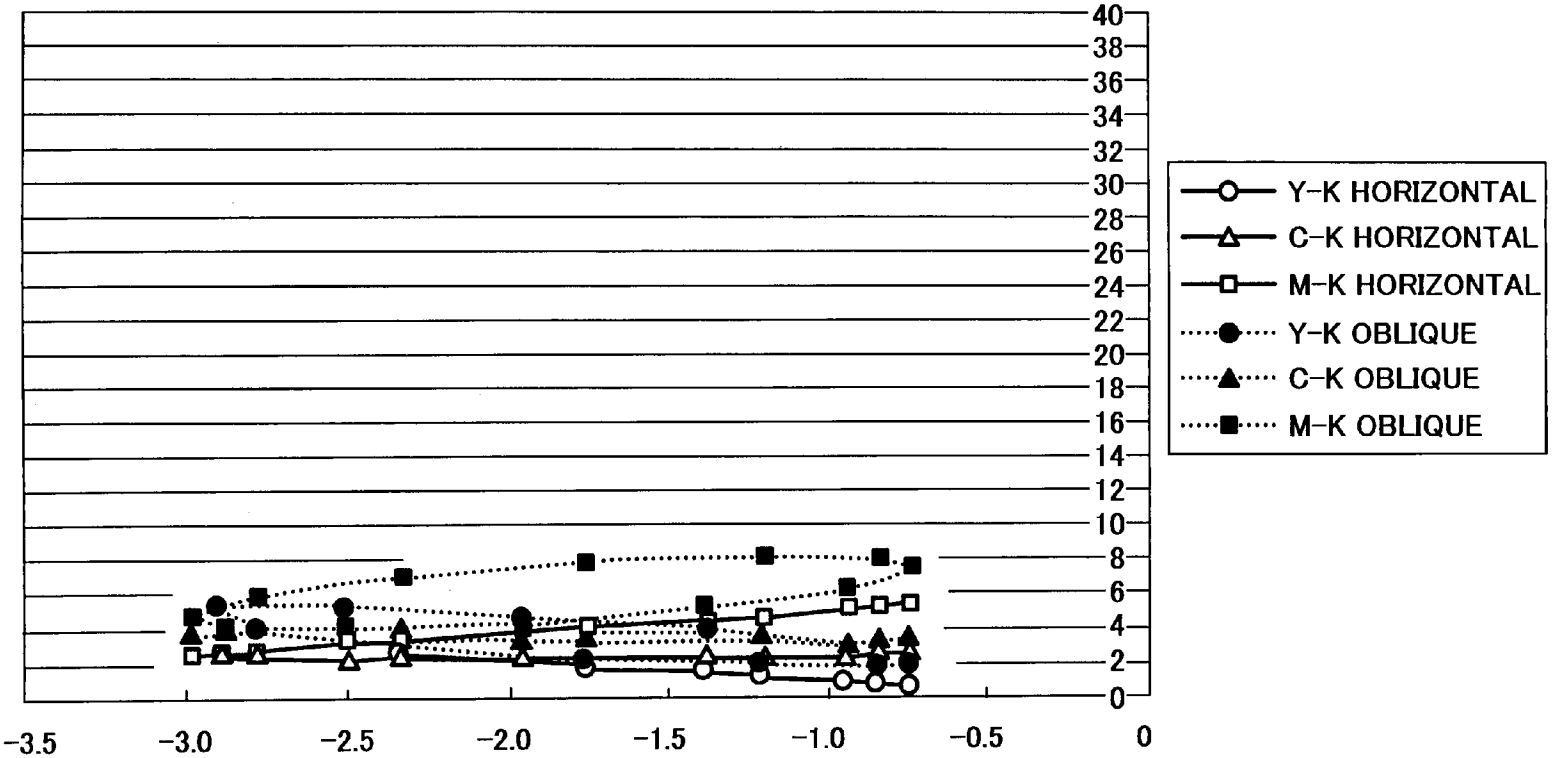
Figure 39:
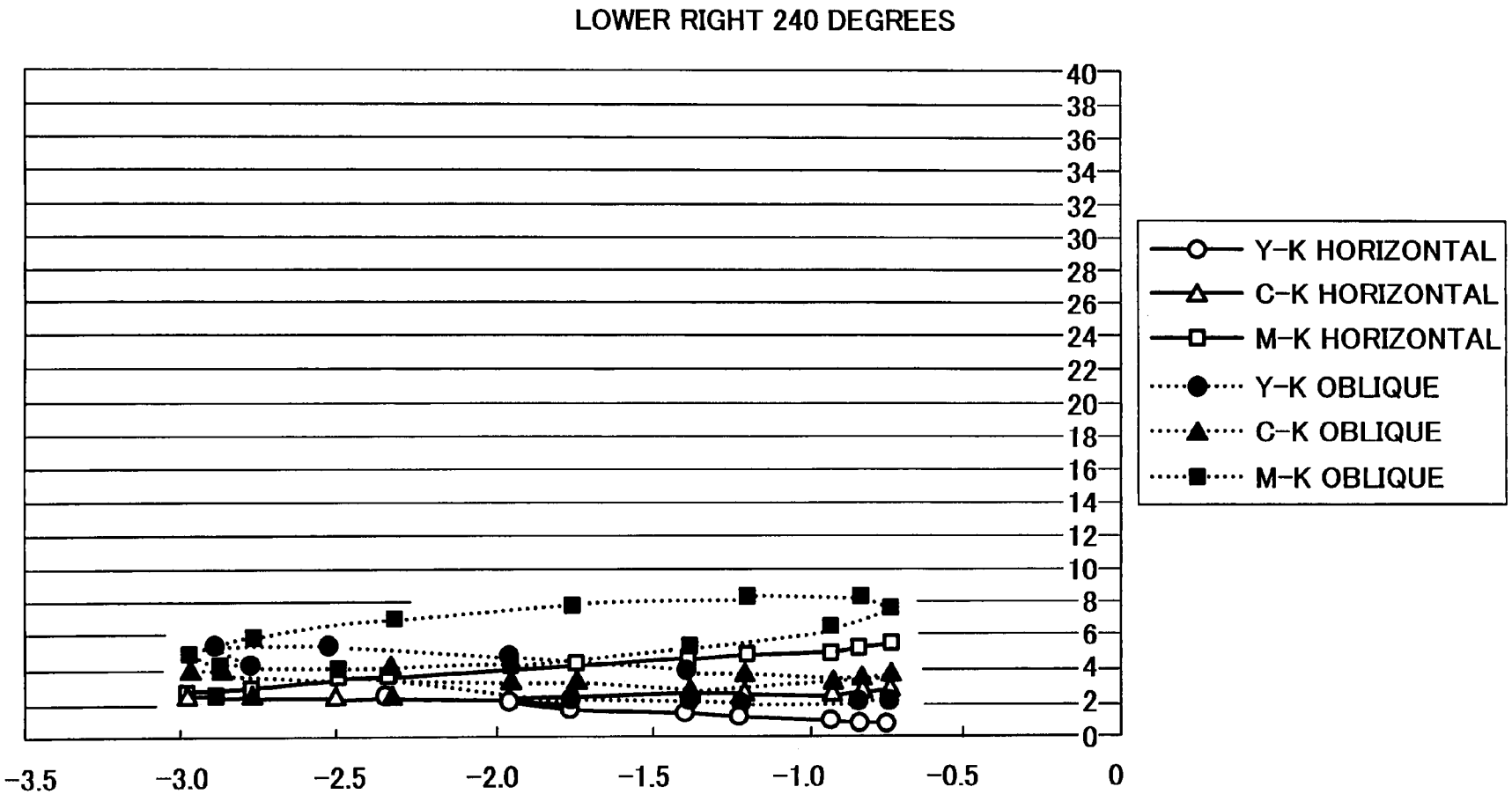
Figure 40:
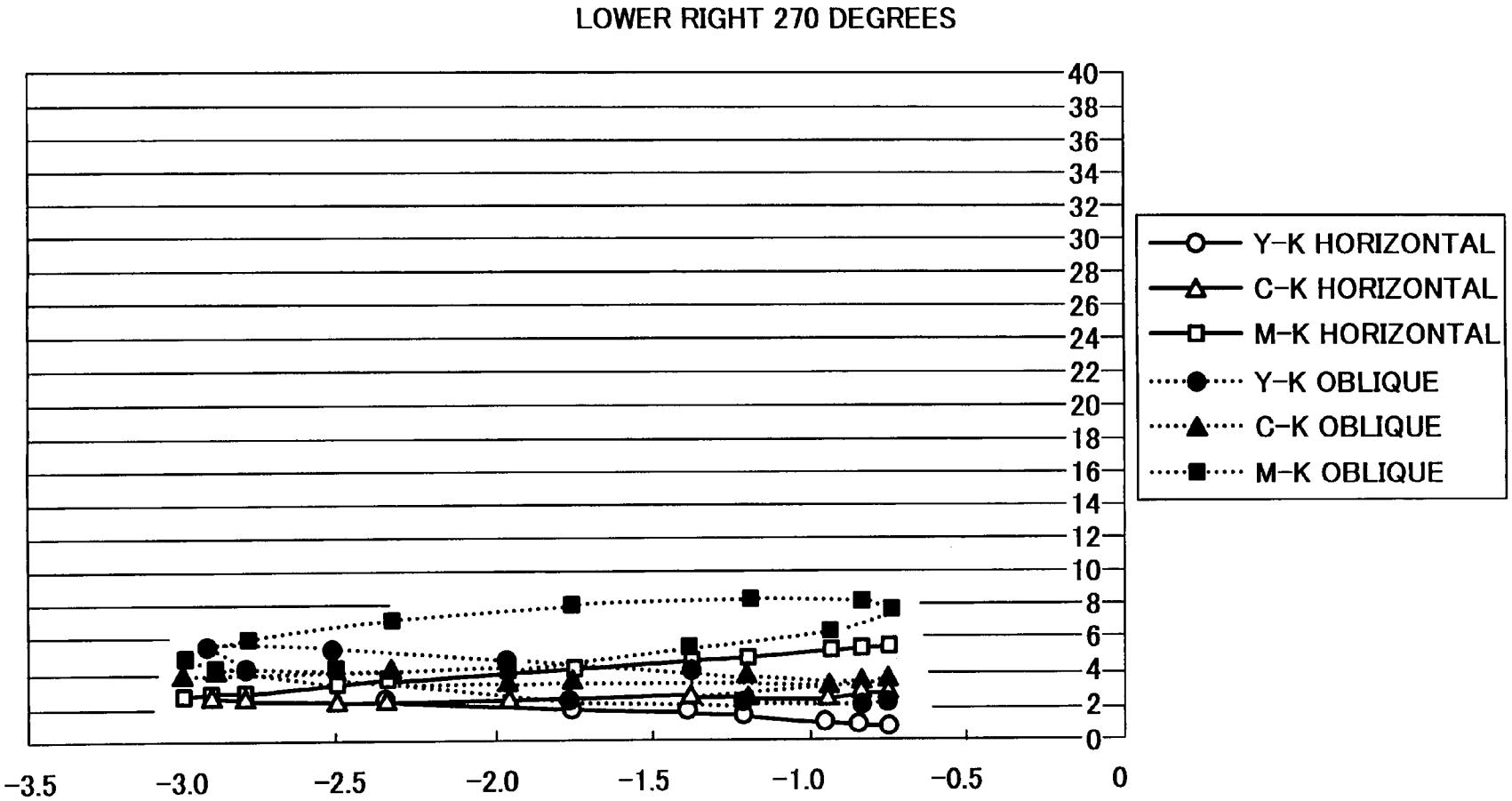
Figure 41:
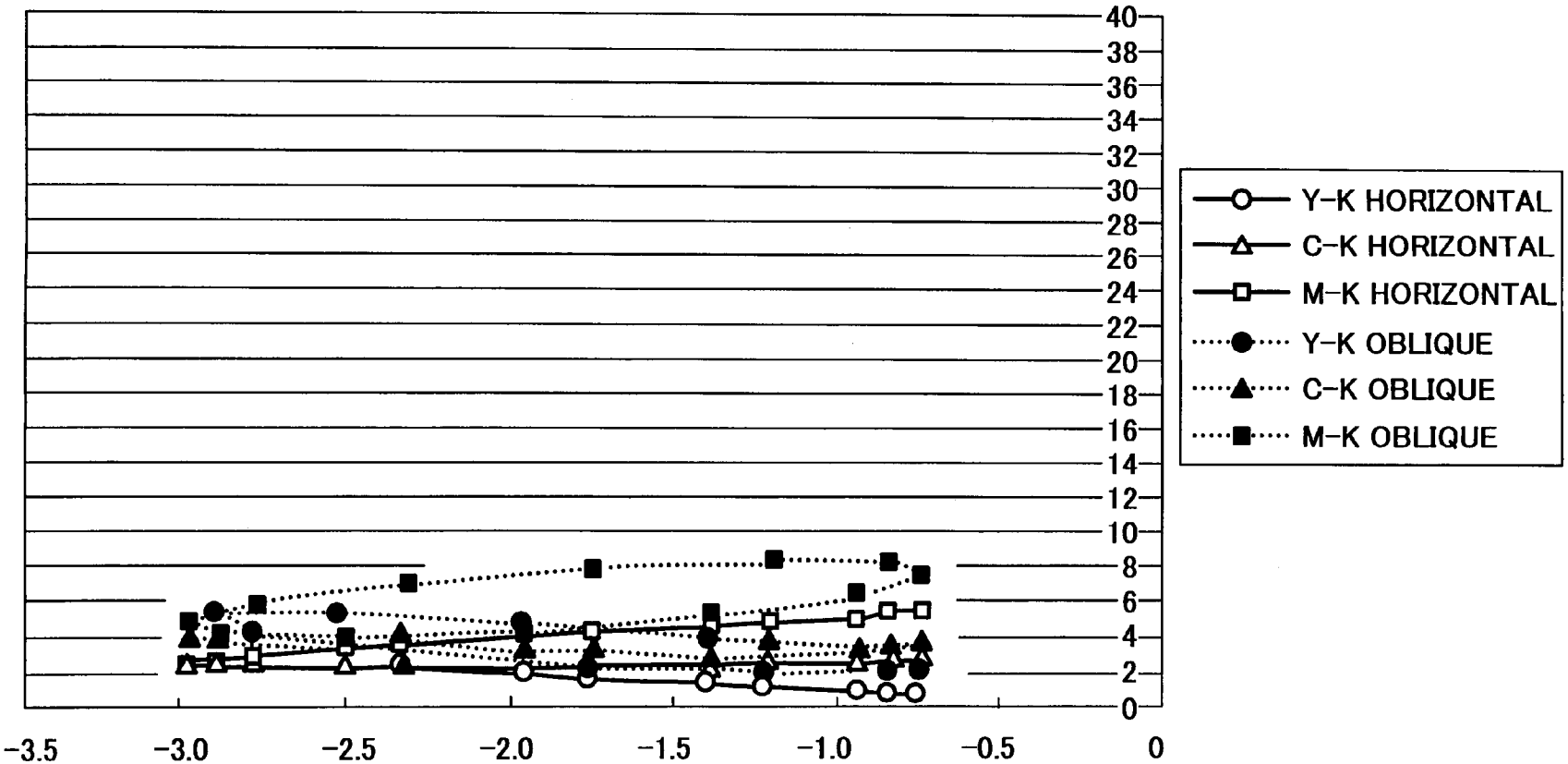
Figure 42:
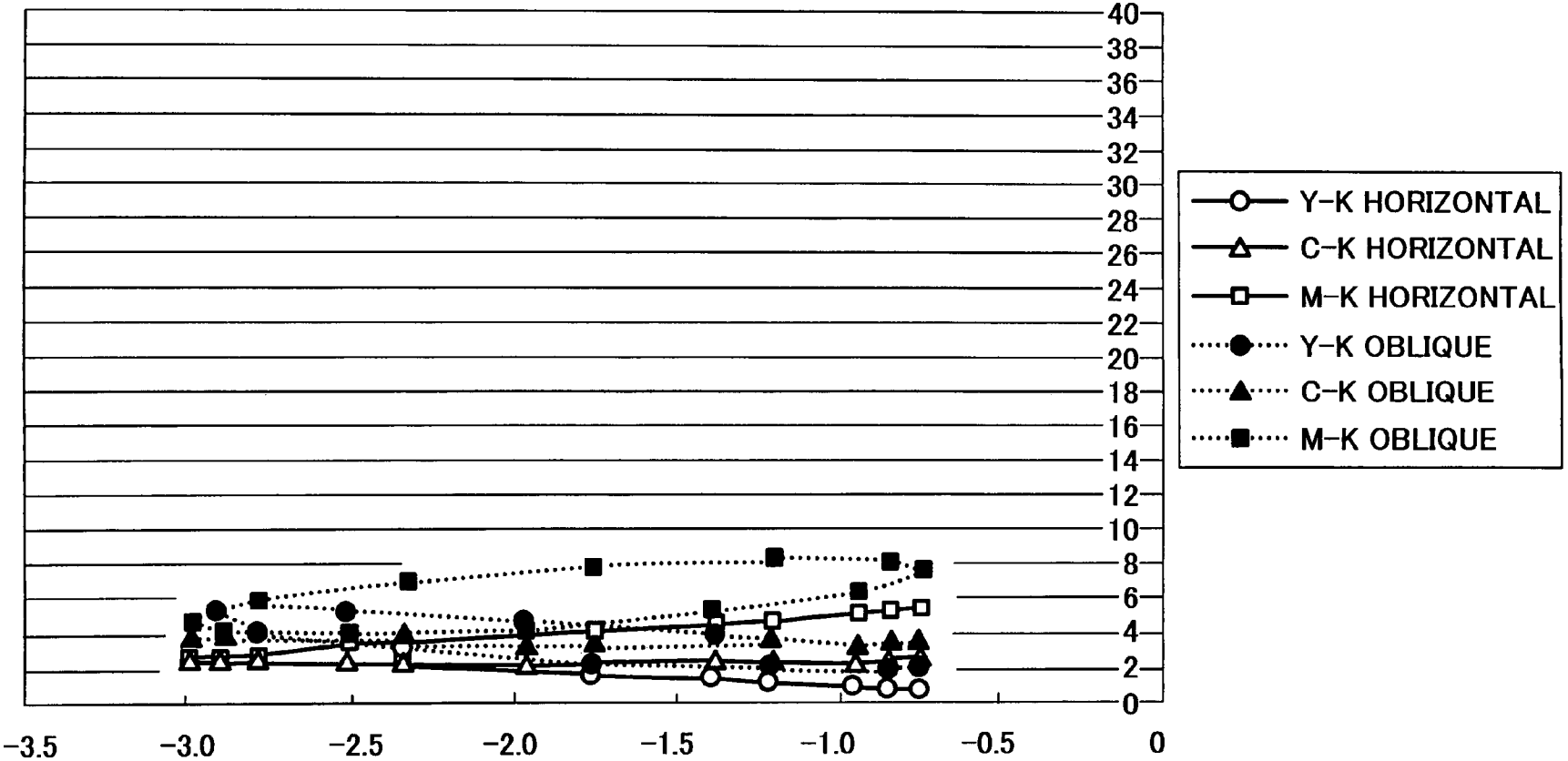
Figure 43:
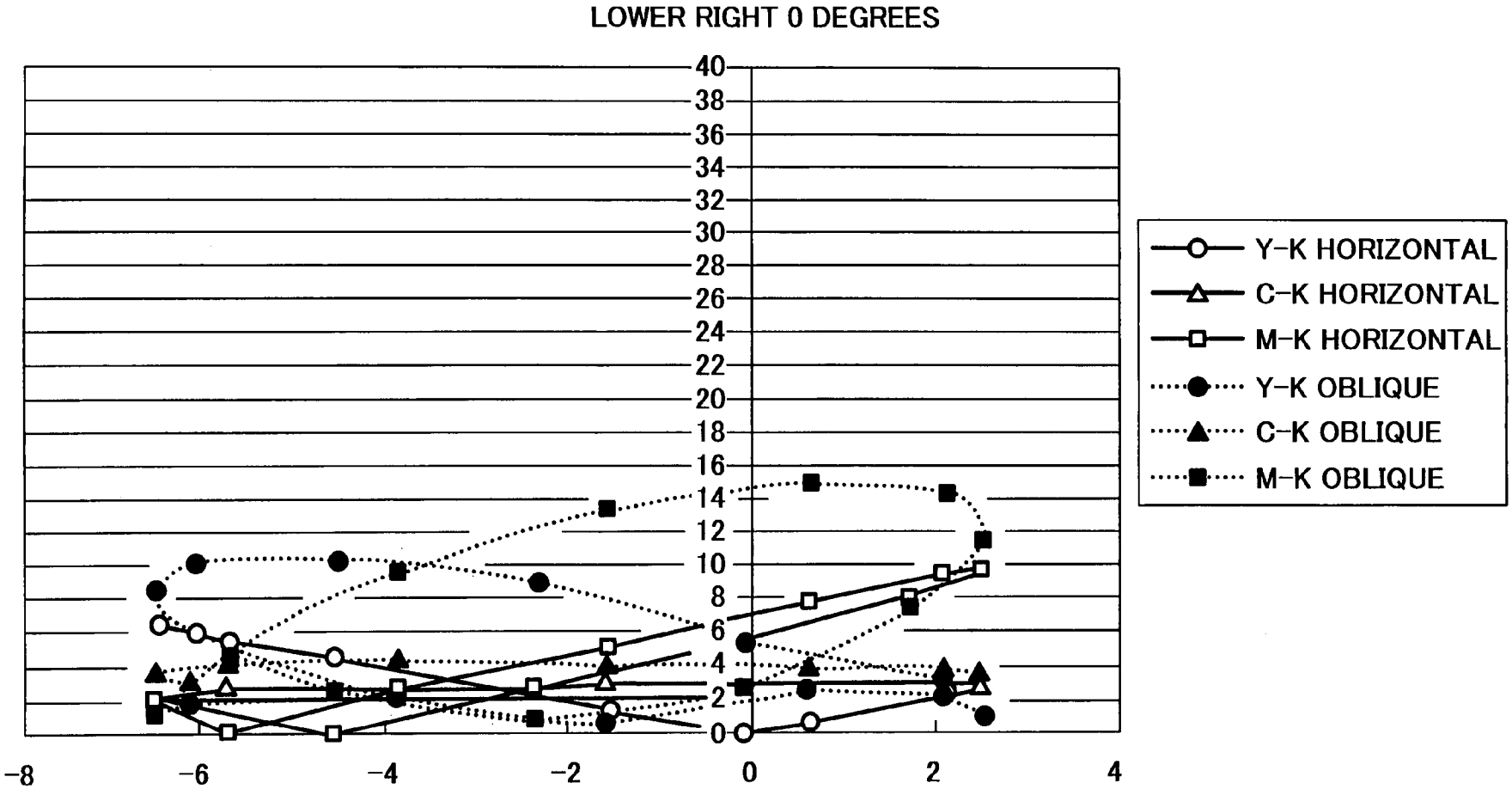
Figure 44:
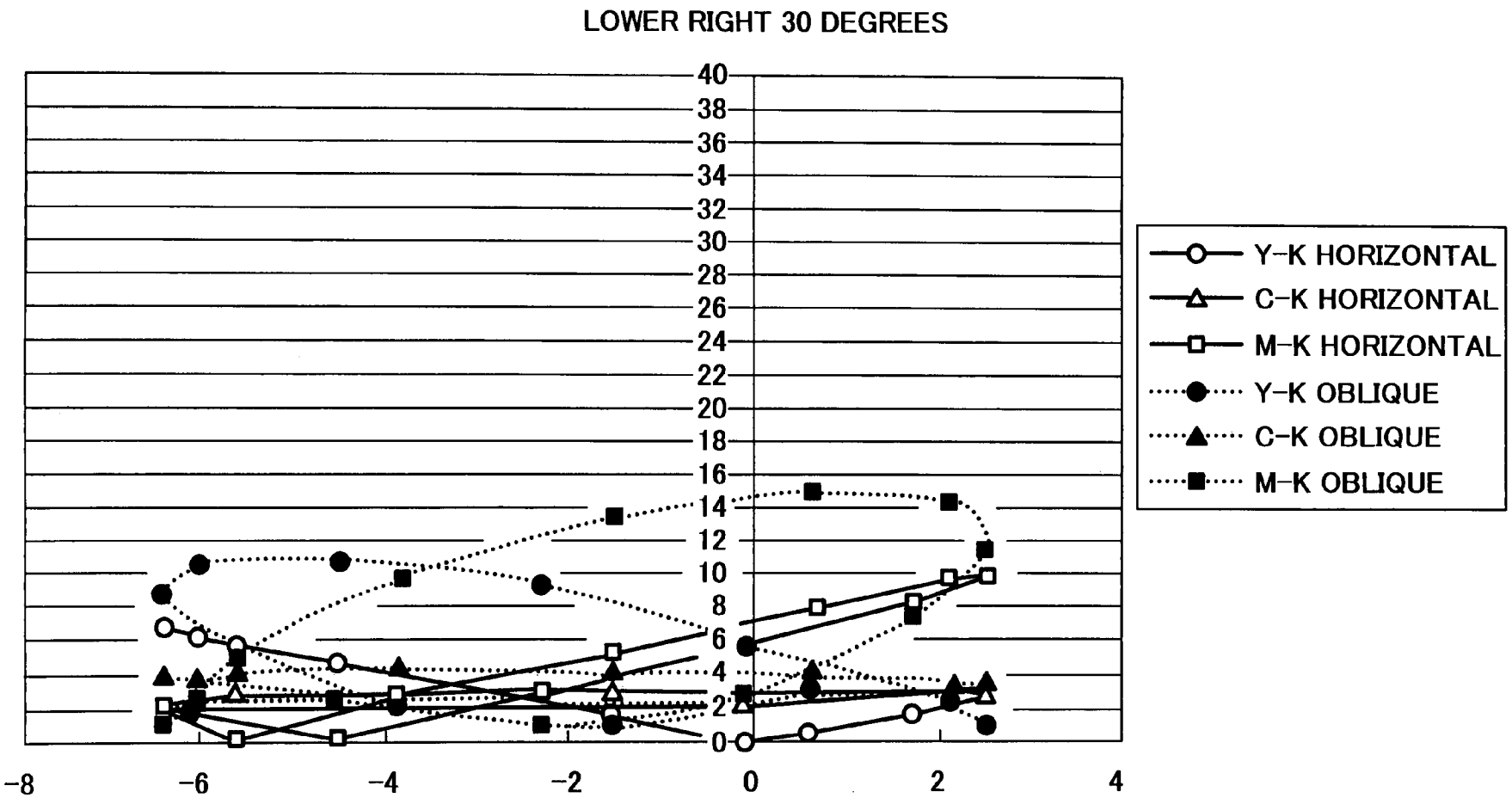
Figure 45:
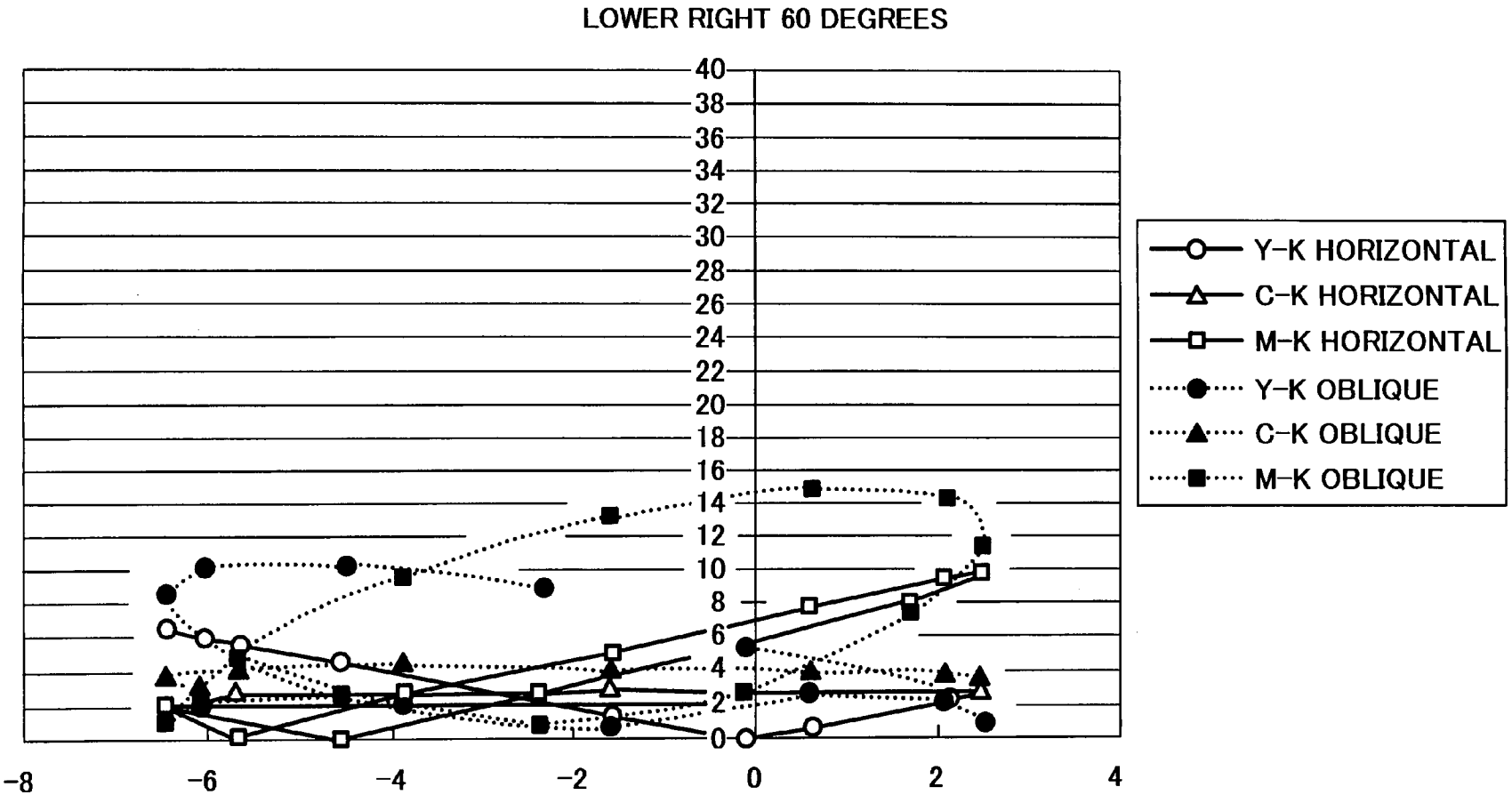
Figure 46:
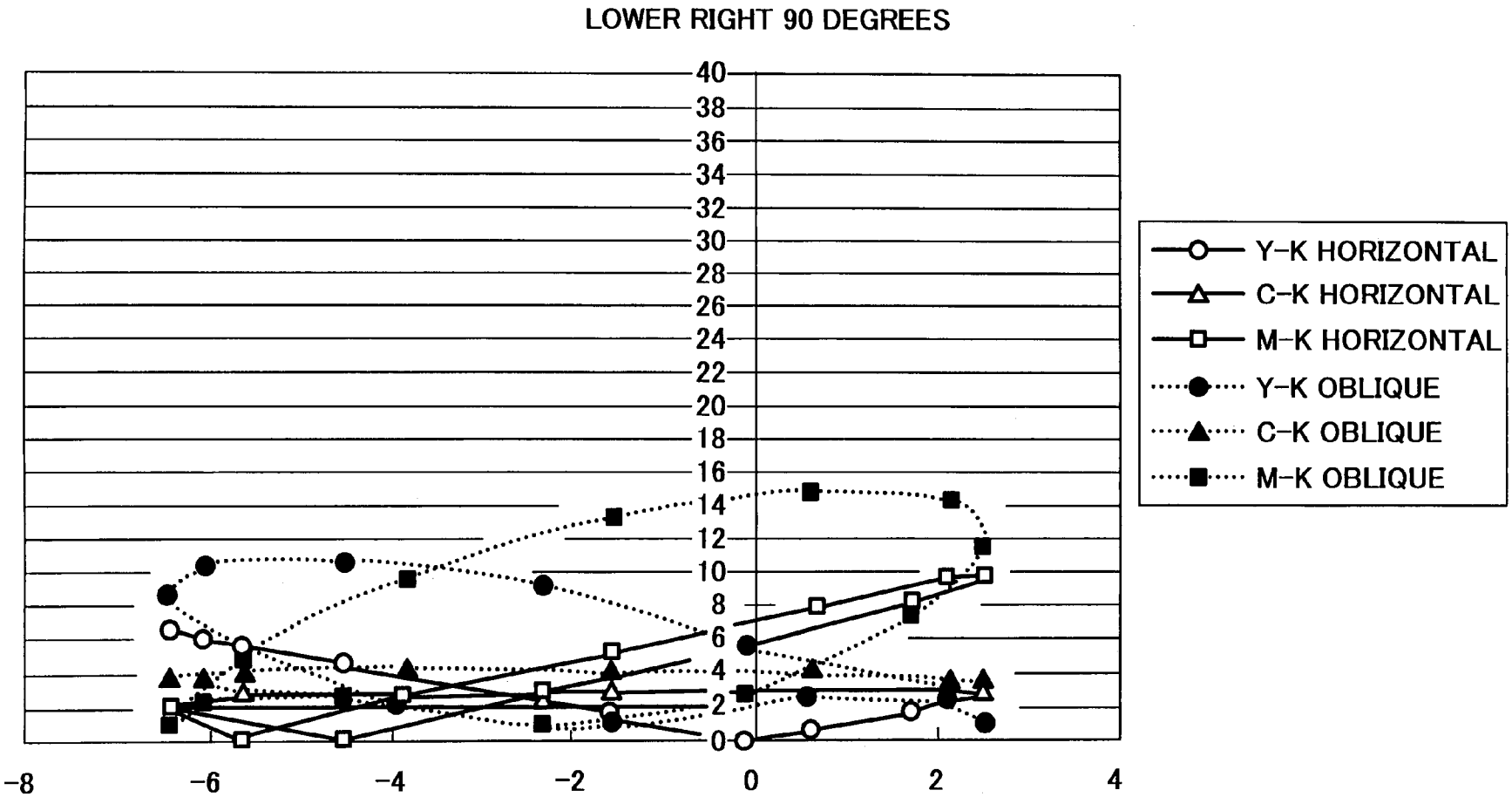
Figure 47:
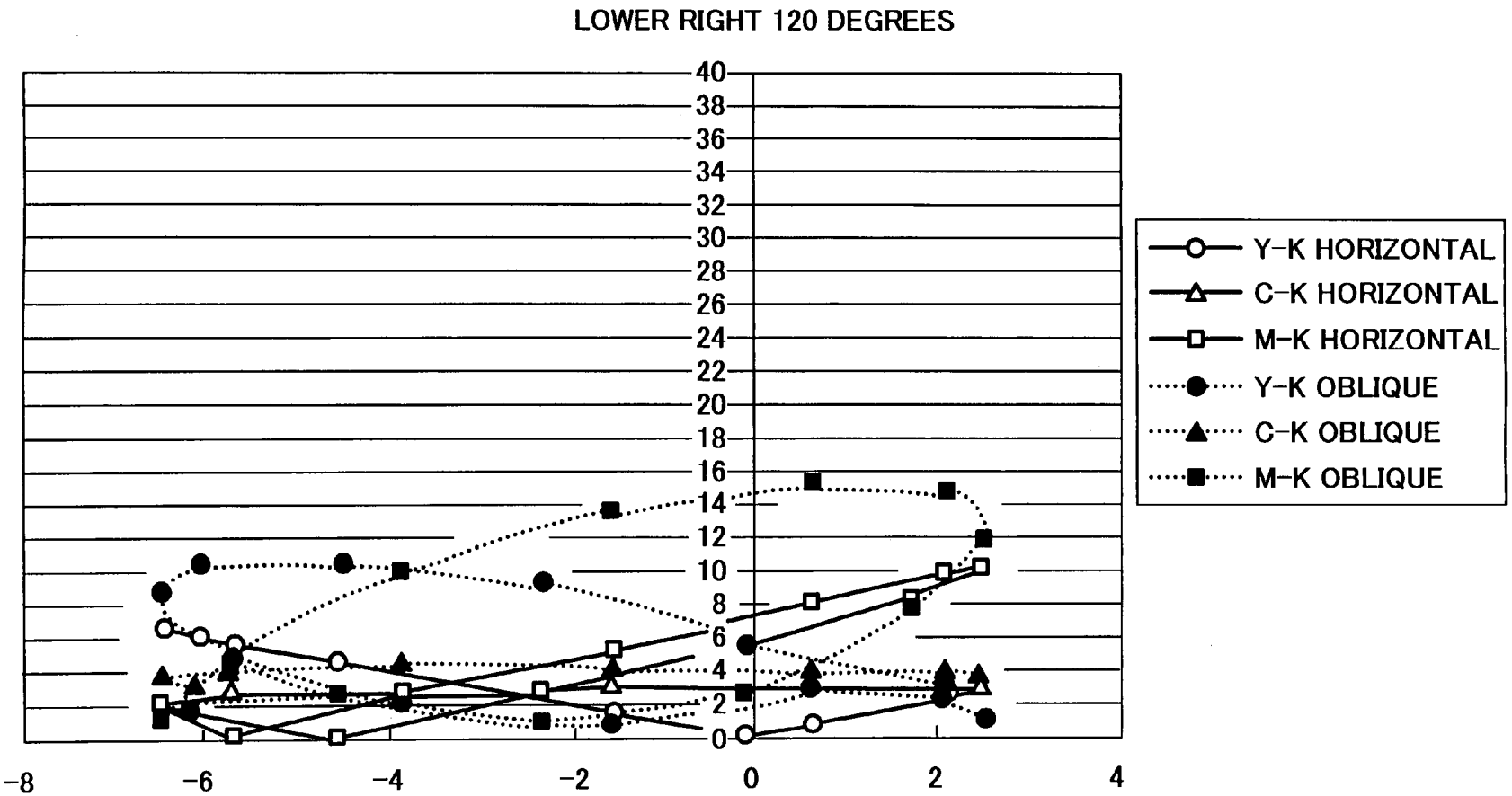
Figure 48:
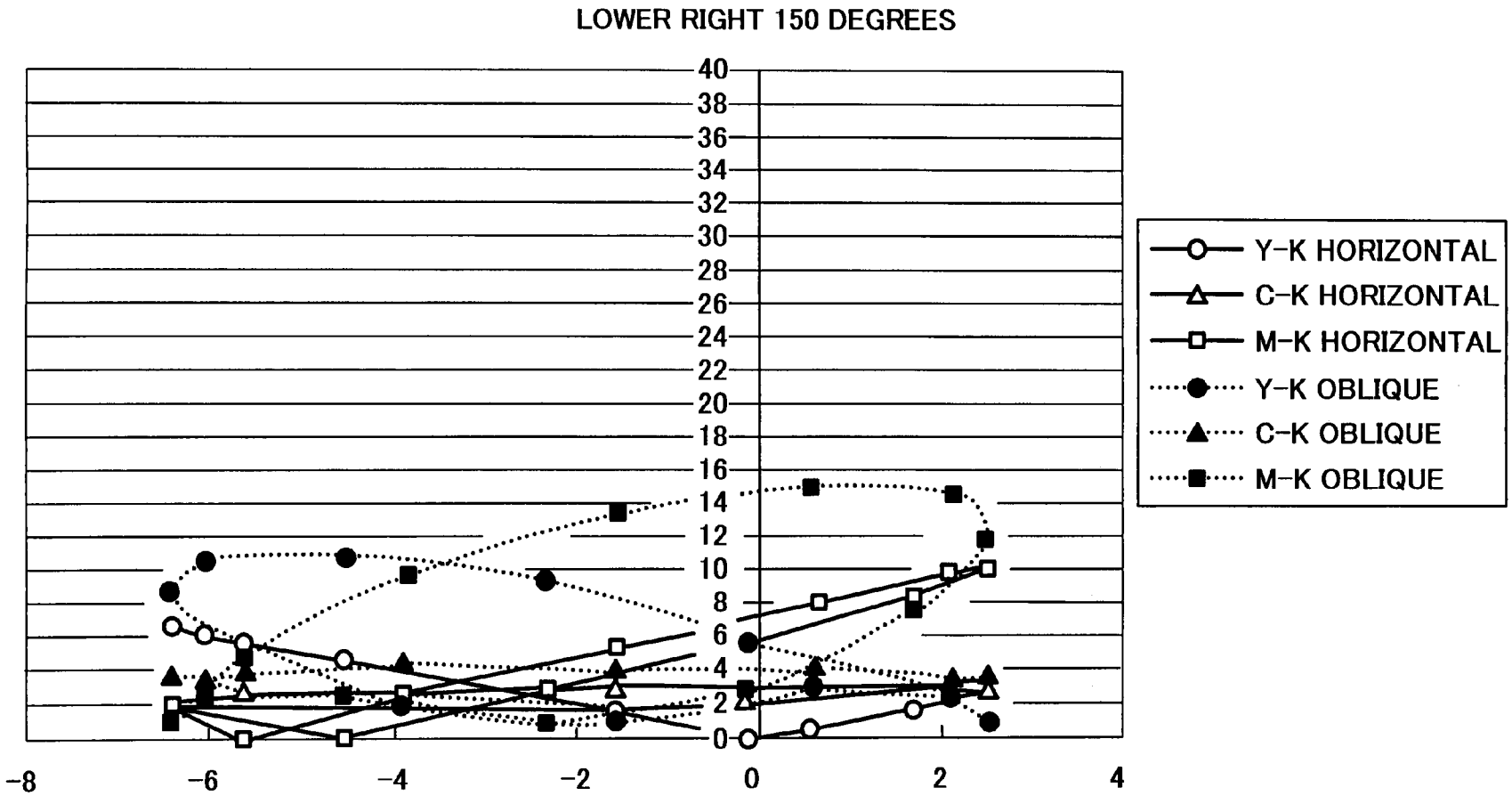
Figure 49:
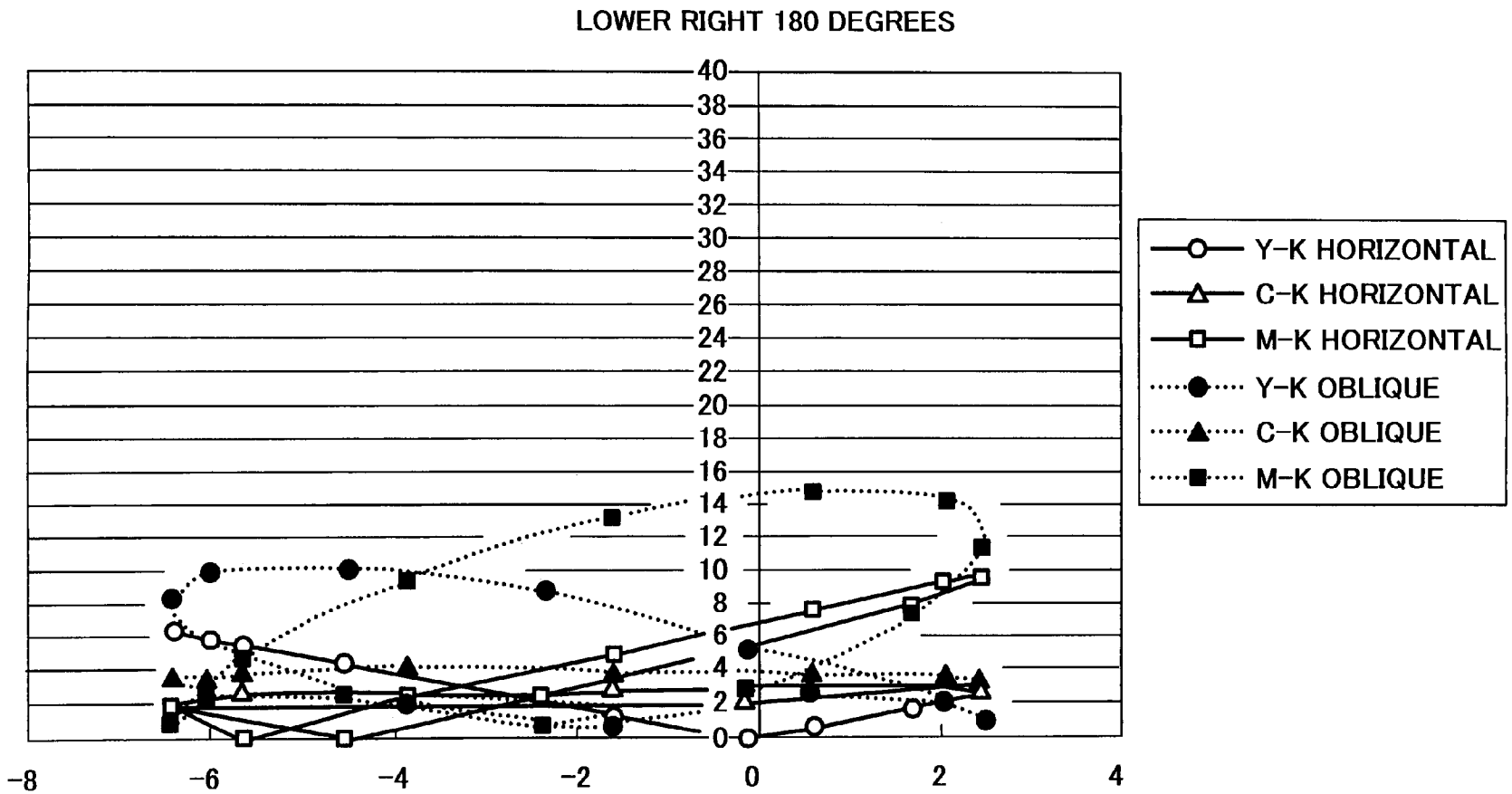
Figure 50:
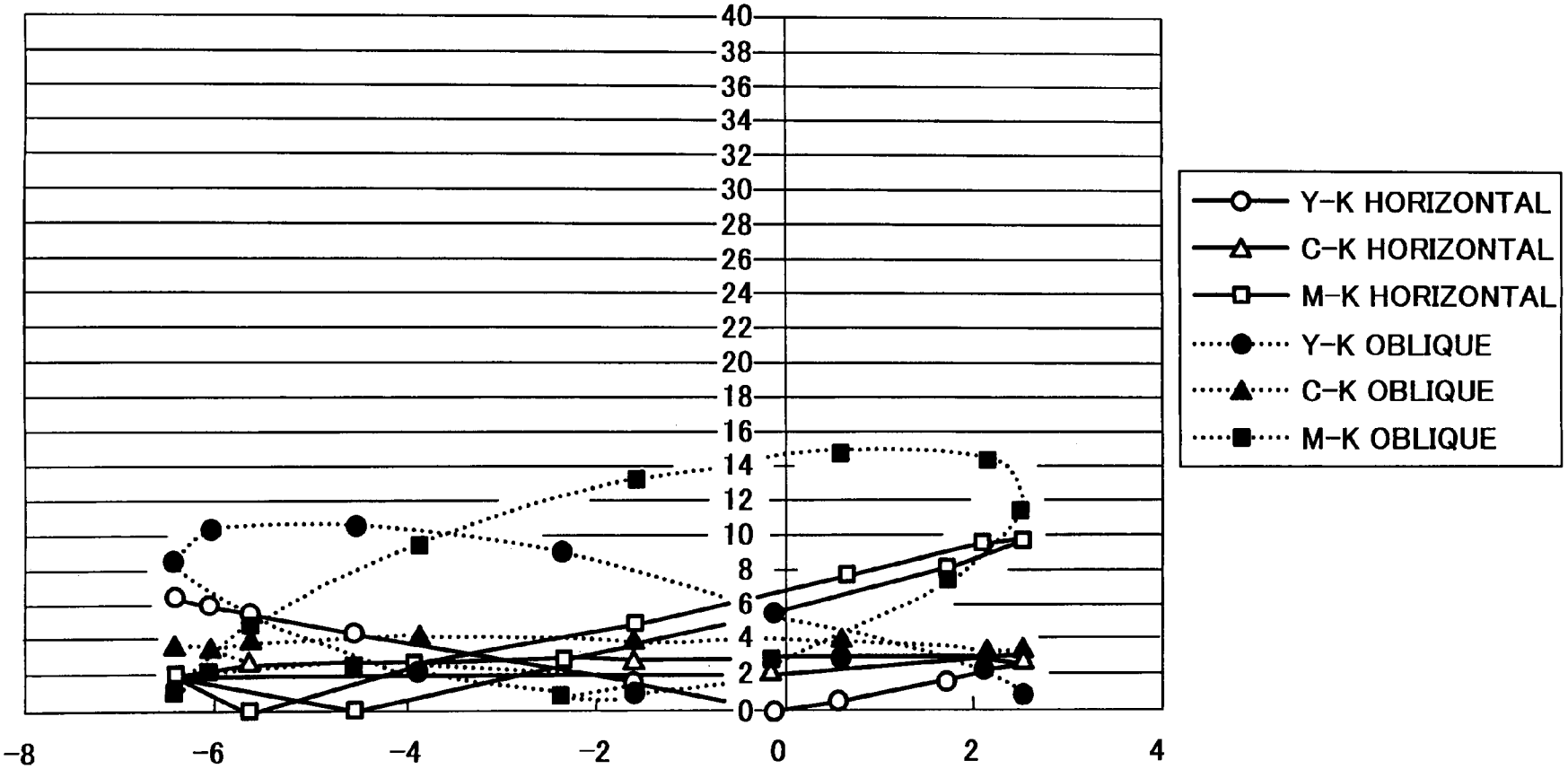
Figure 51:
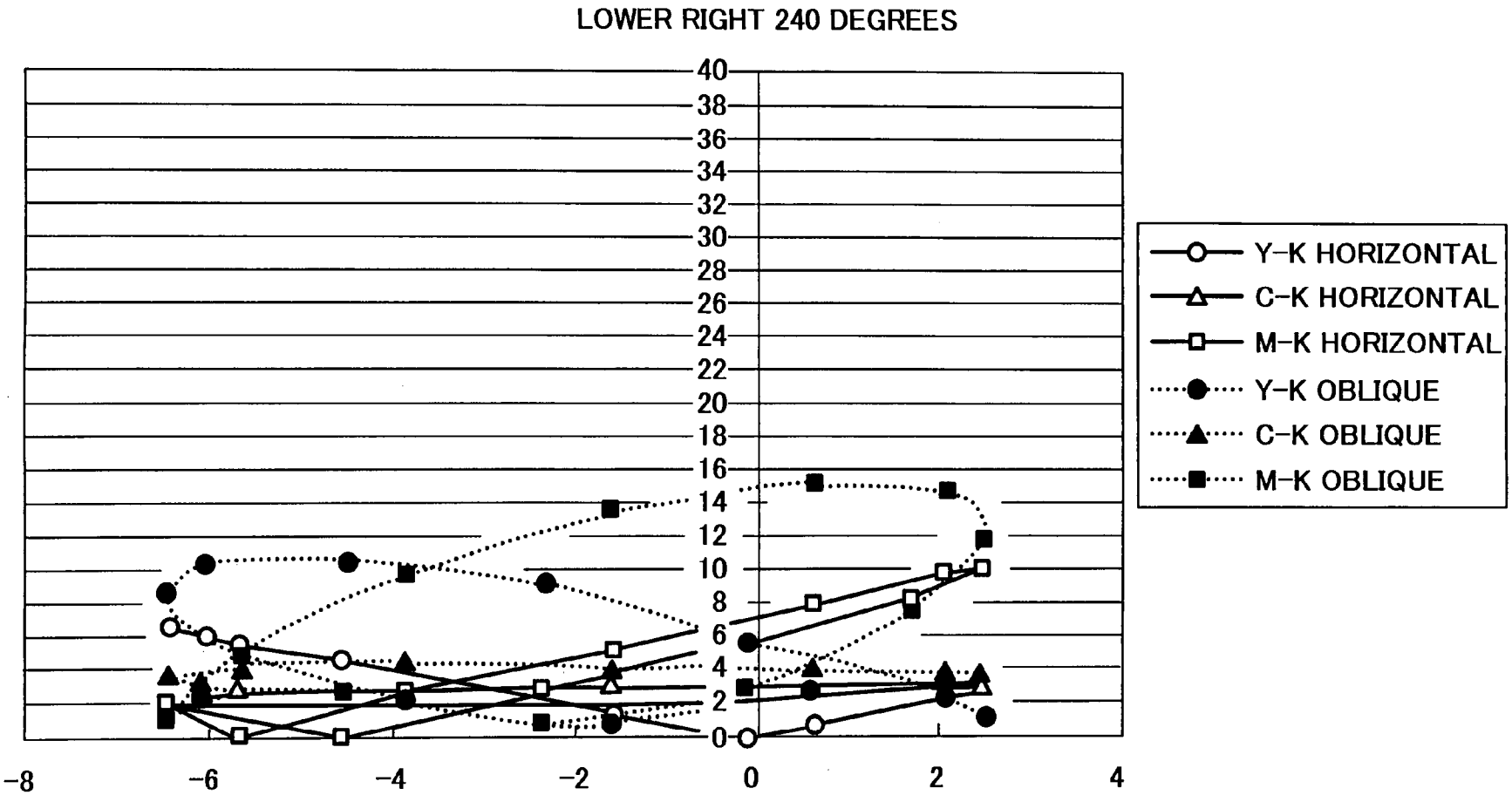
Figure 52:
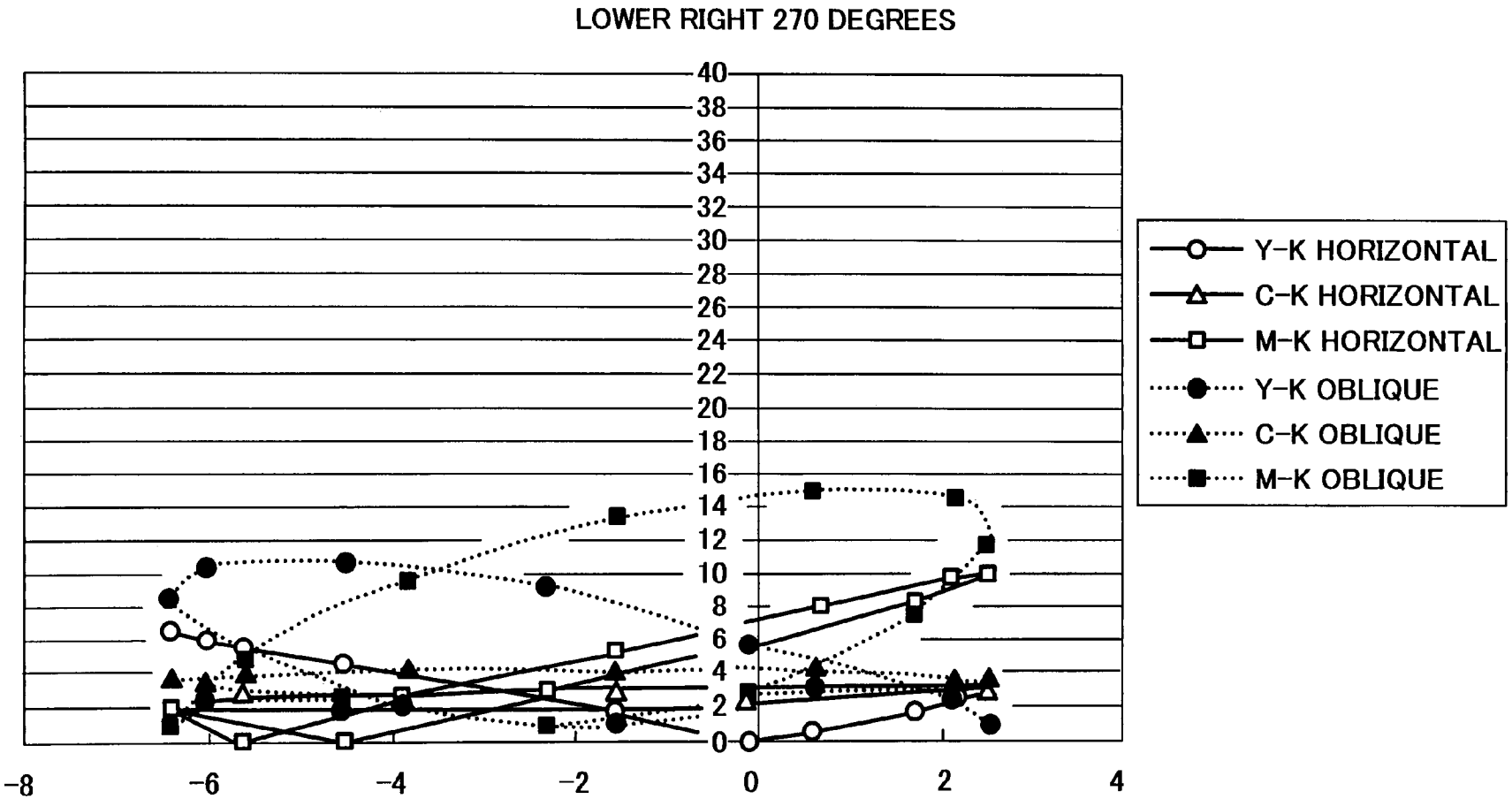
Figure 53:
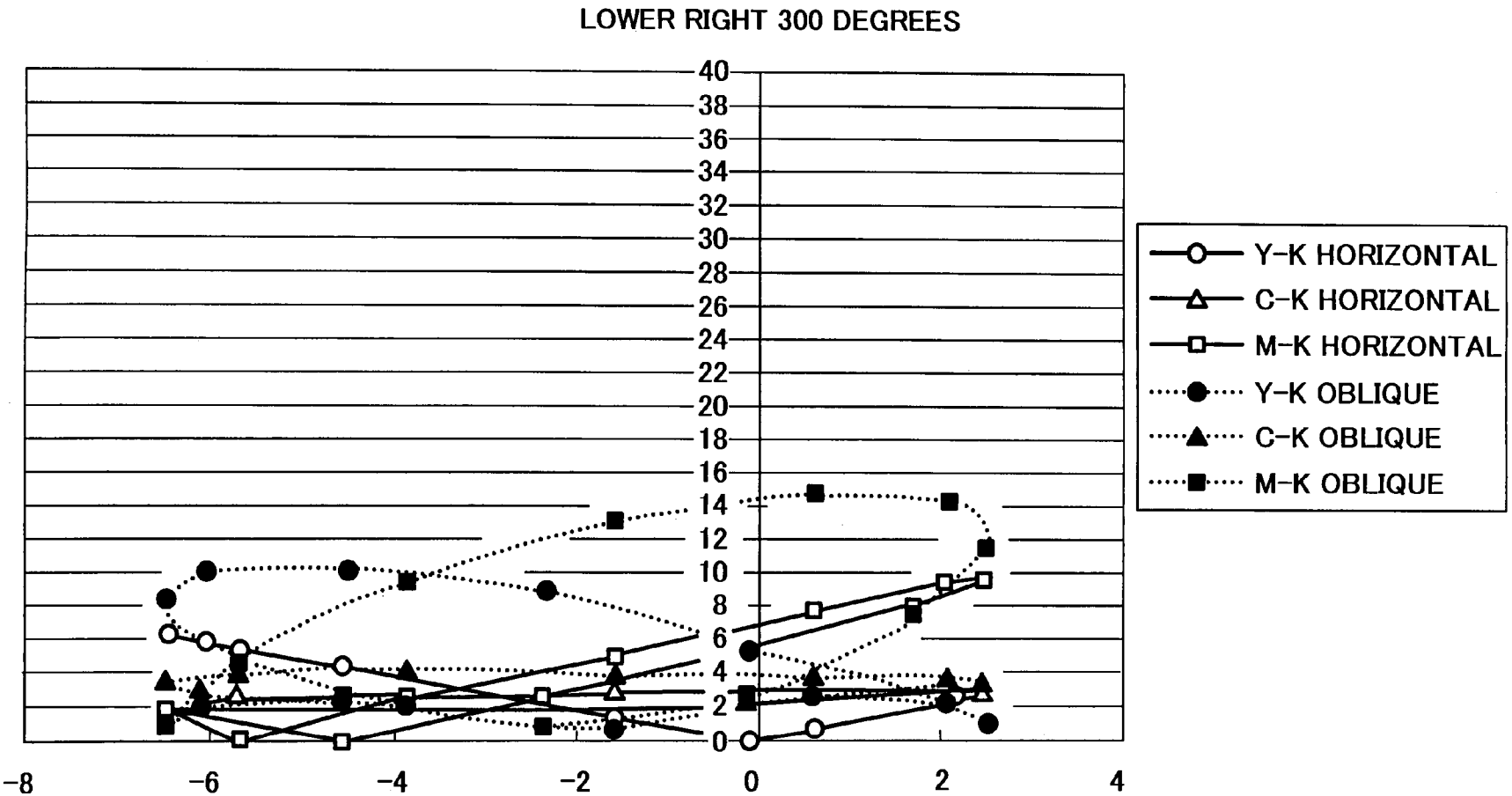
Figure 54:
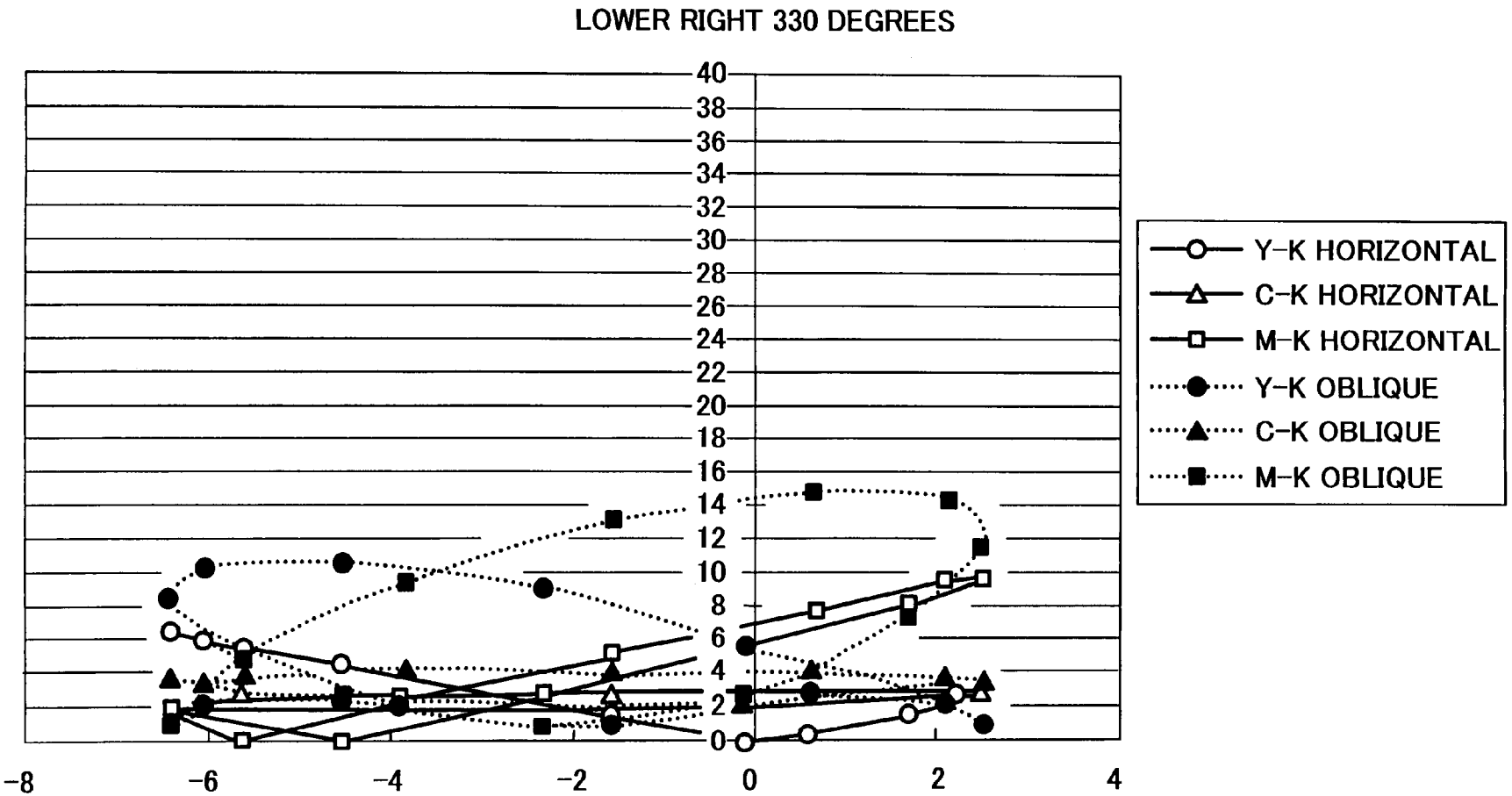

As is shown in FIG. 17, the transfer belt 10 is mounted on an inlet roller 44, outlet roller 45, driving roller 46, roller 47 that pushes the transfer belt 10 inward, tension roller 48, and lower right roller 49, and the driving roller 46 is connected to the driving gear of a transfer driving motor 51 via a timing belt 50. An encoder 52 is attached to the lower right roller 49, and a transfer driving motor control part (not shown in the figures) performs feedback control of the transfer driving motor 51 on the basis of pulse signals from the encoder 52, so that the movement speed of the transfer belt 10 is controlled to a set speed.

The transfer belt 10 is rotationally driven as a result of the driving roller 46 being rotationally driven by the driving motor 51. Transfer rollers to which a transfer bias is applied from the power supply are used as transfer units 11*a*, 11*b*, 11*c* and 11*d*. The photosensitive drums 6*a*, 6*b*, 6*c* and 6*d* are connected to a drum motor (used as a driving source) via idler gears (not shown in the figures), and are rotationally driven by this drum motor. Encoders (not shown in the figures) are attached to the photosensitive drums 6*a*, 6*b*, 6*c* and 6*d* or drum motor, and a driving motor control part (not shown in the figures) performs feedback control of the drum motor on the basis of pulse signals from these encoders, so that the rotational speed of the photosensitive drums 6*a*, 6*b*, 6*c* and 6*d* is controlled to a set speed.

In the Present Embodiment, 1. the spacing ma between the respective marks of the reference color Bk and other colors Y, C and M within the same mark set,
2. the spacing mb between respective marks of the same color within the same mark set, and
3. the spacing L between the respective mark sets, are set as the spacing between marks within the mark sets and the spacing between mark sets, so that when the amount of color deviation is calculated for a synthesized wave comprising two or more driving irregularity frequencies that are generated by the fluctuation irregularity per revolution of the image carrying body driving system that drives the photosensitive drums 6*a*, 6*b*, 6*c* and 6*d*, the transfer driving system that drives the transfer belt 10, and the transfer belt or photosensitive body belt, the calculation error caused by this synthesized wave is 20 μm or less. Thus, the precision of color deviation correction is 20 μm or better.

Here, 20 μm is half of the 40 μm of one dot in the case of 600 DPI, so that color deviation amounts greater than 20 μm are corrected by the above-mentioned adjustment. Color deviation amounts that are equal to or less than 20 μm are color deviation amounts that are not corrected by the above-mentioned adjustment.

In the setting of these mark spacings, it is assumed by the personal computer that the respective driving irregularity frequencies of the photosensitive drums 6*a*, 6*b*, 6*c* and 6*d* (OPC drums) used as an image carrying body driving system, the drum motor, the abovementioned idler gears, the driving roller 46 used as a transfer driving system, the transfer driving motor (independent motor) 51, the lower right roller 49, the outlet roller 45 and the inlet roller 44 are sine waves $$A\sin(2\pi f+\Theta)$$

A: amplitude, f: frequency, Θ: phase as shown in FIGS. 18A through 18D, and these are all combined to create a synthesized wave that is the basis for simulation.

Furthermore, in the case of parts such as the transfer belt, photosensitive drums and the like that are longer than the total length of the mark patterns, the fluctuation components are canceled by disposing the plurality of mark pattern groups (mark set groups) so that the phase is shifted by 360 degrees/number of mark set groups in accordance with the above-mentioned approach illustrated using FIG. 59.

In the present embodiment, as an embodiment of the present invention, the mark spacing is determined with consideration given to the rotational fluctuation generated by the photosensitive body driving system and rotational fluctuation generated by the transfer image formation driving system; furthermore, in the case of driving irregularities with a period longer than the total length of the mark patterns, the rotational period of the transfer belt 10 is envisioned, and the number of mark set groups is set as two groups, with the spacing of the mark sets of the first group and mark sets of the second group (eight mark sets on the r side and eight mark sets on the f side) in the direction of rotation of the transfer belt 10 being set so that the phase is shifted by 360 degrees/2=180 degrees with respect to the period of the transfer belt 10.

Specifically, with a wave having the period of the transfer belt 10, which constitutes a wave with a frequency per revolution that is lower than the frequency determined from the length of the mark sets of one group, taken as an object, the mark sets of the two groups are disposed so that the phase is shifted by 180 degrees. This is realized by the MPU 41 causing test pattern signals to be sent to the write unit 5 from the abovementioned test pattern signal generator so that the phases of the mark sets of the first group and mark sets of the second group are shifted by 180 degrees with respect to the period of the transfer belt 10. In this case, since the phase difference between the mark sets of the first group and the mark sets of the second group is 180 degrees, the spacing of the mark sets of the first group and mark sets of the second group may be set at 0.5 periods with respect to the period of the transfer belt 10, so that the spacing may be set at 1.5 periods, 2.5 periods, 3.5 periods . . . or N.5 (N is an integer) periods.

In the present embodiment, the spacing of the mark sets of the first group and mark sets of the second group in the rotational direction of the transfer belt 10 is set at 2.5 periods. In concrete terms, the circumferential length of the transfer belt 10 is 815 mm, and the spacing of the respective pattern groups (mark sets) is 285 mm, which corresponds to approximately 35% of the circumferential length of the transfer belt 10. The spacing between the mark sets of the first group and mark sets of the second group is 815×2.5=2037.5 mm. Furthermore, the mean thickness t of the transfer belt 10 is 0.1 mm, and the thickness deviation within one circumference of the transfer belt 10 is 10% or less of the thickness t of the transfer belt 10.

In this case, it is assumed that the respective driving irregularity frequencies of the photosensitive drums 6*a*, 6*b*, 6*c* and 6*d* (OPC drums) used as the image carrying body driving system, the drum motor and the abovementioned idler gears are respective sine waves A1 through A3, and these are synthesized by the calculation of $\alpha$A1+$\beta$A2+$\gamma$A3. Furthermore, it is assumed that the respective driving irregularity frequencies of the driving roller 46 used as a transfer driving system, the transfer driving motor (independent motor) 51, the lower right roller 49, the outlet roller 45 and the inlet roller 44 are respective sine waves A4 through A8, and these are synthesized by the calculation of $\eta$(A4+A5+A6+A7+A8), thus producing a synthesized wave.

Here, the respective frequencies of the abovementioned sine waves A1 through A8 are so that the one-sided amplitude is as shown in FIG. 18A. For example, the coefficients $\alpha$, $\beta$ and $\gamma$ are set as shown in FIG. 18B, and $\eta$ is set, for example, to 1 as shown in FIG. 18C.

Next, the personal computer calculates the amounts of deviation in the image formation of the respective colors Y, Bk (K), C and M (i.e., the amounts of deviation of the toner images of the respective colors Y, Bk, C and M that are transferred onto the transfer belt 10: color deviation correction precision) while varying the spacing ma of the respective orthogonal marks (horizontal marks) and the spacing of the respective oblique marks (oblique marks) which are the mark spacings within the respective mark sets by 0.5 mm at a time within a range of 2.5 mm to 5.5 mm, varying the spacing mb of the orthogonal marks (horizontal marks) and oblique marks (oblique marks) which are the mark spacings within the respective mark sets by 0.5 mm at a time within a range of 17.5 mm to 35 mm, and varying the spacing L of the respective mark sets by 1.0 mm at a time within a range of 35 mm to 70 mm, as shown in FIG. 18D by means of a simulation in which the test patterns on the transfer belt 10 are substituted into the abovementioned synthesized wave.

Here, the processing line speed of the digital color copier of the present embodiment is 125 mm/s, so that ma=3.000 mm corresponds to 0.024 sec, mb=32.300 mm corresponds to 0.2584 sec, and L=61.300 mm corresponds to 0.4904 sec. Furthermore, for A1 through A8, the phase $\Theta$ is set at 0. Moreover, the initial calculation results are obtained by calculating the amounts of deviation of the spacing ma of the respective orthogonal marks and the spacing ma of the respective oblique marks within the same mark set in the abovementioned synthesize wave (i.e., the amounts of variation at the respective times corresponding to the spacing ma of the respective orthogonal mark and spacing ma of the respective oblique marks in the synthesized wave).

Figure 56:
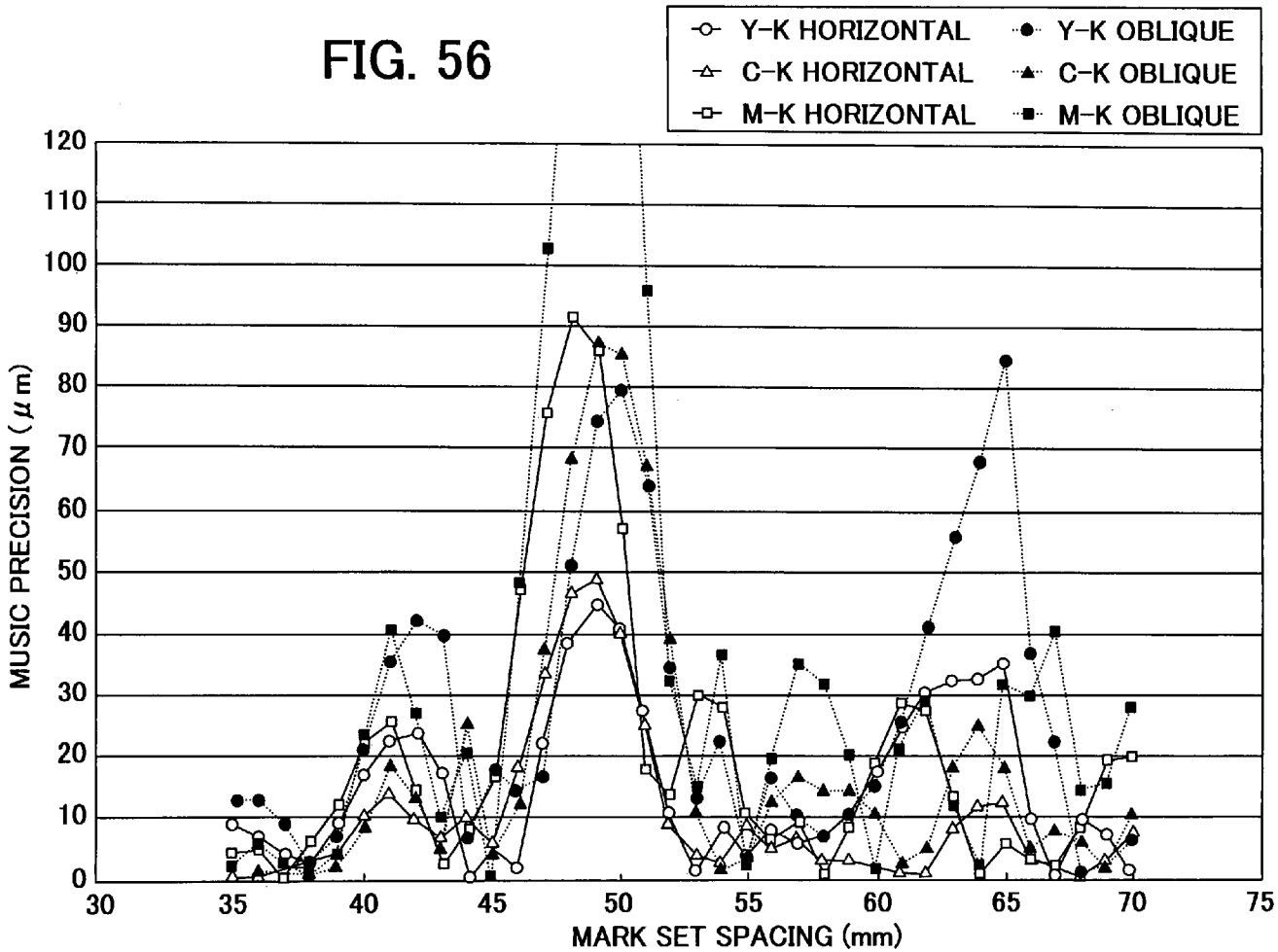
FIG. 56 is a diagram which shows the initial calculation results used to determine the dispositions of the marks in the same embodiment.

FIG. 56 shows the results obtained when the amount of deviation in image formation (color deviation correction precision) was calculated while varying the spacing of the respective mark sets by 1.0 mm at a time within a range of 35 mm to 70 mm with the spacing of the respective orthogonal marks (horizontal marks) set at 3.00 mm and with the spacing of the orthogonal marks (horizontal marks) and oblique marks (oblique marks) within the same mark sets set at 17.5 mm. In these calculations, the respective phases $\Theta$ of the OPC drums, drum motor, idler gears, driving roller 46, transfer driving motor (independent motor) 51, lower right roller 49, outlet roller 45 and inlet roller 44 are 0.

Among the abovementioned initial calculated results, results for combinations of ma, mb and L in which the color deviation correction precision is 20 μm or less were extracted, and second calculated results were obtained by the personal computer fitting the test patterns on the transfer belt 10 into the abovementioned synthesized wave and similarly calculating the Music precision while varying the respective phases $\Theta$ of A6 and A1 of the lower right roller 49 and OPC drums from 0 degrees to 330 degrees in 30-degree increments by means of a simulation. FIGS. 19 through 54 show some of the second calculated results in the respective phases (lower right 0 degrees, lower right 30 degrees, lower right 60 degrees . . . ) of A6 of the lower right roller 49.

In FIGS. 19 through 54, the vertical axis indicates the Music precision [μm], and the horizontal axis indicates the amount of deviation [mm] in the spacing of the respective orthogonal marks (horizontal marks) within the same mark sets, and the spacing of the oblique marks (oblique marks) within the same mark sets (i.e., the spacing of the Bk orthogonal marks and Y orthogonal marks (Y-K horizontal), the spacing of the Bk orthogonal marks and C orthogonal marks (C-K horizontal), the spacing of the Bk orthogonal marks and M orthogonal marks (M-K horizontal), the spacing of the Bk oblique marks and Y oblique marks (Y-K oblique), the spacing of the Bk oblique marks and C oblique marks (C-K oblique), and the spacing of the Bk oblique marks and M oblique marks (M-K oblique)).

Next, among the abovementioned second calculated results, the results in which the color deviation precision is 20 μm or less for all of the combinations of the respective phases of ma, mb and L for the lower right roller 49 and OPC drums were extracted, and the color deviation correction precision was similarly calculated by the personal computer fitting the test patterns on the transfer belt 10 into the abovementioned synthesized wave, and varying the phase of A8 of the inlet roller 44 from 0 degrees to 330 degrees in 90 degree increments by means of a simulation.

The reason that the respective phases of A1, A6 and A8 of the lower right roller 49, inlet roller 44 and OPC drums were varied in these second calculations and third calculations was that the amplitudes of these A6 and A1 of the lower right roller 49 and OPC drums were large, so that the A8 of the inlet roller 44 affected the lower right roller 49, and the frequency was a frequency in which the phases did not match among the respective colors.

Figure 55:
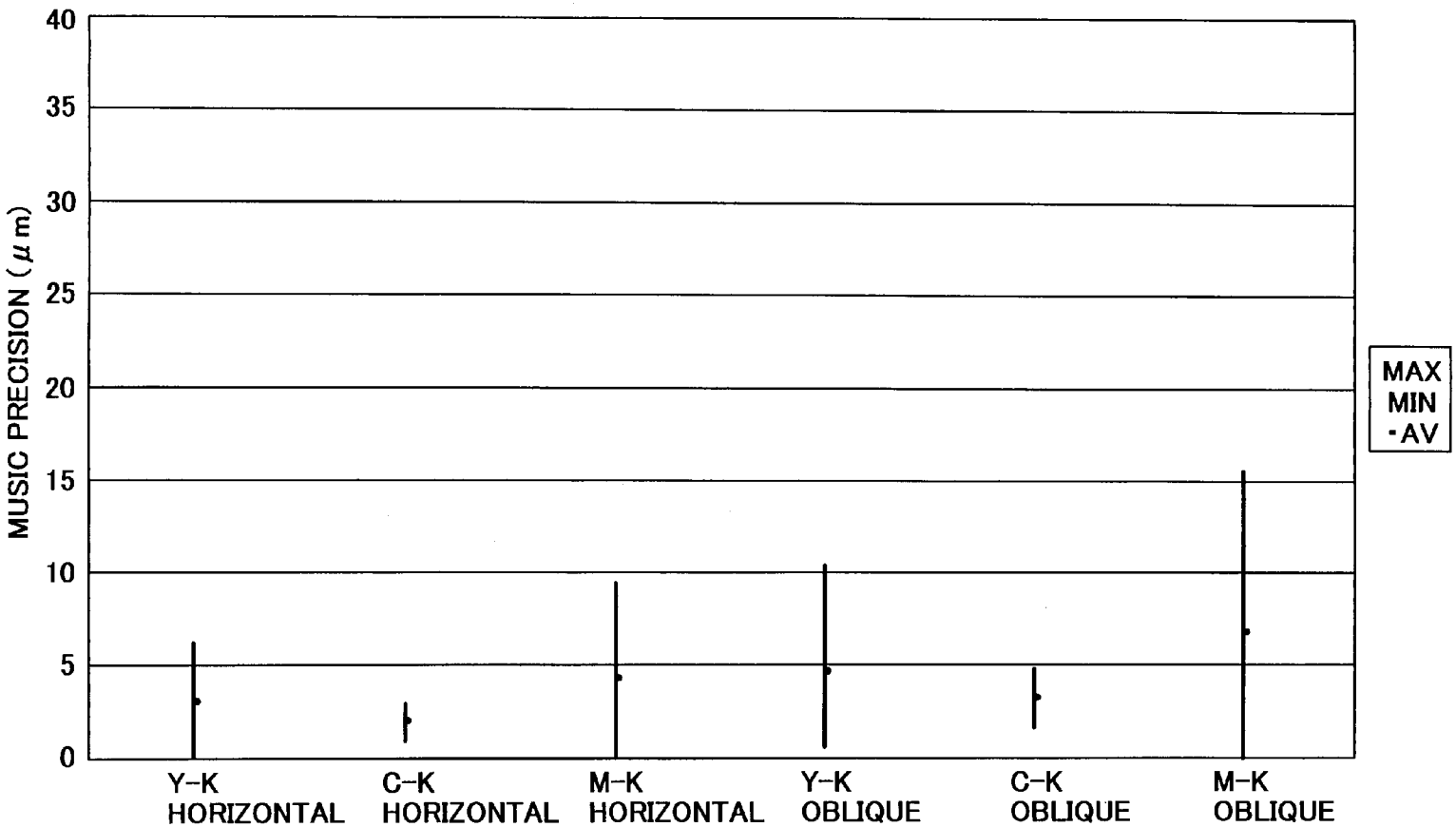
FIG. 55 is a diagram which shows the distribution of the amount of deviation in the spacing of the marks, the maximum value max, the minimum value min and the mean value av, which are the third calculation results that are used to determine the dispositions of the marks in the same embodiment.
Figure 58:
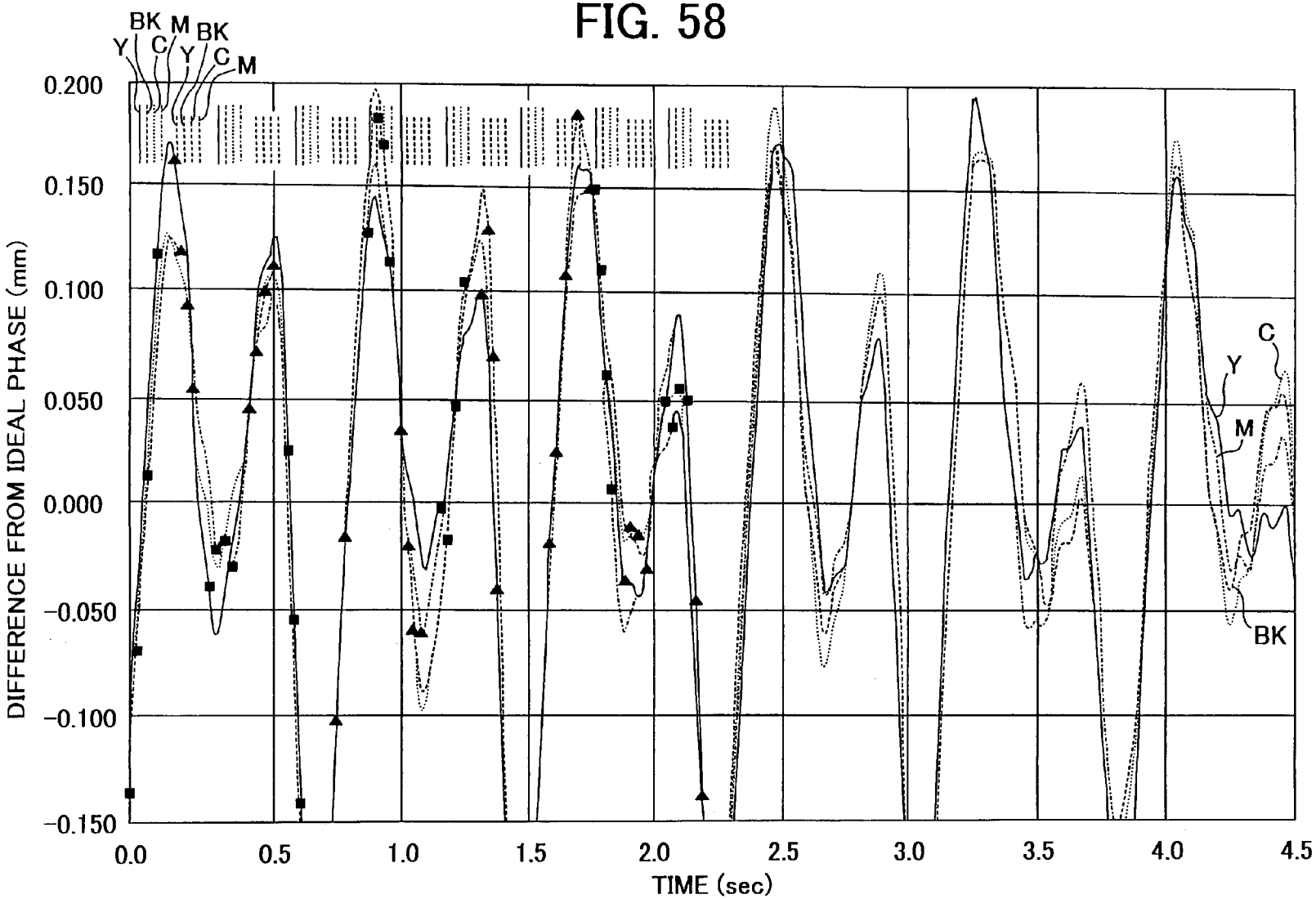
FIG. 58 is a diagram which shows the amounts of deviation of the marks of respective colors created from the abovementioned third calculation results.

FIG. 57 shows some of the third calculated results. FIG. 55 shows examples of the distributions, maximum values max, minimum values min and mean values av of the amounts of deviation of the spacing of the Bk orthogonal marks and Y orthogonal marks (Y-K horizontal), the spacing of the Bk orthogonal marks and C orthogonal marks (C-K horizontal), the spacing of the Bk orthogonal marks and M orthogonal marks (M-K horizontal), the spacing of the Bk oblique marks and Y oblique marks (Y-K oblique), the spacing of the Bk oblique marks and C oblique marks (C-K oblique), and the spacing of the Bk oblique marks and M oblique marks (M-K oblique), which constitute the third calculated results. FIG. 58 shows the amounts of deviation of the respective color marks created from the third calculated results with respect to the reference position. In FIG. 57, the OPC phase, the phase of the lower right roller and the inlet phase are respectively the phase of A1, the phase of A6 and the phase of A8.

From the third calculated results, conditions which are such that the spacings of the respective marks of the reference color Bk and other colors Y, C and M, i.e., the spacing of the Bk orthogonal marks and Y orthogonal marks (Y-K horizontal), the spacing of the Bk orthogonal marks and C orthogonal marks (C-K horizontal), the spacing of the Bk orthogonal marks and M orthogonal marks (M-K horizontal), the spacing of the Bk oblique marks and Y oblique marks (Y-K oblique), the spacing of the Bk oblique marks and C oblique marks (C-K oblique), and the spacing of the Bk oblique marks and M oblique marks (M-K oblique) (i.e., the maximum values of the respective spacings), are all spacings that do not exceed 20 μm in any of the combinations of the respective phases of A1, A6 and A8 of the lower right roller 49, inlet roller 44 and OPC drums were calculated, and 1. the spacing ma between the respective marks of the reference color Bk and other colors Y, C and M,
2. the spacing mb between respective marks of the same color, and
3. the spacing L between the respective mark sets, were set as the spacings ma and mb between marks within the mark sets and the spacing L between mark sets in accordance with the abovementioned conditions.

In other words, the abovementioned test pattern signal generator that provides test pattern signals to the write unit 5 is constructed so as to generate test pattern signals used to form test patterns on the transfer belt 10 that have 1. a spacing ma between the respective marks of the reference color Bk and other colors Y, C and M,
2. a spacing mb between respective marks of the same color, and
3. a spacing L between the respective mark sets, as the spacings ma and mb between marks within the mark sets and the spacing L between mark, which are such that the spacing of the Bk orthogonal marks and Y orthogonal marks (Y-K horizontal), the spacing of the Bk orthogonal marks and C orthogonal marks (C-K horizontal), the spacing of the Bk orthogonal marks and M orthogonal marks (M-K horizontal), the spacing of the Bk oblique marks and Y oblique marks (Y-K oblique), the spacing of the Bk oblique marks and C oblique marks (C-K oblique), and the spacing of the Bk oblique marks and M oblique marks (M-K oblique) (i.e., the maximum values of the respective spacings), are all spacings that do not exceed 20 μm in any of the combinations of the respective phases of A1, A6 and A8 of the lower right roller 49, inlet roller 44 and OPC drums.

Furthermore, in the present embodiment, it was assumed that the respective driving frequency irregularity frequencies of the OPC drums used as an image carrying body driving system, the drum motor, the abovementioned idler gears, the driving roller 46 used as a transfer driving system, the transfer driving motor 51, the lower right roller 49, the outlet roller 45 and the inlet roller 44 were sine waves, and all of these eight waves were combined to produce the synthesized wave that constitute the basis of the simulation. However, the synthesized wave that is used is not limited to these eight waves.

In the abovementioned synthesized wave, the abovementioned eight waves A1 through A8 may be synthesized with a wave having a low frequency, e.g., a wave in which the driving irregularity frequency of the transfer belt 10 is viewed as a sine wave, and the total length of the abovementioned eight mark sets may be set at a length that is substantially the same as or shorter than the circumferential length per revolution of the part (e.g., the transfer belt 10) having the lowest frequency among the respective waves prior to the synthesis of the above-mentioned synthesized wave. However, in cases where such a short length is used, it is necessary to prepare a plurality of mark pattern groups and to dispose the mark pattern groups in a manner that allows canceling of these groups with respect to the frequencies, so that the frequencies are canceled. Furthermore, there are likewise no restrictions on the elements of the eight waveforms treated here (i.e., the OPC drums, drum motor, idler gears, driving roller 46, transfer driving motor 51, lower right roller 49, outlet roller 45 and inlet roller 44).

In this embodiment, the spacing of the marks of the reference color and other colors, the spacing of marks of the same color and the spacing between mark sets used as the spacing of marks within the same mark sets and the spacing between mark sets are set so that when the amount of color deviation is calculated for a synthesized wave comprising two or more driving irregularity frequencies generated by the image carrying body driving system (OPC drums, drum motor, idler gears) and transfer driving system (driving roller 46, transfer driving motor 51, lower right roller 49, outlet roller 45 and inlet roller 44), the calculation error that is caused by this synthesized wave is 20 μm or less, which is a range that allows correction of the deviation of the [abovementioned] image of a plurality of colors. In actuality, therefore, the reliability of color deviation detection can be increased, and the error caused by the mark disposition of the test patterns can be minimized, so that the color deviation correction precision can be improved, by considering various fluctuation factors, and considering the disposition of the test patterns in a state that is close to the fluctuation that occurs on the transfer belt.

In the present embodiment, in cases where the total length of the mark sets formed on the transfer belt 10 used as a transfer medium is substantially the same as or shorter than the period length per revolution of the wave with the lowest frequency in the synthesized wave, high-precision pattern disposition that is more suitable for an actual device can be obtained by preparing a plurality of mark pattern groups and disposing these groups with the phase shifted in a manner that allows canceling with respect to the frequencies, so that the frequencies are canceled, and by assuming that the driving irregularity frequency of the endless belt is a sine wave and synthesizing this sine wave with the synthesized wave in cases where such an endless belt is used as the image carrying body or transfer medium.

In the present embodiment, the mark disposition was performed so that detection error did not occur with respect to the synthesized wave considering the positional fluctuation of the mark sets caused by the image carrying body driving system and transfer driving system, [and] the driving irregularity generated by the image carrying body driving system and transfer driving system; accordingly, color deviation correction in which the color deviation correction error caused by the mark disposition is minimized can be performed.

In the present embodiment, the mark spacing is determined with consideration given to the rotational fluctuation generated by the photosensitive body driving system and rotational fluctuation generated by the transfer image formation driving system; furthermore, in the case of driving irregularities with a period longer than the total length of the mark patterns, the rotational period of the transfer belt 10 is envisioned, and the number of mark set groups is set as two groups, with the spacing of the mark sets of the first group and mark sets of the second group in the direction of rotation of the transfer belt 10 being set so that the phase is shifted by 360 degrees/2=180 degrees with respect to the period of the transfer belt 10.

In the present embodiment, since the phase difference of the mark sets of the first group and the mark sets of the second group is 180 degrees, the spacing between the mark sets of the first group and the mark sets of the second group is set at a spacing of 2.5 periods of the transfer belt 10. By doing this, it is possible to cancel the transfer belt periodic fluctuation of low-frequency components that have a large effect on the color deviation at the time of color deviation correction (see FIGS. 59A and 59B).

In intrinsic terms, a shorter color deviation correction time is more convenient for the customer; accordingly, setting the spacing of the mark sets of the first group and mark sets of the second group at a spacing of 0.5 periods of the transfer belt 10 is optimal; in the present embodiment, however, the spacing of the mark sets of the first group and mark sets of the second group is set at 2.5 periods of the transfer belt 10 because of considerations of the software calculation processing time.

Next, in regard to the respective dimensions, the circumferential length of the transfer belt 10 is 815 mm, the spacing of the pattern groups (mark set groups) is 285 mm, which corresponds to approximately 35% of the circumferential length of the transfer belt 10, and the spacing of the mark sets of the first group and mark sets of the second group is 815×2.5=2037.5 mm.

As the spacing of the pattern groups (mark set groups) is set at a longer value, i.e., as this spacing approaches the circumferential length of the transfer belt 10, it becomes possible to cancel the periodic fluctuation components of the transfer belt 10 with greater precision. The reason for this is that the fluctuation components of the transfer belt 10 can be detected with greater fidelity, and these components can be corrected. However, when the spacing of the pattern groups (mark set groups) thus becomes long, this is not appreciated by the customer (as was described above). Accordingly, the balance between the waiting time for the customer and the correction precision is important; if the spacing of the mark set groups is 25% of the circumferential length of the transfer belt 10 or less (¼ circumference or less), then the correction precision is low, even if the phase of the mark sets of the respective groups is shifted by 180 degrees. The reason for this is that the fluctuation components of the transfer belt 10 cannot be detected with good fidelity, so that these components cannot be corrected (see FIGS. 59A and 59B).

If the fluctuation of the transfer belt 10 is a sine wave, then theoretically there are no problems even if the spacing of the mark set groups is 25% of the circumferential length of the transfer belt 10. In actuality, however, although the fluctuation of the transfer belt 10 may approach the form of a sine wave, this fluctuation is not a perfect sine wave. Even if the fluctuation of the transfer belt 10 is a perfect sine wave, in a case where the spacing of the mark set groups is 50% of the circumferential length of the transfer belt 10, almost all of the periodic components of the transfer belt 10 can be taken in and detected if the phase of the mark sets of the respective groups is shifted by 180 degrees. Accordingly, for the spacing of the mark set groups, a value which constituted a length close to 50% of the circumferential length of the transfer belt 10 (a length equal to 50% of the circumferential length of the transfer belt 10 or less), and which was thought not to produce a very long waiting time for the customer, was set. Specifically, in the present embodiment, the length of the pattern groups determined from the abovementioned synthesized wave and the abovementioned content were both taken into consideration, and eight sets of patterns (mark sets) were set as one pattern group, with the length of this group being set at approximately 35% of the circumferential length of the transfer belt 10.

Figure 63:
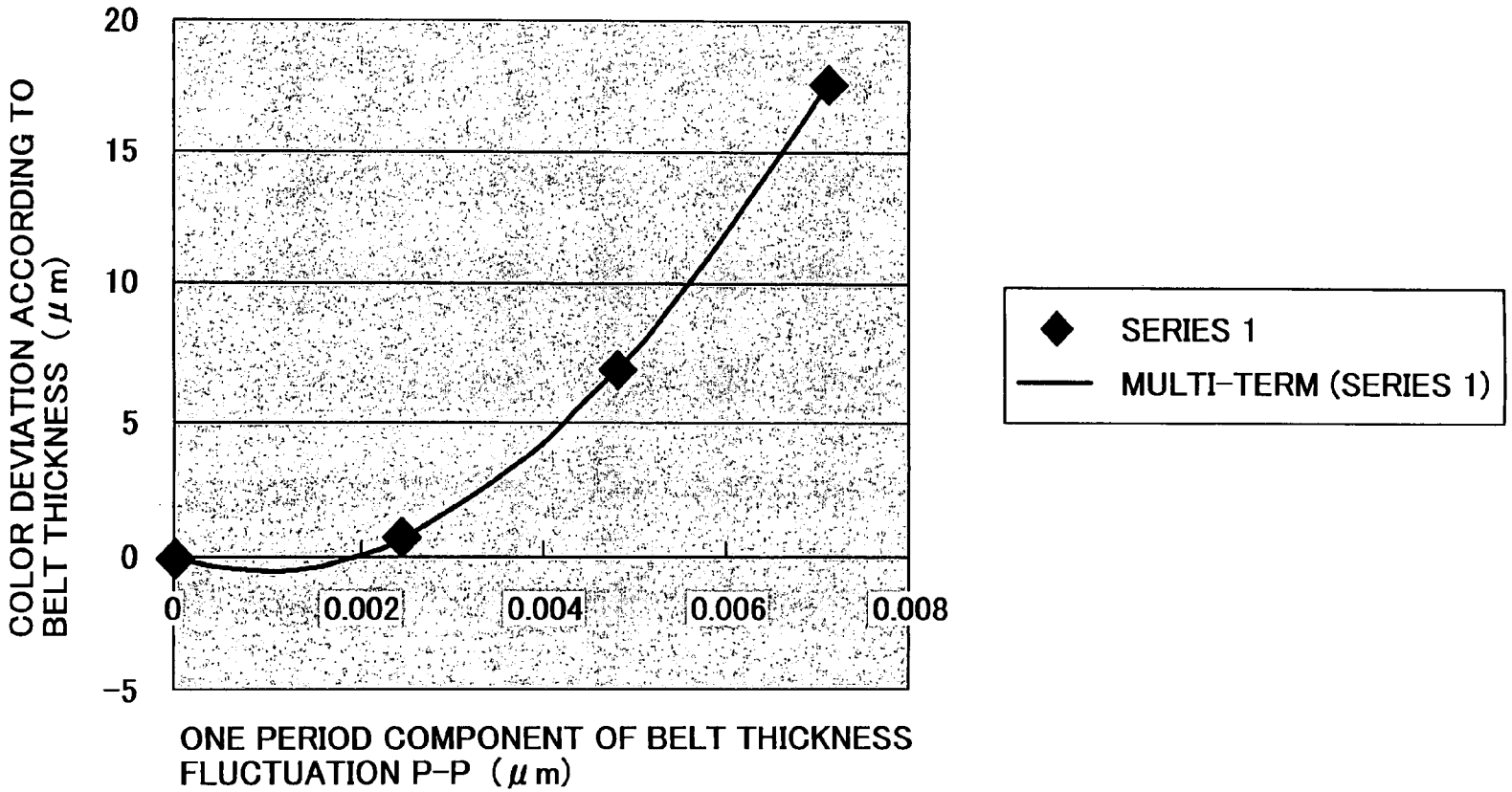
FIG. 63 is a diagram which shows the relationship between the thickness deviation of the transfer belt and the amount of color deviation caused by the effects of this thickness deviation in the abovementioned embodiment.

Next, in regard to the thickness of the transfer belt 10, the mean thickness t of the transfer belt 10 is 0.1 mm, and the thickness deviation within one circumference of the transfer belt 10 is set at 10% of the thickness t or less (0.01 mm or less). According to an investigation conducted by the inventor, this thickness deviation and the amount of color deviation have a close correlation in a four-unit tandem type full color copier (see FIG. 63), and if the thickness deviation exceeds 10%, the color deviation is no longer at an acceptable level. FIG. 63 shows the relationship between the thickness deviation of the transfer belt 10 and the amount of color deviation caused by the effects of this thickness deviation. It is seen from this FIG. 63 that if the thickness deviation of the transfer belt 10 is large, the amount of color deviation increases, while if the thickness deviation of the transfer belt 10 is small, the amount of color deviation decreases.

However, in order to suppress the thickness deviation of the transfer belt 10, an increase in cost is unavoidable (this is caused by a deterioration in the yield and a rise in mold expenditures due to increased mold precision). If the transfer belt 10 is viewed as a part expenditure in the image forming device, this part is positioned at a high rank. Furthermore, the transfer belt 10 is also a part that has a relatively high replacement frequency in the marketplace as well. In view of these facts, it is very desirable to avoid a cost increase in the transfer belt 10. Accordingly, in the present embodiment, the thickness deviation of the transfer belt 10 was set at 10% of the mean thickness of the transfer belt 10 or less in order to achieve both low cost and high quality.

Furthermore, as is shown in FIG. 14B, accurate mark detection without any missing of marks or erroneous detection of noise as marks can be achieved by extracting only mark read-out data in the range of 2 to 3 V, and calculating the center positions a and c of the data groups in the level falling regions and the intermediate points. Akrp and Ayrp of the data groups b and d in the level rising regions as the mark positions. In such cases and in cases where there is no contamination or adhesion of dirt to the transfer belt 10, all of the marks of the first through eighth mark sets can be correctly detected. Furthermore, since the length of all of the mark sets (the length to the eighth set) is set at a length that is the same as or shorter than the circumferential length of the part with the lowest frequency among the driving irregularity frequencies generated by the photosensitive body driving system and transfer driving system, the color deviation correction error can be minimized, and the time required for color deviation correction can be shortened.

In the present embodiment, in the method used to perform color deviation detection as described above, the read-out signals (Sdr/Sdf) of the sensors (20*r*/20*f*) are subjected to an A/D conversion at a specified pitch (Tsp), and the scanning positions (Nos) are specified and stored in memory. Furthermore, a color deviation detection method is used in which distribution information (Akrp, Ayrp . . . ) for the respective marks is produced on the basis of the scanning positions (a, b, c, d . . . ) of the data groups belonging to specified read-out signal variation regions with adjacent scanning positions in this memory (see FIG. 14B).

In this color deviation detection method, the data groups in regions where the mark read-out signals (Sdr/Sdf) vary are read-out signals for the leading end edge regions or trailing end edge regions of the marks, and the positions of the data groups (a, b, c, d . . . ) correspond to the edge positions of the marks. Even if the mark read-out signal levels should shift, the read-out signals (Sdr/Sdf) always drop or rise at the edges of the marks; accordingly, data groups that correspond to these edges are obtained, so that the mark edges can be reliably detected. Position information for the mark edges can be obtained by calculating the center positions of the mark groups, so that the positions of the respective marks can be detected by relatively simple processing. Since this mark position data is obtained by statistical processing of the positions of the respective data of the data groups, the reliability is high, and the deviation between overlapping images of the respective colors in color image formation can be detected relatively easily.

In the present embodiment, the specified mark read-out signal variation regions between high and low levels corresponding to the presence or absence of marks, in which there is a variation from the high level (5 V: no mark) to the low level (0 V: mark present). These regions are either the leading end edge regions or trailing end edge regions of the marks (leading end edges). In cases where a specified mark read-out signal variation region is a leading end edge region, position data expressing the leading end edges of the respective marks in the mark sequence is obtained; in cases where such a specified mark read-out signal variation region is a trailing end edge region, position data expressing the trailing end edges of the respective marks in the mark sequence is obtained.

Assuming that the variation regions employing the mark groups are leading end edge regions and trailing end edge regions, then, for example, a check can be made in order to ascertain whether or not the position difference between the two edges is a vale that corresponds to the mark width (w), so that it can be verified whether or not a mark edge is detected. Furthermore, the mean value of the positions of both edges can be determined as the center point of the mark. By determining the center points of the marks in this way, it is possible to achieve a great increase in the reliability and precision of the mark position data, so that the reliability of the detection of the mark sequences is greatly improved.

In the present embodiment, a plurality of marks (Akr, Ayr, Amr, Acr/Akf, Ayf, Amf, Acf . . . ) that are lined up in a row are read through relative scanning by the optical sensors 20*r*/20*f*, the read-out signals (Sdr/Sdf) are subjected to an A/D conversion at a specified pitch (Tsp), and the scanning positions (Nos) are specified and stored in memory. Furthermore, a color deviation detection method is used in which the first edge positions (a and c in FIG. 14B) are calculated on the basis of the scanning positions of data groups with adjacent scanning positions in this memory belonging to the variation regions of the high and low levels (5 V: no mark/0 V: mark present) corresponding to the presence or absence of marks, in which there is a variation from one level (5 V: no mark) to the other level (0 V: mark present), and the second edge positions (b and d in FIG. 14B) are calculated on the basis of the scanning positions of data groups following the abovementioned data groups in the scanning direction in the abovementioned memory, which belong to variation regions in which there is a variation from the abovementioned second level (0 V: mark present) to the first level (5 V: no mark).

In this color deviation detection method, for example, a check can be made in order to ascertain whether or not the position difference between the two edges is a value that corresponds to the mark width (w), so that it can be verified whether or not a mark is detected. Furthermore, the mean value of the positions of both edges can be determined as the center point of the mark. By determining the center points of the marks in this way, it is possible to achieve a great increase in the reliability and precision of the mark position data, so that the reliability of the detection of the mark sequences is greatly improved.

In the present embodiment, a mark distribution pattern detection method is employed in which position information expressing the intermediate points of the calculated positions of the first and second edges is produced as mark positions. If such a mark distribution pattern detection method is used, the reliability and precision of the mark position data are greatly increased, so that the reliability of the detection of the mark sequences is greatly improved.

In the present embodiment, a mark distribution pattern detection method is employed in which only the A/D-converted data of the read-out signals (Sdr/Sdf) in a range between a first level (2 V) and a second level (3 V) that have different values between the "no mark" level (5 V) and "mark present" level (0 V) is stored in the abovementioned memory following the specification of the scanning positions (Nos).

If this mark distribution pattern detection method is used, then the read-out data (Ddr/Ddf) that is stored in the memory comprises only the digital data (Ddr/Ddf) of the read-out signals (Sdr/Sdf) that is equal to or greater than the first level (2 V) but no greater than the second level (3 V), as shown in FIG. 14B. Accordingly, the amount of data requiring storage in memory can be greatly reduced. As a result, a small-capacity memory can be used; furthermore, the data processing can be performed easily and in a short period of time. Alternatively, the sampling pitch (Tsp) of the read-out signals (Sdr/Sdf) can be reduced, so that data can be handled at a high density.

In the present embodiment, a color deviation detection device is used which comprises test pattern forming means for forming a plurality of mark sets comprising arrangements of marks of a plurality of colors that are lined up in the movement direction within the range of one circumference of a transfer medium constituting a transfer drum or transfer belt used for color image formation in which color sensible images of respective colors are formed on a photosensitive body and superimposed and transferred onto transfer paper, optical sensors (20*r*/20*f*) that detect the abovementioned marks, A/D conversion means (36*r*, 36*f*) for digitally converting the detection signals (Sdr/Sdf) of the abovementioned optical sensors into detection data (Ddr/Ddf), a memory (41), data storage control means for specifying the scanning positions (Nos) of the A/D-converted data (Ddr/Ddf) of the abovementioned A/D conversion means, and storing this data in the abovementioned memory, and calculating means for calculating the positions of the abovementioned respective marks on the basis of the A/D-converted data in the abovementioned memory, and calculating the mean values of the amounts of deviation of different mark sets with respect to the reference positions of marks of the same color.

If this color deviation detection device is used, then the reliability of color deviation detection can be improved by considering the numerous fluctuation factors that actually exist, and considering the pattern dispositions in a state that is close to the fluctuation occurring on the transfer belt, and the color deviation detection precision can be improved by minimizing the error caused by the arrangement of the marks in the test patterns.

In the present embodiment, a mark distribution pattern detection device is used in which the abovementioned data storage control means store only the A/D-converted data of the read-out signals of the abovementioned optical sensors that is within a range between a first level and second level that have values that are different from the "no mark" level and "mark present" level in the abovementioned memory after specifying the scanning positions.

If this mark distribution pattern detection device is used, then, as is shown in FIG. 14B, the read-out data (Ddr/Ddf) that is stored in the memory comprises only the digital data (Ddr/Ddf) of the read-out signals (Sdr/Sdf) that is equal to or greater than the first level (2 V) but no greater than the second level (3 V). Accordingly, the amount of data that is stored in the memory can be greatly reduced, As a result, a small-capacity memory can be used; furthermore, the data processing can be performed easily and in a short period of time. Alternatively, the sampling pitch (Tsp) of the read-out signals (Sdr/Sdf) can be reduced, so that data can be handled at a high density.

In the present embodiment, a mark distribution pattern detection device is used in which the abovementioned calculating means calculate the positions of the first edges on the basis of the scanning positions of data groups belonging to variation regions between high and low levels corresponding to the presence or absence of marks (with adjacent scanning positions in the abovementioned memory), in which there is a variation from one level to the other, and calculate the positions of the second edges on the basis of the scanning positions of data groups following the abovementioned data groups in the scanning direction, which belong to variation regions in which there is a variation from the abovementioned second level to the first level.

In the case of this mark distribution pattern detection device, a check can be made in order to ascertain whether or not the position difference between both edges is a value that corresponds to the mark width (w), so that it can be verified whether or not the edge of a mark is detected. Furthermore, the mean value of the positions of both edges can be determined as the center point of the mark. By determining the center points of the marks in this way, it is possible to achieve a great increase in the reliability and precision of the mark position data, so that the reliability of the detection of the mark sequences is greatly improved.

In the present embodiment, a mark distribution pattern detection device is used in which intermediate points between the calculated positions of the first and second edges are calculated as the mark positions. If this mark distribution pattern detection device is used, the reliability and precision of the mark position data are greatly increased, so that the reliability of the detection of the mark sequences is greatly improved.

In the present embodiment, a mark distribution pattern detection device can be used in which abovementioned plurality of marks that are lined up in a row are marks of respective colors that are formed on a photosensitive body, transfer drum, transfer belt or transfer paper by means of a color image forming device in which sensible images of respective colors are formed on a photosensitive body and are overlapped and transferred onto a transfer paper, and the medium that carries the abovementioned marks is the abovementioned photosensitive body, transfer drum, transfer belt or transfer paper.

The amounts of deviation of the images of respective colors that are formed by the respective color image forming units can be calculated on the basis of the position data for the marks of respective colors obtained by means of this mark distribution pattern detection device. If the amounts of color deviation are known, then the color deviation can be eliminated by adjusting the image formation timing or image formation positions of the respective color image forming units.

The present embodiment is a color image forming device in which color sensible images of respective colors are formed on a photosensitive body, and these color sensible images are superimposed and transferred onto transfer paper via a transfer medium constituting a transfer belt 10 or transfer drum, this device comprising test pattern forming means for forming a plurality of mark sets comprising arrangements of marks of respective colors (Akr, Ayr, Amr, Acr/Akf, Ayf, Amf, Acf . . . ) that are lined up in the movement direction (y) within the range of one circumference of the transfer medium, optical sensors (20*r*/20*f*) that detect the abovementioned marks, A/D conversion means (36*r*/36*f*) for digitally converting the detection signals (Sdr/Sdf) of the abovementioned sensors into detection data (Ddr/Ddf), a memory 41, data storage control means (1) for specifying the scanning positions (Nos) of the A/D-converted data (Ddr/Ddf) of the abovementioned A/D conversion means, and storing this data in the abovementioned memory, calculating means for calculating the positions of the abovementioned respective marks on the basis of the A/D-converted data in the abovementioned memory, and calculating the mean values of the amounts of deviation of different mark sets with respect to the reference positions of marks of the same color, and color adjustment means 41 for calculating the image formation deviation amount in colors (dyy, dxy, dLxy . . . ) based on the calculated positions of the respective colors and adjusting the timing of image formation of respective colors so that this deviation is eliminated.

If this color image forming device is used, color deviation caused by the shifting of the color formation timing of the respective color image forming units can be eliminated.

The present embodiment is a color image forming device in which the abovementioned data storage control means (1) store only the A/D-converted data of the read-out signals of the abovementioned optical sensors in a range between a first level and a second level that have different values between the "no mark" level and "mark present" in the abovementioned memory following the specification of the detection signal read-in positions in the abovementioned direction of movement.

If this color image forming device is used, then, as is shown in FIG. 14B, the read-out data (Ddr/Ddf) that is stored in the memory comprises only the digital data (Ddr/Ddf) of the read-out signals (Sdr/Sdf) that is equal to or greater than the first level (2 V) but no greater than the second level (3 V). Accordingly, the amount of data requiring storage in memory can be greatly reduced. As a result, a small-capacity memory can be used; furthermore, the data processing can be performed easily and in a short period of time. Alternatively, the sampling pitch (Tsp) of the read-out signals (Sdr/Sdf) can be reduced, so that data can be handled at a high density.

The present embodiment is a color image forming device in which the abovementioned test pattern formation means (1) form marks of the respective colors (Akr, Ayr, Amr, Acr/Akf, Ayf, Amf, Acf . . . ) in pairs in a specified order and at specified distances on the transfer medium (10) so that these marks are lined up in the movement direction (y) of the transfer medium (10) on both sides (r and f) of an intermediate point on the image exposure line oriented in the direction (x) that is perpendicular to the abovementioned movement direction (y), the abovementioned sensors constitute a pair of sensors that respectively detect the pairs of marks, the abovementioned A/D conversion means also constitute a pair of means corresponding to this arrangement, the abovementioned data storage control means store the A/D-converted data of the respective A/D conversion means in the abovementioned memory, the above-mentioned calculating means calculate the positions of the pairs of marks, and the abovementioned color adjustment means calculate the skewing (dSqy, . . . ) on the basis of the differences in the positions of the pairs of marks calculated for each color, and adjust the attitudes of the exposure lines of the respective colors so that this skewing is eliminated.

If this color image forming device is used, the skewing of the color images can be eliminated in addition to the amounts of deviation in image formation between the respective colors (dyy, dxy, dLxy/ . . . ).

The present embodiment is a color image forming device in which the abovementioned data storage control means (1) include range detection means (39*r*/39*f*) which are devised so that in cases where the read-out signals of the above-mentioned optical sensors are within a range that is equal to or greater than the first level but no greater than the second level, these range detection means produce information that expresses this, and control means (41) which write the A/D-converted data at a specified period (Tsp) (while such information is present) into the above-mentioned memory after specifying the detection signal read-in positions (Nos).

If this color image forming device is used, then the control means (41) need write the A/D-converted data into the memory in response to the above-mentioned information of the range detection means (39*r*/39*f*) only when such information is present. Accordingly, the amount of work that must be performed by the control means (41) is reduced, and the control means (41) can be used to read in high-density detection signals in which the abovementioned period (Tsp) is shortened.

The present embodiment is a color image forming device in which the image forming mechanisms (6*a* through 6*d*/7*a* through 7*d*) are unitized and can be replaced, wherein this device comprises unit replacement detection means (41, 69*a* through 69*d*/79*a* through 79*d*), and color adjustment (CPA) between formed images of a plurality of different colors is performed in response to the detection of unit replacement (FPC=1).

If this color image forming device is used, unit replacement is detected, and color adjustment (CPA) is performed. If a color forming mechanism unit is replaced, e.g., if a latent image carrying unit including a photosensitive drum is replaced, the color image superimposition deviation characteristics vary according to the shift in the axis of the photosensitive drum with respect to the apparatus body (color image forming device main body), the eccentricity of the circumferential surface with respect to the axial center and the like; however, since the color deviation caused by such factors is re-adjusted each time that a unit is replaced, the deviation between colors caused by unit replacement can be eliminated.

The present embodiment is a color image forming device in which the image forming mechanisms including the photosensitive bodies are a plurality of mechanisms (6*a* through 6*d*) and are respectively unitized, wherein the unit replacement detection means comprise a plurality of attachment and detachment detection means (69*a* through 69*d*) that detect the attachment or detachment of individual units.

If this color image forming device is used, color adjustment (CPA) is performed when the replacement of at least one of the plurality of latent image carrying units respectively including photosensitive drums is detected. The color image superimposition deviation characteristics of the individual units vary according to the shift in the axis of the photosensitive drum with respect to the apparatus body (color image forming device main body), the eccentricity of the circumferential surface with respect to the axial center and the like; however, since the color deviation caused by such factors is re-adjusted each time that at least one unit is replaced, color deviation caused by unit replacement does not occur.

The present embodiment is a color image forming device in which a plurality of developing mechanisms (7*a* through 7*d*) with different developing agents are respectively unitized, and the unit replacement detection means include a plurality of attachment and detachment detection means (79*a* through 79*d*) that detect the attachment or detachment of individual units.

If this color image forming device is used, the axial center positions of the photosensitive drums may also be shifted as a result of the replacement of the developing units (7*a* through 7*d*); however, color adjustment (CPA) is performed when the replacement of at least one of the developing units (7*a* through 7*d*) is detected. Since the color deviation is re-adjusted each time that at least one of the developing units (7*a* through 7*d*) is replaced, deviation between colors caused by developing unit replacement does not occur.

In the present embodiment, processing control (m27) that adjusts the image formation processing parameters is also performed when color adjustment (CPA) is performed (see FIG. 9). The units possess individuality in terms of color density reproduction characteristics, and these characteristics also vary according to the number of times of use (number of instances of image formation). Accordingly, if a unit is replaced, the image density and color may also vary. Since the respective color image formation processing parameters are re-adjusted by the processing control (m27), there is no color fluctuation caused by unit replacement.

The present embodiment is a color image forming device comprising a plurality of image forming mechanisms (6*a* through 6*d*/7*a* through 7*d*) which each include a photosensitive body, and which are unitized so as to be detachable with respect to the apparatus body (color image forming device main body), and transfer means (10, 11*a* through 11*d*) for superimposing and transferring the sensible images formed by each of the image forming mechanisms onto transfer paper, wherein this color image forming device comprises replacement detection means (41, 69*a* through 69*d*, 79*a* through 79*d*, 64) for detecting the respective replacement of the abovementioned image forming mechanisms (6*a* through 6*d*/7*a* through 7*d*), means (41) for forming test pattern images with respective color images in different positions in response to the detection of replacement by the above-mentioned replacement detection means, means (20*r*/20*f*, 1) for reading the respective color images of the test pattern images, and color adjustment means (1) for adjusting the image formation positions of the respective image forming mechanisms on the basis of information obtained by reading the respective color images.

If this color image forming device is used, color adjustment (CPA) is performed when image forming mechanism unit replacement is detected. If a unit is replaced, e.g., if a latent image carrying unit including a photosensitive drum is replaced, the color image superimposition deviation characteristics vary according to the shift in the axis of the photosensitive drum with respect to the apparatus body (color image forming device main body), the eccentricity of the circumferential surface with respect to the axial center and the like; however, since the color deviation caused by such factors is automatically re-adjusted each time that a unit is replaced, deviation between colors caused by unit replacement does not occur.

The present embodiment is a color image forming device which comprises mounting detection means (41, 69*a* through 69*d*/79*a* through 79*d*, 64) for detecting the presence or absence of the mounting of respective unitized image forming mechanisms on the apparatus body (color image forming device main body), and detection operating elements (64/74) which are positioned in positions (in the respective image forming mechanism units) viewed as "no mounting" by the mounting detection means during the supply of a new [unit], but which are linked to the driving of image forming functional elements (62/73) inside the units, and move to positions viewed as "mounting present" by the mounting detection means.

If this color image forming device is used, color adjustment (CPA) is performed when a unit is replaced by a newly supplied (new) unit. Color adjustment (CPA) that corrects the deviation between colors caused by the individual image formation characteristics of the new unit is automatically performed. Furthermore, since the parts that are replaced are unitized as described above, the occurrence of problems caused by unit setting mistakes is also suppressed.

Furthermore, in the abovementioned embodiments, a transfer drum may also be used instead of a transfer belt, and photosensitive belts may also be used as image carrying bodies instead of the photosensitive drums 6*a* through 6*d*. Moreover, the optical sensors 20*f* and 20*r* that read the test patterns are not limited to two sensors.

In the present embodiment, a plurality of mark set groups are prepared, and the spacing of the mark set groups is set with the phase of the mark set groups shifted by an amount equal to 360 degrees/number of mark set groups, so that the fluctuation irregularity per revolution of parts that have a circumferential length that is longer than the total length of the mark sets is canceled. In particular, since there are two mark set groups, the phase of the mark set groups is shifted by 360 degrees/2=180 degrees. Accordingly, low-frequency fluctuation irregularities in one revolution that could not be cut out in conventional devices can be canceled, so that the color deviation correction precision can be improved. Furthermore, in regard to the means used to shift the phase of the respective mark sets by 180 degrees, this is achieved in the embodiments of the present invention by shifting the phase of the mark sets of the first group and the phase of the mark sets of the second group by an amount equal to 2.5 periods of the transfer belt 10. This can be realized by the MPU 41 causing test pattern signals to be sent to the write unit 5 from the abovementioned test pattern signal generator so that the phase of the mark sets of the first group and the phase of the mark sets of the second group are shifted by an amount equal to 2.5 periods of the transfer belt 10. Naturally, the amount by which the phases of the respective mark sets are shifted is not limited to 2.5 periods of the transfer belt 10; this amount may also be 0.5 periods of the transfer belt 10, or 1.5, 3.5, 4.5 or N.5 (N is an integer) periods of the transfer belt 10.

Furthermore, since the mark sets are disposed as shown in FIG. 59B, and the calculation method is set so that the amount of correction used during image formation is determined as (a+b)/2 from the correction amount a determined by the color deviation correction 1 and the correction amount b determined by the color deviation correction 2 (e.g., as (a+b+c+d)/4 from the correction amounts a, b, c and d determined four color deviation corrections in cases where color deviation correction is performed four times), the low-frequency fluctuation irregularities in one revolution can be canceled, so that the color deviation correction precision can be improved.

Furthermore, the present invention is devised so that color deviation correction is performed in order to handle the new transfer belt when the transfer belt or a unit using the transfer belt is replaced. Unit replacement sensors or the like that detect the replacement of the abovementioned units may be disposed so that this is performed automatically, or this procedure may be described in a procedural manual or the like.

Figure 60:
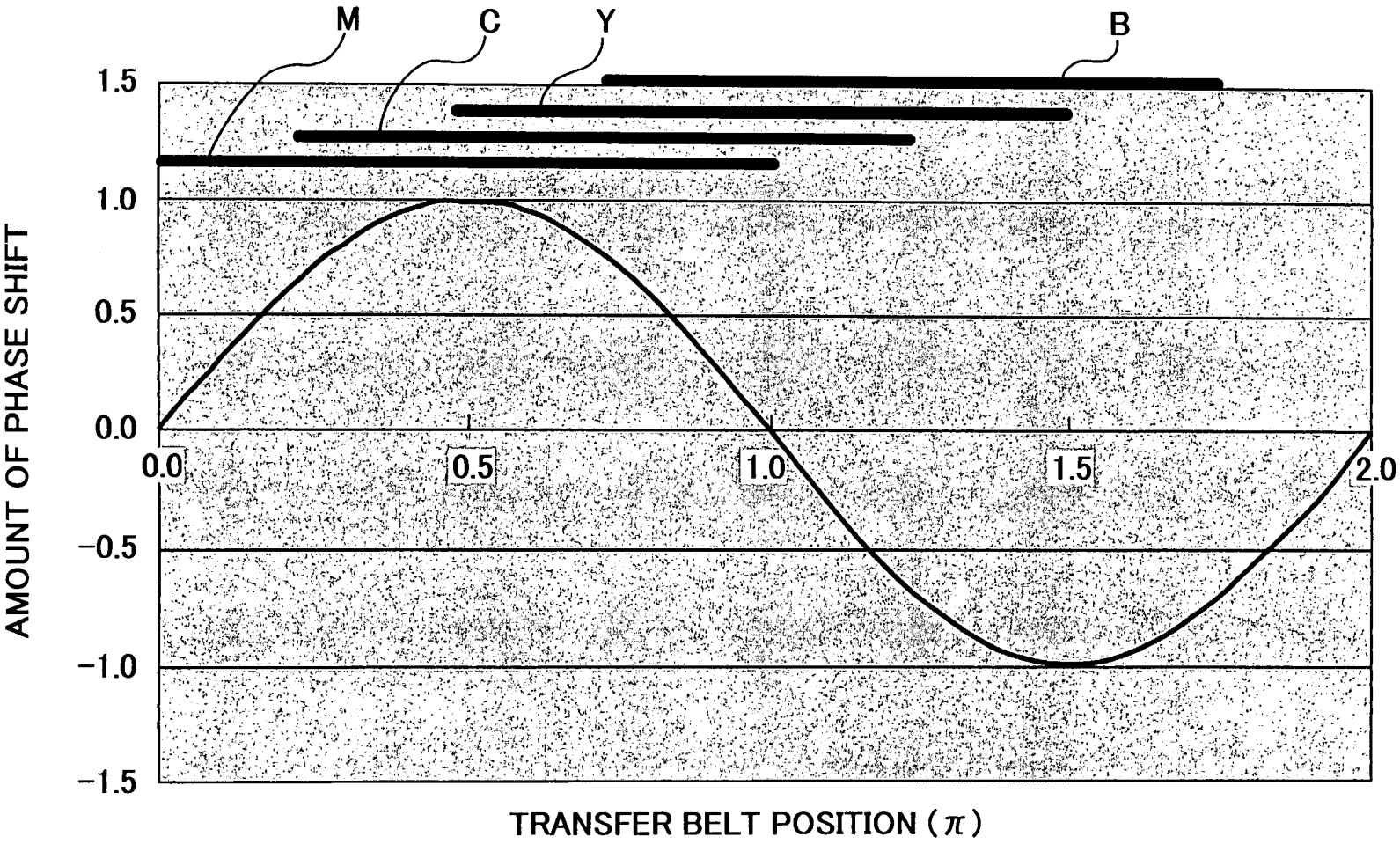
FIG. 60 is a diagram which expresses the fluctuation of the position (positional deviation amount) of the transfer belt in the above-mentioned embodiment as a sine wave.

In FIG. 60, the vertical axis shows the positional fluctuation (amount of positional deviation) of the transfer belt 10 as a sine wave, and the horizontal axis shows the image formation timing for the respective colors. In the case of a part with a long circumferential length such as a transfer belt or the like, the frequency is a low frequency as shown in FIG. 60; accordingly, the positional fluctuation differs when image formation is performed for the respective colors. As is also seen from FIG. 60, this is a cause of color deviation.

Figure 61:
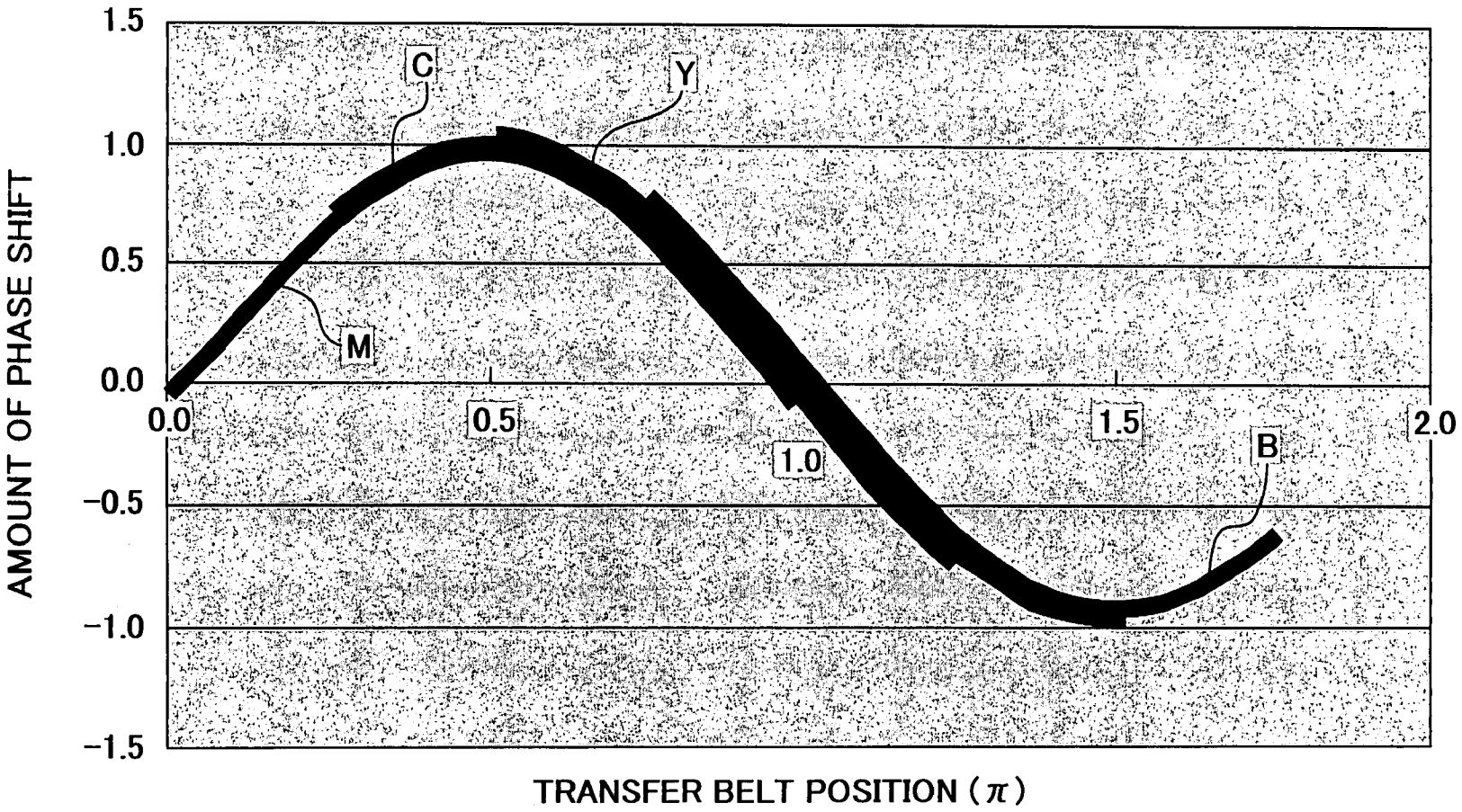
FIG. 61 is a diagram which shows in model form the positional deviations of the respective colors in the abovementioned embodiment.
Figure 62:
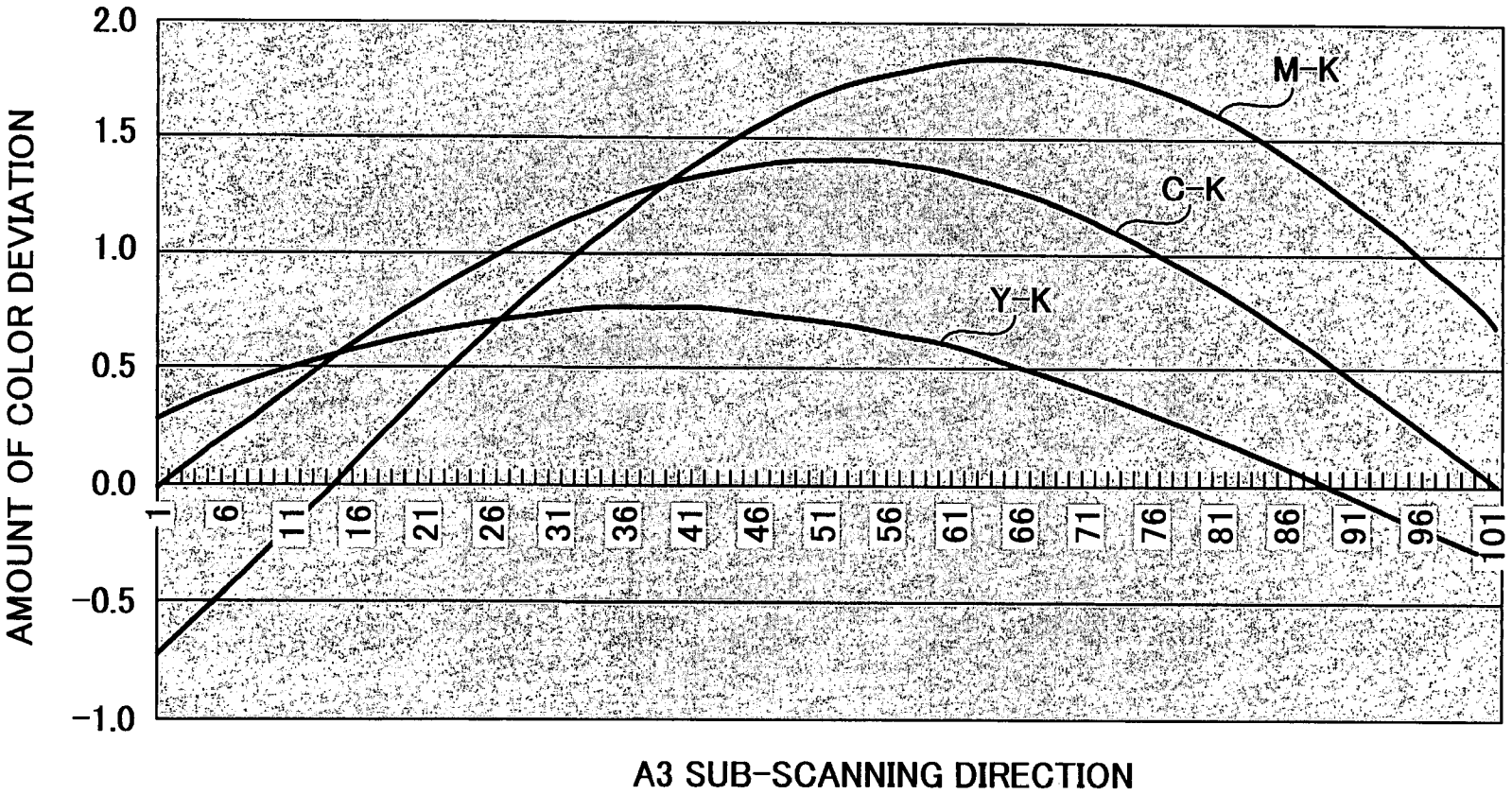
FIG. 62 is a diagram which expresses the positional deviations of the respective colors in the abovementioned embodiment as movement (color deviation) on the actual image.

FIG. 61 shows the positional deviation for the respective colors in model form (the deviation from the image drawing position viewed as skewing is called "positional deviation", while the relative deviation between two colors is called "color deviation"). Thus, the positional deviations of the respective colors vary according to low-frequency fluctuations. FIG. 62 shows such fluctuations as actual movements (color deviation) on the image. This is expressed as a color deviation with respect to black from FIG. 61; here, M-K, C-K and Y-K are calculated.

As is seen from this FIG. 62, even if the amplitude of the fluctuations in the transfer belt 10 is 1 in terms of 0—peak (FIG. 60), the maximum values of the color deviations for the respective colors may exceed 1 (the calculations performed here combine magenta writing and a fluctuation phase of 0 degrees for the transfer belt 10; in actuality, this fluctuation phase is constantly changing); accordingly, the color deviation is amplified by a corresponding ratio.

The present invention offers the following advantages:

(1) The reliability of color deviation detection can be increased, so that the error caused by the arrangement of the marks in the test patterns can be minimized, and the color deviation correction precision can be improved.

(2) The time required for color deviation correction can be shortened, and a high-precision pattern disposition that is suited to an actual device can be obtained. Furthermore, the amount of data requiring storage in memory can be greatly reduced.

(3) The positions of the respective marks can be detected by relatively simple processing, so that deviation between overlapping images of respective colors in color image formation can be detected relatively easily.

(4) The reliability of color deviation detection can be increased, so that error caused by the arrangement of the marks in the test patterns can be minimized, thus making it possible to improve the color deviation correction precision.

(5) Color deviation can be eliminated.

(6) Deviation between colors cause by unit replacement can be eliminated.

(7) An increase in cost can be prevented, and the color deviation correction precision can be improved.

(8) An appropriate balance between waiting time for the customer and color deviation correction precision can be obtained.

(9) Both a low cost and good quality can be achieved.

Various modifications will become possible for those skilled in the art after receiving the teachings of the present disclosure without departing from the scope thereof.

What is claimed is:

1. A color deviation detection method in which a plurality of mark sets constructed by arrangements of marks of respective colors that are lined up in the direction of movement are formed on a transfer medium in a color image forming device in which an image carrying body is rotated by an image carrying body driving system, the transfer medium is rotated by a transfer driving system, an image of a plurality of colors is formed on said image carrying body, and the image of a plurality of colors is superimposed on and transferred onto said transfer medium, and the respective marks of the plurality of mark sets are detected by sensors so that the amount of deviation of said image is detected, wherein the spacing between marks of the reference color and other colors, the spacing between marks of the same color, and the spacing between mark sets, are set as the spacing between marks within said mark sets and the spacing between mark sets, so that when the amount of color deviation is calculated for a synthesized wave comprising two or more driving irregularity frequencies that are generated by said image carrying body driving system and said transfer driving system, the calculation error caused by said synthesized wave is within a range that allows correction of the deviation of said image of a plurality of colors wherein the mark sets are arranged in groups, and a spacing between the groups is arranged such that a fluctuation irregularity per revolution of parts of the transfer medium having a circumferential length longer than the mark set is cancelled.

2. The color deviation detection method as claimed in claim 1, wherein the total length of said plurality of mark sets formed on said transfer medium is substantially the same as or shorter than the circumferential length per revolution of said synthesized wave showing the lowest frequency.

3. The color deviation detection method as claimed in claim 1, wherein the detection signals of said sensors are converted into digital data at a specified pitch, and are stored in memory with the scanning position specified, and distribution information for said respective marks is produced on a basis of the scanning positions of data groups with adjacent scanning positions belonging to specified detection signal variation regions in the memory.

4. A color deviation detection method in which a plurality of mark sets constructed by arrangements of marks of respective colors that are lined up in the direction of movement are formed on a transfer medium in a color image forming device in which an image carrying body is rotated by an image carrying body driving system, the transfer medium is rotated by a transfer driving system, an image of a plurality of colors is formed on said image carrying body, and the image of a plurality of colors is superimposed on and transferred onto said transfer medium, and the respective marks of the plurality of mark sets are detected by sensors so that the amount of deviation of said image is detected, wherein the spacing between marks of the reference color and other colors, the spacing between marks of the same color, and the spacing between mark sets, are set as the spacing between marks within said mark sets and the spacing between mark sets, so that when the amount of color deviation is calculated for a synthesized wave comprising two or more driving irregularity frequencies that are generated by said image carrying body driving system and said transfer driving system, the calculation error caused by said synthesized wave is 20 μm or less.

5. The color deviation detection method as claimed in claim 4, wherein the total length of said plurality of mark sets formed on said transfer medium is substantially the same as or shorter than the circumferential length per revolution of said synthesized wave showing the lowest frequency.

6. The color deviation detection method as claimed in claim 4, wherein the detection signals of said sensors are converted into digital data at a specified pitch, and are stored in memory with the scanning position specified, and distribution information for said respective marks is produced on a basis of the scanning positions of data groups with adjacent scanning positions belonging to specified detection signal variation regions in the memory.

7. A color deviation detection device for a color image forming device in which an image carrying body is rotated by an image carrying body driving system, a transfer medium is rotated by a transfer driving system, an image of a plurality of colors is formed on said image carrying body, and the image of a plurality of colors is superimposed on and transferred onto said transfer medium, comprising:

test pattern forming means for forming a plurality of mark sets comprising arrangements of marks of a plurality of colors that are lined up in the movement direction within the range of the circumference of said transfer medium;

sensors configured to detect said marks;

conversion means for converting detection signals of said sensors into digital data;

a memory configured to store the converted data from said conversion means with the positions specified; and calculating means for calculating the positions of said respective marks on the a basis of the data in said memory, and calculating the mean values of the amounts of deviation of said different mark sets with respect to the reference positions of marks of the same color, wherein the calculating means further calculates a spacing between groups of the mark sets, the groups of mark sets in which a specified number of marks are taken as one group are formed within one color deviation correction operation, the spacing being arranged such that a fluctuation irregularity per revolution of parts of the transfer medium having a circumferential length longer than the mark set is cancelled.

8. A color image forming device in which an image carrying body is rotated by an image carrying body driving system, a transfer medium is rotated by a transfer driving system, an image of a plurality of colors is formed on said image carrying body, and the image of a plurality of colors is superimposed on and transferred onto said transfer medium, comprising:

test pattern forming means for forming a plurality of mark sets comprising arrangements of marks of a plurality of colors that are lined up in the movement direction within the range of the circumference of said transfer medium;

sensors configured to detect said marks;

conversion means for converting detection signals of said sensors into digital data;

a memory configured to store the converted data from said conversion means with the positions specified;

calculating means for calculating the positions of said respective marks on a basis of the data in said memory, and calculating the mean values of the amounts of deviation of said different mark sets with respect to the reference positions of marks of the same color; wherein the calculating means further calculates a spacing between groups of the mark sets, the groups of mark sets in which a specified number of marks are taken as one group are formed within one color deviation correction operation, the spacing being arranged such that a fluctuation irregularity per revolution of parts of the transfer medium having a circumferential length longer than the mark set is cancelled; and color adjustment means for adjusting the image formation timing of said image of a plurality of colors on the a basis of the mean values of the amounts of deviation calculated by said calculating means.

9. The color image forming device as claimed in claim 8, wherein said color image forming device is a tandem drum type color image forming device.

10. The color image forming device as claimed in claim 9, further comprising charging means, developing means and cleaning means for forming an image of a plurality of colors on the image carrying body, and a process cartridge which is combined with at least one of the charging means, developing means or cleaning means, and which is installed in a freely detachable manner in the image forming device.

11. The color image forming device as claimed in claim 8, wherein at least two groups of mark sets in which a specified number of marks are taken as one group are formed within one color deviation correction operation, and said plurality of mark sets are disposed so that the phase of the write timing of the spacing of said mark sets of the respective groups is shifted by 360 degrees/n, n being the number of groups of said mark sets with respect to a wave having a frequency per revolution that is lower than the frequency which is determined from the length of said mark sets of all of the groups.

12. The color image forming device as claimed in claim 11, wherein in the calculation of the correction values that are finally reflected in image formation, the correction values are determined by averaging in said correction values obtained from said mark sets of the first group, said values obtained from said mark sets of the second group, and the calculated values obtained from said mark sets of the nth group.

13. The color image forming device as claimed in claim 11, wherein the detection and correction of said color deviation amount are performed at least at a timing at which a part having said frequency per revolution lower than the frequency determined from the length of said mark sets of all of the groups is replaced.

14. The color image forming device as claimed in claim 8, wherein two groups of mark sets in which a specified number of marks are taken as one group are formed within one color deviation correction operation, and said two groups of mark sets are disposed so that the phase is shifted by 180 degrees with respect to a wave of the period of an endless belt used as said transfer medium, which is a wave having a frequency per revolution that is lower than the frequency determined from the length of said mark sets of one group.

15. The color image forming device as claimed in claim 14, wherein the write positions of the mark sets of the second group among said two groups of mark sets are the positions which are reached after 2.5 cycles in the rotational period of said endless belt from the write positions of the mark sets of the first group among said two groups of mark sets.

16. The color image forming device as claimed in claim 14, wherein the thickness of said endless belt is 1 mm or less, and the thickness deviation of said endless belt is 10% of said thickness or less.

17. The color image forming device as claimed in claim 14, wherein the length of said mark sets of one group is 50% of the circumferential length of said endless belt or less.

18. A process cartridge which is disposed in a detachable manner in the main body of a color image forming device in which an image carrying body is rotated by an image carrying body driving system, a transfer medium is rotated by a transfer driving system, an image of a plurality of colors is formed on said image carrying body, and the image of a plurality of colors is superimposed on and transferred onto said transfer medium, said process cartridge being constructed by being combined with at least one of charging means, developing means and cleaning means for forming an image of a plurality of colors on said image carrying body, and said image forming device further comprising test pattern forming means for forming a plurality of mark sets comprising arrangements of marks of a plurality of colors that are lined up in the movement direction within the range of the circumference of said transfer medium, sensors configured to detect said marks, conversion means for converting detection signals of said sensors into digital data, a memory configured to store the converted data from said conversion means with the positions specified, calculating means for calculating the positions of said respective marks on a basis of the data in said memory, and calculating the mean values of the amounts of deviation of said different mark sets with respect to the reference positions of marks of the same color, and color adjustment means for adjusting the image formation timing of said image of a plurality of colors on a basis of the mean values of the amounts of deviation calculated by said calculating means, and wherein the calculating means further calculates a spacing between groups of the mark sets, the groups of mark sets in which a specified number of marks are taken as one group are formed within one color deviation correction operation, the spacing being arranged such that a fluctuation irregularity per revolution of parts of the transfer medium having a circumferential length longer than the mark set is cancelled.

19. A color deviation detection and correction method in which the amount of deviation of an image is detected by a color deviation detection method in which a plurality of mark sets constructed by arrangements of marks of respective colors that are lined up in the direction of movement are formed on a transfer medium in a color image forming device in which an image carrying body is rotated by an image carrying body driving system, the transfer medium is rotated by a transfer driving system, an image of a plurality of colors is formed on said image carrying body, and the image of a plurality of colors is superimposed on and transferred onto said transfer medium, the respective marks of the plurality of mark sets are detected by sensors so that the amount of deviation of said image is detected providing detection results, and the spacing between marks of the reference color and other colors, the spacing between marks of the same color, and the spacing between mark sets, are set as the spacing between marks within said mark sets and the spacing between mark sets, so that when the amount of color deviation is calculated for a synthesized wave comprising two or more driving irregularity frequencies that are generated by said image carrying body driving system and said transfer driving system, the calculation error caused by said synthesized wave is within a range that allows correction of the deviation of said image of a plurality of colors, and the amount of deviation of said image is corrected on a basis of the detection results, wherein at least two groups of mark sets in which a specified number of marks are taken as one group are formed within one color deviation correction operation, and said plurality of mark sets are disposed so that the phase of the write timing of the spacing of said mark sets of the respective groups is shifted by 360 degrees/n, n being the number of groups of said mark sets with respect to a wave having a frequency per revolution that is lower than the frequency which is determined from the length of said mark sets of all of the groups.

20. The color deviation detection and correction method as claimed in claim 19, wherein in the calculation method of the correction values that are finally reflected in image formation, the values are determined by averaging said correction values obtained from said mark sets of the first group, said values obtained from said mark sets of the second group, and the calculated values obtained from said mark sets of the nth group.

21. The color deviation detection and correction method as claimed in claim 19, wherein the detection and correction of said color deviation amount are performed at least at a timing at which a part having said frequency per revolution lower than the frequency determined from the length of said mark sets of all of the groups is replaced.

22. A color deviation detection and correction method in which the amount of deviation of an image is detected by a color deviation detection method in which a plurality of mark sets constructed by arrangements of marks of respective colors that are lined up in the direction of movement are formed on a transfer medium in a color image forming device in which an image carrying body is rotated by an image carrying body driving system, the transfer medium is rotated by a transfer driving system, an image of a plurality of colors is formed on said image carrying body, and the image of a plurality of colors is superimposed on and transferred onto said transfer medium, the respective marks of the plurality of mark sets are detected by sensors so that the amount of deviation of said image is detected providing detection results, and the spacing between marks of the reference color and other colors, the spacing between marks of the same color, and the spacing between mark sets, are set as the spacing between marks within said mark sets and the spacing between mark sets, so that when the amount of color deviation is calculated for a synthesized wave comprising two or more driving irregularity frequencies that are generated by said image carrying body driving system and said transfer driving system, the calculation error caused by said synthesized wave is 20 μm or less, and the amount of deviation of said image is corrected on a basis of the detection results, wherein at least two groups of mark sets in which a specified number of marks are taken as one group are formed within one color deviation correction operation, and said plurality of mark sets are disposed so that the phase of the write timing of the spacing of said mark sets of the respective groups is shifted by 360 degrees/n, n being the number of groups of said mark sets with respect to a wave having a frequency per revolution that is lower than the frequency which is determined from the length of said mark sets of all of the groups.

23. The color deviation detection and correction method as claimed in claim 22, wherein in the calculation method of the correction values that are finally reflected in image formation, the values are determined by averaging said correction values obtained from said mark sets of the first group, said values obtained from said mark sets of the second group, and the calculated values obtained from said mark sets of the nth group.

24. The color deviation detection and correction method as claimed in claim 22, wherein the detection and correction of said color deviation amount are performed at least at a timing at which a part having said frequency per revolution lower than the frequency determined from the length of said mark sets of all of the groups is replaced.

25. A color deviation detection and correction device in which the amount of deviation of an image is detected by a color deviation detection device in which an image carrying body is rotated by an image carrying body driving system, a transfer medium is rotated by a transfer driving system, an image of a plurality of colors is formed on said image carrying body, and the image of a plurality of colors is superimposed on and transferred onto said transfer medium, the color deviation detection device comprising test pattern forming means for forming a plurality of mark sets comprising arrangements of marks of a plurality of colors that are lined up in the movement direction within the range of the circumference of said transfer medium, sensors configured to detect said marks to provide detection results, conversion means for converting detection signals of said sensors into digital data, a memory configured to store the converted data from said conversion means with the positions specified, and calculating means for calculating the positions of said respective marks on a basis of the data in said memory, and calculating the mean values of the amounts of deviation of said different mark sets with respect to the reference positions of marks of the same color, and the amount of deviation of said image is corrected on a basis of the detection signals, wherein at least two groups of mark sets in which a specified number of marks are taken as one group are formed within one color deviation correction operation, and said plurality of mark sets are disposed so that the phase of the write timing of the spacing of said mark sets of the respective groups is shifted by 360 degrees/n, n being the number of groups of said mark sets with respect to a wave having a frequency per revolution that is lower than the frequency which is determined from the length of said mark sets of all of the groups.

26. The color deviation detection and correction device as claimed in claim 25, wherein in the calculation of the correction values that are finally reflected in image formation, the values are determined by averaging said correction values obtained from said mark sets of the first group, said values obtained from said mark sets of the second group, and the calculated values obtained from said mark sets of the nth group.

27. The color deviation detection and correction device as claimed in claim 25, wherein the detection and correction of said color deviation amount are performed at least at a timing at which a part having said frequency per revolution lower than the frequency determined from the length of said mark sets of all of the groups is replaced.

28. A color deviation detection and correction method in which the amount of deviation of an image is detected by a color deviation detection method in which a plurality of mark sets constructed by arrangements of marks of respective colors that are lined up in the direction of movement are formed on a transfer medium in a color image forming device in which an image carrying body is rotated by an image carrying body driving system, the transfer medium is rotated by a transfer driving system, an image of a plurality of colors is formed on said image carrying body, and the image of a plurality of colors is superimposed on and transferred onto said transfer medium, the respective marks of the plurality of mark sets are detected by sensors so that the amount of deviation of said image is detected providing detection results, and the spacing between marks of the reference color and other colors, the spacing between marks of the same color, and the spacing between mark sets, are set as the spacing between marks within said mark sets and the spacing between mark sets, so that when the amount of color deviation is calculated for a synthesized wave comprising two or more driving irregularity frequencies that are generated by said image carrying body driving system and said transfer driving system, the calculation error caused by said synthesized wave is within a range that allows correction of the deviation of said image of a plurality of colors, and the amount of deviation of said image is corrected on a basis of the detection results, wherein two groups of mark sets in which a specified number of marks are taken as one group are formed within one color deviation correction operation, and said two groups of mark sets are disposed so that the phase is shifted by 180 degrees with respect to a wave of the period of an endless belt used as said transfer medium, which is a wave having a frequency per revolution that is lower than the frequency determined from the length of said mark sets of one group.

29. The color deviation detection and correction method as claimed in claim 28, wherein the write positions of the mark sets of the second group among said two groups of mark sets are the positions which are reached after 2.5 cycles in the rotational period of said endless belt from the write positions of the mark sets of the first group among said two groups of mark sets.

30. The color deviation detection and correction method as claimed in claim 28, wherein the thickness of said endless belt is 1 mm or less, and the thickness deviation of said endless belt is 10% of said thickness or less.

31. The color deviation detection and correction method as claimed in claim 28, wherein the length of said mark sets of one group is 50% of the circumferential length of said endless belt or less.

32. A color deviation detection and correction method in which the amount of deviation of an image is detected by a color deviation detection method in which a plurality of mark sets constructed by arrangements of marks of respective colors that are lined up in the direction of movement are formed on the transfer medium in a color image forming device in which an image carrying body is rotated by an image carrying body driving system, a transfer medium is rotated by a transfer driving system, an image of a plurality of colors is formed on said image carrying body, and the image of a plurality of colors is superimposed on and transferred onto said transfer medium, the respective marks of the plurality of mark sets are detected by sensors providing detection results so that the amount of deviation of said image is detected, and the spacing between marks of the reference color and other colors, the spacing between marks of the same color, and the spacing between mark sets, are set as the spacing between marks within said mark sets and the spacing between mark sets, so that when the amount of color deviation is calculated for a synthesized wave comprising two or more driving irregularity frequencies that are generated by said image carrying body driving system and said transfer driving system, the calculation error caused by said synthesized wave is 20 μm or less, and the amount of deviation of said image is corrected on a basis of the detection results, wherein two groups of mark sets in which a specified number of marks are taken as one group are formed within one color deviation correction operation, and said two groups of mark sets are disposed so that the phase is shifted by 180 degrees with respect to a wave of the period of an endless belt used as said transfer medium, which is a wave having a frequency per revolution that is lower than the frequency determined from the length of said mark sets of one group.

33. The color deviation detection and correction method as claimed in claim 32, wherein the write positions of the mark sets of the second group among said two groups of mark sets are the positions which are reached after 2.5 cycles in the rotational period of said endless belt from the write positions of the mark sets of the first group among said two groups of mark sets.

34. The color deviation detection and correction method as claimed in claim 32, wherein the thickness of said endless belt is 1 mm or less, and the thickness deviation of said endless belt is 10% of said thickness or less.

35. The color deviation detection and correction method as claimed in claim 32, wherein the length of said mark sets of one group is 50% of the circumferential length of said endless belt or less.

36. A color deviation detection and correction device in which the amount of deviation of an image is detected by a color deviation detection device in which an image carrying body is rotated by an image carrying body driving system, a transfer medium is rotated by a transfer driving system, an image of a plurality of colors is formed on said image carrying body, and the image of a plurality of colors is superimposed on and transferred onto said transfer medium the color deviation detection device comprising test pattern forming means for forming a plurality of mark sets comprising arrangements of marks of a plurality of colors that are lined up in the movement direction within the range of the circumference of said transfer medium, sensors configured to detect said marks to provide detection results, conversion means for converting detection signals of said sensors into digital data, a memory configured to store the converted data from said conversion means with the positions specified, and calculating means for calculating the positions of said respective marks on a basis of the data in said memory, and calculating the mean values of the amounts of deviation of said different mark sets with respect to the reference positions of marks of the same color, and the amount of deviation of said image is corrected on a basis of the detection results, wherein two groups of mark sets in which a specified number of marks are taken as one group are formed within one color deviation correction operation, and said two groups of mark sets are disposed so that the phase is shifted by 180 degrees with respect to a wave of the period of an endless belt used as said transfer medium, which is a wave having a frequency per revolution that is lower than the frequency determined from the length of said mark sets of one group.

37. The color deviation detection and correction device as claimed in claim 36, wherein the write positions of the mark sets of the second group among said two groups of mark sets are the positions which are reached after 2.5 cycles in the rotational period of said endless belt from the write positions of the mark sets of the first group among said two groups of mark sets.

38. The color deviation detection and correction device as claimed in claim 36, wherein the thickness of said endless belt is 1 mm or less, and the thickness deviation of said endless belt is 10% of said thickness or less.

39. The color deviation detection and correction device as claimed in claim 36, wherein the length of said mark sets of one group is 50% of the circumferential length of said endless belt or less.

* * * * *